US009298113B2

(12) United States Patent
Ishida et al.

(10) Patent No.: US 9,298,113 B2
(45) Date of Patent: Mar. 29, 2016

(54) ELECTROPHOTOGRAPHIC PHOTOCONDUCTOR, IMAGE FORMING APPARATUS, AND PROCESS CARTRIDGE

(71) Applicants: Toshihiro Ishida, Shizuoka (JP); Hiroshi Ikuno, Kanagawa (JP); Tetsuya Toshine, Shizuoka (JP); Naohiro Toda, Kanagawa (JP); Takafumi Iwamoto, Shizuoka (JP); Kazuhiro Egawa, Shizuoka (JP)

(72) Inventors: Toshihiro Ishida, Shizuoka (JP); Hiroshi Ikuno, Kanagawa (JP); Tetsuya Toshine, Shizuoka (JP); Naohiro Toda, Kanagawa (JP); Takafumi Iwamoto, Shizuoka (JP); Kazuhiro Egawa, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 128 days.

(21) Appl. No.: 14/155,716

(22) Filed: Jan. 15, 2014

(65) Prior Publication Data

US 2014/0199620 A1 Jul. 17, 2014

(30) Foreign Application Priority Data

| | | |
|---|---|---|
| Jan. 16, 2013 | (JP) | 2013-005567 |
| Jun. 20, 2013 | (JP) | 2013-129362 |
| Oct. 23, 2013 | (JP) | 2013-220117 |

(51) Int. Cl.

| | |
|---|---|
| ***G03G 15/04*** | (2006.01) |
| ***G03G 15/01*** | (2006.01) |
| ***G03G 5/06*** | (2006.01) |
| ***G03G 5/05*** | (2006.01) |
| ***G03G 5/147*** | (2006.01) |

(52) U.S. Cl.

CPC ..... *G03G 5/0614* (2013.01); *G03G 5/0596* (2013.01); *G03G 5/14704* (2013.01); *G03G 5/14708* (2013.01); *G03G 5/14795* (2013.01)

(58) Field of Classification Search

CPC ..... G03G 5/0614; G03G 5/14704
USPC ..... 430/57.1, 58.65, 66, 69; 399/111, 159
See application file for complete search history.

(56) References Cited

U.S. PATENT DOCUMENTS

| | | | | |
|---|---|---|---|---|
| 5,437,950 | A | 8/1995 | Yu et al. | |
| 6,573,018 | B2 * | 6/2003 | Ishibashi et al. | 430/108.2 |
| 2001/0019674 | A1 * | 9/2001 | Asano et al. | 399/223 |

(Continued)

FOREIGN PATENT DOCUMENTS

| | | |
|---|---|---|
| JP | 03-045962 | 2/1991 |
| JP | 05-181299 | 7/1993 |

(Continued)

OTHER PUBLICATIONS

Itami et al., The Effects of Nitrogen Oxide on the Resolution of Organic Photoconductors, pp. 37-40, KONICA Technology Report vol. 13(2000) (With English Abstract).

(Continued)

*Primary Examiner* — Thorl Chea
(74) *Attorney, Agent, or Firm* — Oblon, McClelland, Maier & Neustadt, L.L.P.

(57) ABSTRACT

An electrophotographic photoconductor, including: an electroconductive substrate; and at least a photoconductive layer and a surface layer in this order over the electroconductive substrate, wherein the surface layer includes a resin having no charge transport properties, and first inorganic fine particles, and wherein the first inorganic fine particles are inorganic fine particles having surfaces modified with at least one of a primary amino group and a secondary amino group, and a volume resistivity of the first inorganic fine particles is $1\times10^8$ Ω·cm or less.

19 Claims, 4 Drawing Sheets

(56) References Cited

U.S. PATENT DOCUMENTS

| | | | | |
|---|---|---|---|---|
| 2006/0051688 | A1 | 3/2006 | Toda et al. | |
| 2007/0212626 | A1* | 9/2007 | Toshine et al. | 430/58.7 |

FOREIGN PATENT DOCUMENTS

| | | |
|---|---|---|
| JP | 07-281463 | 10/1995 |
| JP | 09-026685 | 1/1997 |
| JP | 2000-284514 | 10/2000 |
| JP | 2001-194813 | 7/2001 |
| JP | 2002-006526 | 1/2002 |
| JP | 2002-082465 | 3/2002 |
| JP | 2002-229241 | 8/2002 |
| JP | 2006-099028 | 4/2006 |
| JP | 2010-134071 | 6/2010 |
| JP | 2010-139618 | 6/2010 |
| JP | 2011-043574 | 3/2011 |
| JP | 2012-173511 | 9/2012 |

OTHER PUBLICATIONS

Nashimoto, The Effect of Electrode Materials on $O_3$ and $NO_x$ Emissions by Corona Discharging, Journal of Imaging Science vol. 32, No. 5 (1988), pp. 205-210.

* cited by examiner

ELECTROPHOTOGRAPHIC PHOTOCONDUCTOR, IMAGE FORMING APPARATUS, AND PROCESS CARTRIDGE

BACKGROUND OF THE INVENTION

1. Field of the Invention

The present invention relates to an electrophotographic photoconductor, and an image forming apparatus and a process cartridge using the electrophotographic photoconductor.

2. Description of the Related Art

In recent years, in terms of saving space in offices, expanding business opportunities, and the like, higher speed, smaller size, colorization, particularly higher image quality, easy maintenance, and the like have been desired for image forming apparatuses. These are associated with improvements in the electrical properties and durability of electrophotographic photoconductors, and regarded as problems to be solved.

In terms of improving easy maintenance, a reduction in the frequency of replacement of electrophotographic photoconductors is mentioned. This is decreasing image defects derived from the electrophotographic photoconductors as much as possible over a long period, and is none other than achieving longer life of the electrophotographic photoconductors. In addition, this is also associated with achieving higher image quality of output images over a long period. In order to solve the above problems in the electrophotographic photoconductors, attempts have been made to reduce image defects derived from electrophotographic photoconductors during a long period of use, and a large number of developments for longer life of electrophotographic photoconductors have been reported. In order to achieve longer life of electrophotographic photoconductors, it is necessary to improve durability against various hazards to the electrophotographic photoconductors during image formation. Here, the hazards are broadly divided into two types, mechanical hazards and chemical hazards.

As one example of the mechanical hazards, a hazard derived from cleaning means (the so-called blade cleaning) for removing a toner remaining on an electrophotographic photoconductor is known. The blade cleaning is means that forcedly removes a toner from an electrophotographic photoconductor by abutting an elastic member, such as a cleaning blade, on the photoconductor, and is space-saving and has large toner removal ability. Therefore, the blade cleaning is known as means effective in achieving smaller size of image forming apparatuses. But, a problem of such a cleaning system is that the elastic member, such as a cleaning blade, is directly abutted and slid on the electrophotographic photoconductor, and therefore, the mechanical stress on the electrophotographic photoconductor is very large, and the outermost surface of the electrophotographic photoconductor is likely to be abraded. Therefore, techniques for inhibiting the abrasion of an electrophotographic photoconductor by laminating a high hardness protective layer are proposed (for example, see Japanese Patent Application Laid-Open (JP-A) No. 05-181299, Japanese Patent Application Laid-Open (JP-A) No. 2002-06526, Japanese Patent Application Laid-Open (JP-A) No. 2002-82465, Japanese Patent Application Laid-Open (JP-A) No. 2000-284514, and Japanese Patent Application Laid-Open (JP-A) No. 2001-194813).

One example of the chemical hazards includes an electrostatic hazard caused by the application of electrostatic stress to an electrophotographic photoconductor. In the usual image forming process, a charge is applied to an electrophotographic photoconductor surface, and the electrophotographic photoconductor surface is charged to a predetermined potential, and then, the charge applied to the surface is removed via the photoconductor by the exposure of the electrophotographic photoconductor. At this time, the charge passes through the layers (for example, a surface layer, a charge generation layer, a charge transport layer, and an intermediate layer) of the electrophotographic photoconductor, and thus, electrostatic stress is applied to the electrophotographic photoconductor. Currently, most of widespread electrophotographic photoconductors contain organic materials. Therefore, in the current electrophotographic process such that charging and discharging are repeated, the organic materials constituting the electrophotographic photoconductor are gradually deteriorated by the electrostatic hazard, causing a decrease in electrophotographic properties as mentioned as the occurrence of charge trapping in the layers, and a change in charging properties, light attenuation properties, and the like.

In addition, as one example of the chemical hazards, a hazard due to acidic gases, alkaline gases, and the like produced when the surface of an electrophotographic photoconductor is charged to apply a charge, or the like is also known. Acidic gases, such as ozone and nitrogen oxides, are generated in the vicinity of a charging device (for example, see KONICA Technology Report Vol. 13 (2000)). Therefore, when an electrophotographic photoconductor is exposed to these acidic gases, the charge-transporting materials, such as the hole-transporting material and the electron-transporting material, contained in the electrophotographic photoconductor are deteriorated by the acidic gases (for example, see Journal of Imaging Science 32: 205-210 (1988)), and the properties of the electrophotographic photoconductor decrease. When an electrophotographic photoconductor having short life is used, deterioration due to acidic gases often occurs only in the outermost layer of the electrophotographic photoconductor, and the amount of the deteriorated components is also small. On the other hand, when an electrophotographic photoconductor having long life is used, deterioration due to acidic gases may reach the inside of the electrophotographic photoconductor, and many deteriorated components are contained in the electrophotographic photoconductor. As a result, a decrease in image density, scumming, the deterioration of the uniformity of images during continuous output, and the like occur, and a problem is that the output of images having high image quality cannot be maintained during a long period of use.

In order to solve the problems of the chemical hazards, techniques of adding an antioxidant to a charge transport layer and a surface layer to inhibit the deterioration of the charge-transporting material due to acidic gases are proposed (for example, see Japanese Patent Application Laid-Open (JP-A) No. 2006-099028 and Japanese Patent Application Laid-Open (JP-A) No. 2010-139618). In addition, techniques for reducing the gas permeability of a charge transport layer and a surface layer in order to inhibit acidic gases from permeating into these layers are proposed (for example, see Japanese Patent Application Laid-Open (JP-A) No. 03-45962 and Japanese Patent Application Laid-Open (JP-A) No. 07-281463). In addition, techniques for inhibiting the generation of discharge products (acidic gases) in a charging step are proposed (for example, see Japanese Patent Application Laid-Open (JP-A) No. 09-026685 and Japanese Patent Application Laid-Open (JP-A) No. 2002-229241).

But, even if these proposed techniques are used, an essential improvement is not achieved because relatively large amounts of oxidatively deteriorated components are contained in the electrophotographic photoconductor, and a problem is that the output of high quality images cannot be maintained when the electrophotographic photoconductor is used for a long period.

In addition, in recent years, techniques of modifying electroconductive fine particles or insulating fine particles with a compound having the function of an antioxidant, and adding the electroconductive fine particles or the insulating fine particles to a surface layer have been known (for example, see Japanese Patent Application Laid-Open (JP-A) No. 2011-043574 and Japanese Patent Application Laid-Open (JP-A) No. 2012-173511). When insulating fine particles are modified with a compound having the function of an antioxidant, it is essential to add a charge transport agent to a surface layer in order to reduce the potential after exposure. Therefore, the mechanical durability and the chemical durability are poor. In addition, also when electroconductive fine particles are modified with a compound having an antioxidant function, a sufficient function cannot be exhibited in some cases depending on the modifying compound species.

Therefore, under the present circumstances, there is a strong need for the development of an electrophotographic photoconductor in which oxidative deterioration and abrasion due to a long period of use are extremely reduced, defects associated with the output image quality of an image forming apparatus are reduced, and excellent image quality is maintained over a long period, and an image forming apparatus and a process cartridge using the electrophotographic photoconductor.

SUMMARY OF THE INVENTION

It is an object of the present invention to provide an electrophotographic photoconductor in which oxidative deterioration and abrasion due to a long period of use are extremely reduced, defects associated with the output image quality of an image forming apparatus are reduced, and excellent image quality is maintained over a long period.

The electrophotographic photoconductor of the present invention as means for solving the problems is an electrophotographic photoconductor including an electroconductive substrate, and at least a photoconductive layer and a surface layer in this order over the electroconductive substrate, wherein the surface layer contains at least first inorganic fine particles and a resin having no charge transport properties, and the first inorganic fine particles are inorganic fine particles having surfaces modified with at least one of a primary amino group and a secondary amino group, and a volume resistivity of the first inorganic fine particles is $1\times10^8$ Ω·cm or less.

The present invention can solve the conventional problems, and can provide an electrophotographic photoconductor in which oxidative deterioration and abrasion due to a long period of use are extremely reduced, defects associated with the output image quality of an image forming apparatus are reduced, and excellent image quality is maintained over a long period.

Figure 1:
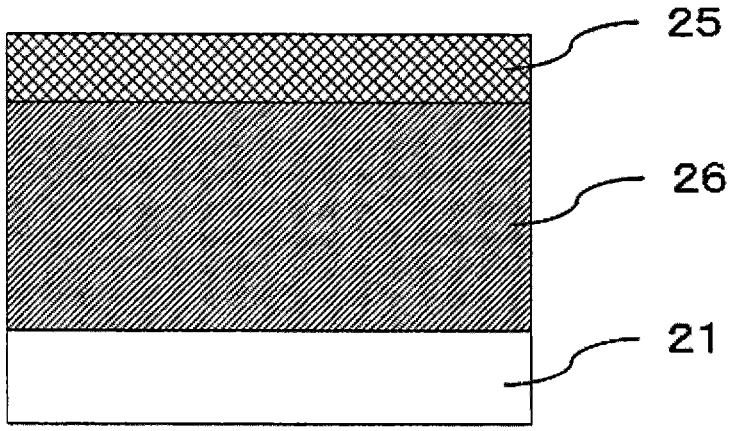
FIG. 1 is a schematic view showing one example of the layer configuration of the electrophotographic photoconductor of the present invention.

DETAILED DESCRIPTION OF THE INVENTION (Electrophotographic Photoconductor)

The electrophotographic photoconductor of the present invention includes an electroconductive substrate, and at least a photoconductive layer and a surface layer in this order on the electroconductive substrate, and further includes other layers as required.

The electrophotographic photoconductor of the present invention has materials defined in the present invention in the surface layer. For the electroconductive substrate, the photoconductive layer, and the other layers, those similar to conventional ones can be applied.

<Surface Layer>

The surface layer contains at least a resin having no charge transport properties, and first inorganic fine particles, preferably contains any of compounds represented by the following general formulas (1) to (7), and second inorganic fine particles, and further contains other components as required.

<<Resin Having No Charge Transport Properties>>

The having no charge transport properties in the resin having no charge transport properties refers to having no hole-transporting structure or electron-transporting structure.

Examples of the hole-transporting structure include structures that triarylamine, hydrazone, pyrazoline, carbazole, and the like have. Examples of the electron-transporting structure include electron-withdrawing aromatic rings, such as condensed polycyclic quinones, diphenoquinone, a cyano group, and a nitro group.

The resin having no charge transport properties is not particularly limited, and can be appropriately selected according to the purpose. Examples of the resin having no charge transport properties include thermoplastic resins having no electron-transporting structure, and crosslinked resins of crosslinking-polymerizable compounds having a crosslinkable functional group. Among these, crosslinked resins of crosslinking-polymerizable compounds are preferred in terms of mechanical durability.

—Thermoplastic Resins Having No Electron-Transporting Structure—

The thermoplastic resins having no electron-transporting structure are not particularly limited, and can be appropriately selected according to the purpose. Examples of the thermoplastic resins having no electron-transporting structure include thermoplastic resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate resins, phenoxy resins, polycarbonates, cellulose acetate resins, ethyl cellulose resins, polyvinyl butyral, polyvinyl formal, polyvinyl toluene, and poly-N-vinylcarbazole. One of these may be used alone, or two or more of these may be used in combination. Among these, polycarbonate resins and polyarylate resins are preferred.

—Crosslinked Resins of Crosslinking-Polymerizable Compounds—

The crosslinked resins of crosslinking-polymerizable compounds are not particularly limited, and can be appropriately selected according to the purpose. Examples of the crosslinked resins of crosslinking-polymerizable compounds include resins, such as acrylic resins, phenolic resins, urethane resins, organosilicon resins, and epoxy resins. One of these may be used alone, or two or more of these may be used in combination. Among these crosslinked resins of crosslinking-polymerizable compounds, acrylic resins are preferred in terms of the charge transport properties and latent image keeping properties of the surface layer.

—Acrylic Resins—

The acrylic resins are obtained by mixing an acrylic polymerizable compound and a radical polymerization initiator, and performing crosslinking. The synthesis method is not particularly limited, and can be appropriately selected according to the purpose. A method of synthesizing an acrylic resin by mixing a known acrylic polymerizable compound and a known radical polymerization initiator, and applying the energy of heating, light irradiation, or the like for crosslinking is preferred.

The polymerizable functional group in the acrylic polymerizable compound is not particularly limited, and can be appropriately selected according to the purpose. In terms of crosslinking reactivity, an acryloyloxy group, a methacryloyloxy group, and the like are preferred.

The number of polymerizable functional groups of the acrylic polymerizable compound is not particularly limited, and can be appropriately selected according to the purpose. The number of polymerizable functional groups is preferably two or more in terms of surface layer strength and film forming properties.

The acrylic polymerizable compound in which the number of polymerizable functional groups is two is not particularly limited, and can be appropriately selected according to the purpose. Examples of the acrylic polymerizable compound include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentyl glycol diacrylate, EO-modified bisphenol A diacrylate, EO-modified bisphenol F diacrylate, and neopentyl glycol diacrylate.

The acrylic polymerizable compound in which the number of polymerizable functional groups is three or more is not particularly limited, and can be appropriately selected according to the purpose. Examples of the acrylic polymerizable compound include trimethylolpropane triacrylate (TMPTA), trimethylolpropane trimethacrylate, trimethylolpropane alkylene-modified triacrylate, trimethylolpropane ethyleneoxy-modified (hereinafter EO-modified) triacrylate, trimethylolpropane propyleneoxy-modified (hereinafter PO-modified) triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified (ECH-modified) triacrylate, glycerol EO-modified triacrylate, glycerol PO-modified triacrylate, tris (acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerythritol ethoxytetraacrylate, phosphoric acid EO-modified triacrylate, and 2,2,5,5,-tetrahydroxymethylcyclopentanone tetraacrylate. One of these may be used alone, or two or more of these may be used in combination.

The radical polymerization initiator used in combination with the acrylic polymerizable compound is not particularly limited, and can be appropriately selected according to the purpose. Examples of the radical polymerization initiator include thermal polymerization initiators, such as peroxide-based initiators and azo-based initiators; and photopolymerization initiators, such as acetophenone-based photopolymerization initiators, ketal-based photopolymerization initiators, benzoin ether-based photopolymerization initiators, benzophenone-based photopolymerization initiators, thioxanthone-based photopolymerization initiators, titanocene-based photopolymerization initiators, acridine-based compounds, triazine-based compounds, and imidazole-based compounds. One of these may be used alone, or two or more of these may be used in combination. Among these, photopolymerization initiators are preferred.

The radical polymerization initiator may be used alone or in combination with a radical polymerization accelerator. The radical polymerization accelerator is not particularly limited, and can be appropriately selected according to the purpose. Examples of the radical polymerization accelerator include triethanolamine, methyldiethanolamine, ethyl 4-dimethylaminobenzoate, isoamyl 4-dimethylaminobenzoate, (2-dimethylamino)ethyl benzoate, and 4,4'-dimethylaminobenzophenone.

The content of the radical polymerization initiator is not particularly limited, and can be appropriately selected according to the purpose. The content of the radical polymerization initiator is preferably 0.5 parts by mass to 40 parts by mass, more preferably 1 part by mass to 20 parts by mass, based on 100 parts by mass of the acrylic polymerizable compound.

—Phenolic Resins—

The phenolic resins are not particularly limited, and can be appropriately selected according to the purpose. Examples of the phenolic resins include novolac resins and resol resins. Among these, resol resins are preferred in that the latent image keeping properties are excellent, and a crosslinking reaction can be performed without using the initiator, compared with novolac resins, which require an initiator, such as an acid catalyst.

The phenolic crosslinking-polymerizable compounds are not particularly limited, and can be appropriately selected according to the purpose. Those synthesized by heating a phenol derivative having one to a plurality of methylol groups in the unit structure for crosslinking are preferred.

As the phenolic resins, commercial products may be used, or appropriately synthesized ones may be used. The synthesis method is not particularly limited, and can be appropriately selected according to the purpose. A method of synthesizing a phenolic resin by heating a phenol derivative having one to a plurality of methylol groups in the unit structure for crosslinking is preferred.

The phenol derivative having one to a plurality of methylol groups in the unit structure is not particularly limited, and can be appropriately selected according to the purpose. Examples of the phenol derivative include dimethylol compounds of monomers of phenols, trimethylol compounds of monomers of phenols, and polymers, such as dimers of phenols. One of these may be used alone, or two or more of these may be used in combination.

The dimethylol compounds of monomers of phenols are not particularly limited, and can be appropriately selected according to the purpose. Examples of the dimethylol compounds of monomers of phenols include 2,6-dihydroxymethyl-4-methylphenol, 2,4-dihydroxymethyl-6-methylphenol, 2,6-dihydroxymethyl-3,4-dimethylphenol, 4,6-dihydroxymethyl-2,3-dimethylphenol, 4-t-butyl-2,6-dihydroxymethylphenol, 4-cyclohexyl-2,6-dihydroxymethylphenol, 2-cyclohexyl-4,6-dihydroxymethylphenol, 2,6-dihydroxymethyl-4-ethylphenol, 4,6-dihydroxymethyl-2-ethylphenol, 4,6-dihydroxymethyl-2-isopropylphenol, and 6-cyclohexyl-2,4-dihydroxymethyl-3-methylphenol.

The trimethylol compounds of monomers of phenols are not particularly limited, and can be appropriately selected according to the purpose. Examples of the trimethylol compounds of monomers of phenols include 2,4,6-trihydroxymethylphenol.

—Urethane Resins—

The urethane resins are not particularly limited, and can be appropriately selected according to the purpose. Examples of the urethane resins include ester-based urethane resins and ether-based urethane resins. One of these may be used alone, or two or more of these may be used in combination.

The urethane resins are not particularly limited, and commercial products may be used, or appropriately synthesized ones may be used. The synthesis method is not particularly limited, and can be appropriately selected according to the purpose. A method of synthesizing a urethane resin by mixing a known polyol compound and a known isocyanate compound, and applying the energy of heating, light irradiation, or the like for crosslinking is preferred.

The polyol compound is not particularly limited, and can be appropriately selected according to the purpose. In terms of excellent surface strength and film forming properties, bi- or higher functional polyol compounds are preferred.

The bi- or higher functional polyol compounds are not particularly limited, and can be appropriately selected according to the purpose. Examples of the bi- or higher functional polyol compounds include diol compounds, such as alkylene glycols, alkylene ether glycols, alicyclic diols, alkylene oxide adducts of alicyclic diols, and alkylene oxide adducts of bisphenols; and tri- or higher hydric polyol compounds, such as polyhydric aliphatic alcohols (for example, glycerin, trimethylolethane, trimethylolpropane, pentaerythritol, and sorbitol), tri- or higher hydric phenols (for example, phenol novolac and cresol novolac), and alkylene oxide adducts of tri- or higher hydric phenols. One of these may be used alone, or two or more of these may be used in combination.

The isocyanate compound is not particularly limited, and can be appropriately selected according to the purpose. In terms of excellent surface layer strength and film forming properties, bi- or higher functional isocyanate compounds are preferred.

The bi- or higher functional isocyanate compounds are not particularly limited, and can be appropriately selected according to the purpose. Examples of the bi- or higher functional isocyanate compounds include tolylene diisocyanate (TDI), diphenylmethane diisocyanate, xylene diisocyanate, hexamethylene diisocyanate, isophorone diisocyanate, bis(isocyanatemethyl)cyclohexane, trimethylhexamethylene diisocyanate, HDI isocyanurate, HDI biuret, XDI trimethylolpropane adducts, IPDI trimethylolpropane adducts, and IPDI isocyanurate. One of these may be used alone, or two or more of these may be used in combination.

The content of the isocyanate compound is not particularly limited, and can be appropriately selected according to the purpose. The content of the isocyanate compound is preferably 0.5 parts by mass to 40 parts by mass, more preferably 1 part by mass to 20 parts by mass, based on 100 parts by mass of the polyol compound. It is preferred that an appropriate amount of the isocyanate compound is blended based on the OH value and the NCO value.

—Epoxy Resins—

The epoxy resins are not particularly limited, and can be appropriately selected according to the purpose. Examples of the epoxy resins include bisphenol A type epoxy resins, bisphenol F type epoxy resins, cresol novolac type epoxy resins, and phenol novolac type epoxy resins. One of these may be used alone, or two or more of these may be used in combination.

As the epoxy resins, commercial products may be used, or appropriately synthesized ones may be used. The synthesis method is not particularly limited, and can be appropriately selected according to the purpose. A method of synthesizing an epoxy resin by mixing an epoxy ring-containing compound having two or more epoxy rings in one molecule and a curing agent, and applying the energy of heating, light irradiation, or the like for crosslinking is preferred.

The epoxy ring-containing compound is not particularly limited, and can be appropriately selected according to the purpose. Examples of the epoxy ring-containing compound include polyalkylene glycol diglycidyl ether, bisphenol A diglycidyl ether, glycerin triglycidyl ether, diglycerol triglycidyl ether, diglycidyl hexahydrophthalate, trimethylolpropane diglycidyl ether, allyl glycidyl ether, and phenyl glycidyl ether. One of these may be used alone, or two or more of these may be used in combination.

The curing agent is not particularly limited, and can be appropriately selected according to the purpose. Examples of the curing agent include thermal acid-generating agents and photo-acid-generating agents. Specific examples include aliphatic amine compounds, alicyclic amine compounds, aromatic amine compounds, modified amine compounds, polyamidoamines, imidazole, polymercaptan, and acid anhydrides. One of these may be used alone, or two or more of these may be used in combination.

The content of the curing agent is not particularly limited, and can be appropriately selected according to the purpose. The content of the curing agent is preferably 0.5 parts by mass to 20 parts by mass, more preferably 1 part by mass to 10 parts by mass, based on 100 parts by mass of the epoxy ring-containing compound.

—Organosilicon Resins—

The organosilicon resins (silicone resins) are not particularly limited, and can be appropriately selected according to the purpose. Examples of the organosilicon resins include dimethylpolysiloxane, methylphenylpolysiloxane, octamethylcyclotetrasiloxane, decamethylcyclopentasiloxane, vinyl silicone, polyether-modified silicone, polyglycerin-modified silicone, amino-modified silicone, epoxy-modified silicone, mercapto-modified silicone, methacryl-modified silicone, carboxylic acid-modified silicone, fatty acid ester-modified silicone, alcohol-modified silicone, alkyl-modified silicone, and fluoroalkyl-modified silicone. One of these may be used alone, or two or more of these may be used in combination.

As the organosilicon resins, commercial products may be used, or appropriately synthesized ones may be used. The synthesis method is not particularly limited, and can be appropriately selected according to the purpose. A method of synthesizing an organosilicon resin by using alone a reactive organosilicon compound having one or more hydrolyzable groups on a silicon atom or mixing the reactive organosilicon compound with a condensation catalyst, and applying the energy of heating or the like for crosslinking is preferred.

The reactive organosilicon compound is not particularly limited, and can be appropriately selected according to the purpose. For example, reactive organosilicon compounds having a structure in which two or more hydrolyzable groups are bonded to a silicon atom are preferred in terms of excellent surface layer strength. The hydrolyzable group is not particularly limited, and can be appropriately selected according to the purpose. Examples of the hydrolyzable group include a methoxy group, an ethoxy group, a methylethylketoxime group, a diethylamino group, an acetoxy group, a propenoxy group, a propoxy group, a butoxy group, and a methoxyethoxy group.

The condensation catalyst is not particularly limited, and can be appropriately selected according to the purpose. Examples of the condensation catalyst include catalysts that act on a condensation reaction in a contact manner, and catalysts that serve to shift the reaction equilibrium of a condensation reaction to a production system. Specific examples include alkali metal salts of organic carboxylic acids, nitrous acid, sulfurous acid, aluminic acid, carbonic acid, thiocyanic acid, and the like; organic amine salts, such as tetramethylammonium hydroxide and tetramethylammonium acetate; and organic acid salts of tin, such as stannous octoate, dibutyltin diacetate, dibutyltin dilaurate, dibutyltin mercaptide, dibutyltin thiocarboxylate, and dibutyltin maleate.

The content of the condensation catalyst is not particularly limited, and can be appropriately selected according to the purpose. The content of the condensation catalyst is preferably 0.5 parts by mass to 20 parts by mass, more preferably 1 part by mass to 10 parts by mass, based on 100 parts by mass of the reactive organosilicon compound.

<<First Inorganic Fine Particles>>

The first inorganic fine particles are not particularly limited as long as they are inorganic fine particles having a volume resistivity of $1\times10^8$ Ω·cm or less, modified with either of primary and secondary amino groups. The first inorganic fine particles can be appropriately selected according to the purpose.

The method for modifying the inorganic fine particles with the either of primary and secondary amino groups is not particularly limited, and can be appropriately selected according to the purpose. Examples of the method include a method for modifying the first inorganic fine particles using a compound having a primary or secondary amino group.

The first inorganic fine particles are not particularly limited, and can be appropriately selected according to the purpose. Examples of the first inorganic fine particles include fine particles of metals, such as gold, silver, copper, and aluminum, and fine particles of metal oxides, such as titanium oxide, tin oxide, zinc oxide, indium oxide, antimony oxide, and ITO. One of these may be used alone, or two or more of these may be used in combination. In terms of replacing the charge transport substance of the surface layer by fine particles for chemical or mechanical durability improvement, inorganic fine particles having relatively high conductivity, and excellent stability over time in the air atmosphere are preferably selected. In addition, even aluminum oxide, silica, zirconium oxide, and the like generally known as insulating particles can be used as long as they have a volume resistivity of $1\times10^8$ Ω·cm or less when modified with at least one of primary and secondary amino groups, by the formation of fine particles, doping with an impurity, and the like. Among these, zinc oxide fine particles doped with group 13 elements are more preferred because they exhibit stable electrical properties over a long period particularly in the air.

The group 13 elements are not particularly limited, and can be appropriately selected according to the purpose. Examples of the group 13 elements include boron, aluminum, gallium, and indium. One of these may be used alone, or two or more of these may be used in combination. Among these, gallium is preferred in that the charge transport properties and latent image keeping properties are excellent, and the electrical properties of the surface layer can be maintained.

The method for doping the first inorganic fine particles with the group 13 element is not particularly limited, and can be appropriately selected according to the purpose. Examples of the method include a firing method in which "zinc oxide that is a bulk matrix" or "a precursor that forms zinc oxide by firing" and "a doping metal" are mixed in a solid state to prepare a mixture, and this mixture is fired in a high temperature atmosphere.

Here, the doping refers to adding the group 13 element to the inorganic fine particles only at a controlled concentration.

The method for confirming that the first inorganic fine particles are doped with the group 13 element is not particularly limited, and can be appropriately selected according to the purpose. Examples of the method include methods of confirming it by generally known elementary analysis methods, such as the X-ray photoelectron spectroscopy method (XPS), the Auger spectroscopy method (AES), and the energy-dispersive X-ray spectroscopy method (EDX).

The content of the group 13 element in the inorganic fine particles is not particularly limited, and can be appropriately selected according to the purpose. For example, in the case of zinc oxide, the content is preferably 0.001 moles to 0.2 moles, more preferably 0.01 moles to 0.1 moles, and further preferably 0.02 moles to 0.1 moles, in terms of the element, based on 1 mole of zinc oxide. If the content is less than 0.001 moles, the electrical property stability of zinc oxide may decrease. If the content is more than 0.2 moles, the electrical property stability and the effect of improving the conductivity of the fine particles are often saturated, and the excess added element not diffused into effective positions is likely to precipitate at grain boundaries as a compound, and therefore, various electrophotographic photoconductor properties may decrease.

The method for measuring the content of the group 13 element in the inorganic fine particles is not particularly limited, and can be appropriately selected according to the purpose. Examples of the method include methods of measuring the content by generally known elementary analysis methods, such as the X-ray photoelectron spectroscopy method (XPS), the Auger spectroscopy method (AES), and the energy-dispersive X-ray spectroscopy method (EDX).

The first inorganic fine particles (zinc oxide doped with the group 13 element) used more preferably contain a sintering inhibitor having a sintering prevention effect on the inorganic fine particle surfaces. By containing the sintering inhibitor, extreme particle growth can be inhibited during particle production, and inorganic fine particles having small variations in primary particle diameter can be provided. In addition, firing at relatively high temperature is possible, and therefore, the diffusion of the dopant element in the inorganic fine particles can be made easy. In addition, by selecting, as the sintering inhibitor, one having higher sintering temperature than the main constituent elements of the inorganic fine particles, the union and aggregation of the inorganic fine particles are less likely to occur during the firing of the inorganic fine particles, and when the inorganic fine particles are applied to applications where a coating film is formed using a dispersion of the inorganic fine particles in a liquid, similar to the applications of the present invention, a coating film with good dispersion of the inorganic fine particles is likely to be obtained.

As the sintering inhibitor, for example, compounds of at least one element selected from Si, Zr, Mg, Hf, Sn, Sr, Mo, W, Ge, Nb, V, Ca, Ta, and Ba are preferred. As the sintering inhibitor having higher sintering temperature than zinc oxide, silica is more preferred.

The content of the sintering inhibitor is preferably in the range of 0.5% by mass to 20% by mass based on the inorganic fine particles (zinc oxide doped with the group 13 element).

When zinc oxide particles surface-modified and doped with gallium are used as the first inorganic fine particles, and Si is used as the sintering inhibitor, the content of Si is preferably 2% by mass to 15% by mass in terms of $SiO_2$.

When the first inorganic fine particles (zinc oxide doped with the group 13 element) having such features is applied to the present invention, a coating film having relatively high transparency can be provided, and zinc oxide having high electrical stability can be provided, achieving the effect of further increasing electrostatic stability, one feature of the electrophotographic photoconductor described in the present invention.

The method for measuring the content of the sintering inhibitor in the first inorganic fine particles (zinc oxide doped with the group 13 element) is not particularly limited as long as it is known elementary quantitative analysis means. The analysis means described can be appropriately selected according to the purpose. Examples of the method include methods of measuring the content by generally known elementary analysis methods, such as the X-ray photoelectron spectroscopy method (XPS), the Auger spectroscopy method (AES), and the energy-dispersive X-ray spectroscopy method (EDX).

The volume resistivity of the first inorganic fine particles is preferably $1\times10^3$ Ω·cm or more and $1\times10^8$ Ω·cm or less, more preferably $1\times10^3$ Ω·cm or more and $1\times10^6$ Ω·cm or less. An electrophotographic photoconductor having a surface layer using inorganic fine particles having a volume resistivity less than $1\times10^3$ Ω·cm is not preferred because the thinning of fine lines or small dots and bleeding are likely to occur even in a suitable range of the electrical properties of the surface layer of the present invention. In addition, a case where inorganic fine particles having a volume resistivity more than $1\times10^6$ Ω·cm is used is not preferred because the environmental dependence of charge transport properties in the surface layer increases, and image density decrease due to a decrease in charge transport properties particularly in a low temperature environment, and the like are likely to occur.

Examples of the method for measuring the volume resistivity of the first inorganic fine particles include a method of making a compact of a predetermined amount of the powder using a predetermined pressure, then providing electrodes at the upper and lower ends of the compact, and measuring the current value when applying a predetermined voltage. In the present invention, pressures at two levels are applied to make a specimen, during the making of a compact, compact porosities and compact volume resistivities are calculated, and then, the resistivity at a porosity of 50 vol % is obtained from exponential function approximation, and taken as the volume resistivity of the inorganic fine particles. The measurement conditions are described below.

Amount of inorganic fine particles used for specimen: 1.0 g

Specimen shape: cylinder (diameter 20 mm)

Pressures during making of specimen: 10 MPa, 20 MPa

Specimen electrodes: W

Applied voltage: 0.1 V

A method for producing the first inorganic fine particles containing the sintering inhibitor will be described below, but the method is not limited to the method described later as long as the same type of inorganic fine particles can be formed.

The method for producing the inorganic fine particles containing the sintering inhibitor (zinc oxide doped with the group 13 element) includes (1) the step of making a mixture in which zinc oxide or a precursor compound that forms zinc oxide by firing, and the group 13 element are mixed in a solid state, (2) the step of mixing the mixture made in the step (1) and the sintering inhibitor, and (3) the step of firing the mixture obtained by the step (2) at a predetermined temperature. The firing temperature is preferably relatively high in order that the group 13 element diffuses in the inorganic fine particles, and firing is preferably performed in a temperature range in which the sintering inhibitor acts effectively. Specifically, by firing at 600° C. or more and 850° C. or less, the first inorganic fine particles (zinc oxide doped with the group 13 element) suitable for the present invention can be obtained The average primary particle diameter of the first inorganic fine particles is not particularly limited, and can be appropriately selected according to the purpose. The average primary particle diameter is preferably 10 nm to 50 nm in terms of excellent light transmittance and abrasion resistance of the surface layer. If the average primary particle diameter is less than 10 nm, the aggregation of the inorganic fine particles is likely to occur, which may be likely to cause such a problem that the control of surface resistivity described in the present invention cannot be stably performed. If the average primary particle diameter is more than 50 nm, the charge transport function in the surface layer is likely to be nonuniform, and it may be difficult to form the desired latent image. In addition, the surface roughness of the surface layer increases, and the abrasion of the blade cleaning member described later proceeds rapidly, and therefore, toner cleaning failure and the like may occur early. In addition, although depending on the specific gravity of the inorganic fine particles, problems associated with coating liquid life, such as the settling properties of the inorganic fine particles in the dispersion being promoted, may be caused.

The average primary particle diameter of the first inorganic fine particles can be measured by obtaining a 3,000× to 10,000× observed image by a scanning electron microscope, and then calculating for 200 randomly selected particles by image analysis software.

—Compound Having Primary or Secondary Amino Group—

The compound having a primary or secondary amino group is not particularly limited, and can be appropriately selected according to the purpose. Examples of the compound having a primary or secondary amino group include N-2-(aminoethyl)-3-aminopropylmethyldimethoxysilane, N-2-(aminoethyl)-3-aminopropyltrimethoxysilane, N-2-(aminoethyl)-3-aminopropyltriethoxysilane, 3-aminopropyltrimethoxysilane, 3-aminopropyltriethoxysilane, 3-triethoxysilyl-N-(1,3-dimethyl-butylidene)propylamine, p-aminophenyltrimethoxysilane, aminoethylaminomethylphenethyltrimethoxysilane, N-phenylaminopropyltrimethoxysilane, N-phenylaminomethyltriethoxysilane, and phenylaminomethylmethyldimethoxysilane. One of these may be used alone, or two or more of these may be used in combination. Among these, compounds having a phenylamino group are preferred.

—Method for Producing First Inorganic Fine Particles—

The method for producing the first inorganic fine particles is not particularly limited, and can be appropriately selected according to the purpose. The following method for modifying the inorganic fine particles using the compound having a primary or secondary amino group is given as an illustration.

A slurry containing the inorganic fine particles and the compound having a primary or secondary amino group (a suspension of solid fine particles) is wet-ground to make the inorganic fine particles finer and simultaneously allows the surface treatment of the inorganic fine particles to proceed. Then, the solvent is removed followed by heat treatment and powderization. Thus, surface-modified inorganic fine particles as uniform and fine first inorganic fine particles modified with a compound having an amino group can be obtained.

The surface treatment apparatus used for the surface treatment is not particularly limited, and can be appropriately selected according to the purpose. Examples of the surface treatment apparatus include wet medium dispersion type apparatuses.

The wet medium dispersion type apparatuses are apparatuses having the step of crushing aggregated particles of inorganic fine particles for grinding, and dispersing the particles by filling the container with beads as a medium, and further rotating the stirring disk attached perpendicularly to the rotation axis at high speed. Their configurations are not particularly limited as long as they are in a form in which when inorganic fine particles are subjected to surface treatment, the metal oxide particles can be sufficiently dispersed, and surface-treated. The configurations can be appropriately selected according to the purpose. Examples of the configurations include various modes, such as a vertical type or a horizontal type, and a continuous type or a batch type.

Specific examples include sand grinder mills, Ultra Visco Mill, pearl mills, grain mills, DYNO-MILL, agitator mills, and dynamic mills. Fine grinding and dispersion are performed by impact collapse, friction, shear, shear stress, and the like by these dispersion type apparatuses using grinding media, such as balls and beads. Examples of the beads used in the sand grinder mills include balls containing glass, alumina, zircon, zirconia, steel, flint, and the like as raw materials. Those made of zirconia and zircon are preferred. In addition, as the beads, those having a diameter of 1 mm to 2 mm are preferred.

The materials for the disks and the container inner walls used in the wet medium dispersion type apparatuses are not particularly limited, and can be appropriately selected according to the purpose. Examples of the materials include materials made of stainless, nylons, ceramics, and the like. Among these, materials made of ceramics, such as zirconia and silicon carbide, are more preferred.

Also for particles of metal oxides, such as alumina, titanium oxide, tin oxide, and silica, the surface-modified inorganic fine particles can be obtained by wet treatment using the compound having an amino group because the particles of metal oxides have hydroxyl groups on the surfaces like zinc oxide.

In addition, another example of the method for producing the surface-modified inorganic fine particles includes a method of reacting the inorganic fine particles with a silane coupling agent having a primary or secondary amino group to modify the inorganic fine particles with the primary or secondary amino group.

The materials used in the method for modifying the first inorganic fine particles may include materials having modifying groups other than an amino group, but preferably include 50% by mass or more of a material having an amino group.

The volume resistivity of the first inorganic fine particles can be measured by using a measuring apparatus according to JIS-K6911. Examples of the measuring apparatus include Model MCP-PD51, Loresta GP, and Hiresta UP (all manufactured by Mitsubishi Chemical Analytech Co., Ltd.).

Measurement can be performed under any pressure in the measuring apparatus. For the volume resistivity of the first inorganic fine particles, the value of powder resistivity at a cylinder porosity of 50% is calculated from a plurality of measurement results by interpolation or extrapolation, and this value is taken as the volume resistivity of the first inorganic fine particles. For the approximation, exponential function approximation is used. The porosity is obtained by the following calculation formula.

A cylinder porosity (%)=(1−weight of measured fine particles÷density of fine particles±volume of fine particles during pressurization)×100

The first inorganic fine particles are not particularly limited as long as they have a volume resistivity of $1\times10^8$ Ω·cm or less. The first inorganic fine particles can be appropriately selected according to the purpose. Those having a volume resistivity of $5\times10^4$ Ω·cm or less are preferred, and those having a volume resistivity of $1\times10^3$ Ω·cm or less are more preferred.

For the detection of the first inorganic fine particles in the surface layer, general analysis techniques, for example, a gas chromatograph mass spectrometer (GCMS), a time-of-flight mass spectrometer (TOF-SIMS), nuclear magnetic resonance (NMR), an infrared spectrophotometer (IR), a Raman spectrophotometer, and the Auger spectroscopy (AES), can be used.

The content of the first inorganic fine particles in the surface layer is not particularly limited, and can be appropriately selected according to the purpose. The content is preferably 10 parts by mass or more and 130 parts by mass or less based on 100 parts by mass of the resin having no charge transport properties. If the content is less than 10 parts by mass, the gas resistance decreases, and an abnormal image may be generated. If the content is more than 130 parts by mass, coating failure may occur due to the aggregation of the particles.

The method for dispersing the first inorganic fine particles into the surface layer is not particularly limited, and can be appropriately selected according to the purpose. Examples of the method include methods using a ball mill, a sand mill, a KD mill, a three-roll mill, a pressure type homogenizer, and the like, and ultrasonic dispersion, which are dispersion methods generally used for the preparation of a surface layer coating liquid.

<<Any of Compounds Represented by Formulas (1) to (7)>>

When the surface layer as described in the present invention is used, the flaw resistance and abrasion resistance are high because the surface layer contains a relatively large amount of inorganic fine particles. On the other hand, a drawback is that the deterioration of image quality (image density unevenness) is likely to occur due to the deposition of ionic substances derived from acidic gases, such as ozone and NOx, produced in the charging process and the like. The mechanism of the image density unevenness due to acidic gases is considered as follows. Ionic substances derived from acidic gases produced by the charging device are deposited on the photoconductor surface and absorb moisture, and thus, the resistance of the outermost surface of the photoconductor decreases, and thus, the charge on the electrostatic latent image is horizontally transferred on the photoconductor surface.

The electrophotographic photoconductors that have generally been used so far have poor mechanical durability, and therefore, abrasion occurs due to mechanical external force applied by the cleaning blade and the like, and ionic substances deposited on the outermost surface can be easily removed. Therefore, the image density unevenness is less likely to become obvious. However, in the electrophotographic photoconductor having the surface layer containing a relatively large amount of inorganic fine particles as described in the present invention, the photoconductor surface is less likely to be abraded, and the removal of ionic substances deposited on the surface is very difficult. Therefore, the image density unevenness is likely to become obvious. Particularly, when the surface layer is formed using a crosslinkable material, the free volume of the surface layer increases because of volume shrinkage due to crosslinking, and the ionic substances are likely to affect to relatively inside the layer. Therefore, problems that have not been seen so far occur, for example, the image density unevenness is likely to become obvious, and, in addition, the recovery is slow. In order to solve such problems caused by the ionic substances deposited on the outermost surface of the electrophotographic photoconductor, it is effective to contain any of compounds represented by the following general formulas (1) to (7). As the embodiment of inclusion, a compound belonging to a general formula may be used alone, a plurality of compounds belonging to a general formula and having different structures may be contained, or a plurality of compounds belonging to different general formulas may be contained.

<General Formula (1)>

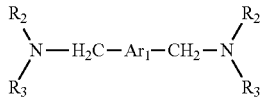

wherein $R_2$ and $R_3$ may be the same or different, and represent a substituted or unsubstituted alkyl group or a substituted or unsubstituted aromatic hydrocarbon group, and either one of $R_2$ and $R_3$ is a substituted or unsubstituted aromatic hydrocarbon group; $R_2$ and $R_3$ may be bonded to each other to form a substituted or unsubstituted heterocyclic group containing a nitrogen atom; and $Ar_1$ represents a substituted or unsubstituted aromatic hydrocarbon group.

Diamine compounds represented by the general formula (1) are described in Japanese Patent Application Publication (JP-B) No. 62-13382, U.S. Pat. No. 4,223,144, U.S. Pat. No. 3,271,383, and U.S. Pat. No. 3,291,788 as dye intermediates or precursors of polymer compounds. The compounds are effective in maintaining image quality in repeatedly using a photoconductor. The reason for this is not clear at present, but since the alkylamino group contained in the chemical structure is a strongly basic group, a neutralization effect for oxidizing gases and ionic substances considered to be substances causing image density unevenness is presumed. In addition, an aromatic hydrocarbon ring group-substituted amino group is known to be a functional group having excellent charge transport ability [Takahashi et al., DENSHI SHASHIN GAKKAISHI (Electrophotography), Vol. 25, No. 3, p. 16, 1986], and the diamine compounds used in the present invention contain this group, and therefore are found to be compounds having high charge transport ability. Further, it is also substituted that by using in combination with other charge transport substances, high sensitivity, repeated stability, and the like increase further.

The diamine compounds represented by the general formula (1) can be easily produced by a method described in a literature (E. Elceand A. S. Hay, Polymer, Vol. 37 No. 9, 1745 (1996)). In other words, they can be obtained by reacting a dihalide represented by the following general formula (1-1) with a secondary amine compound represented by the following general formula (1-2) in the presence of a basic compound at a temperature of room temperature to about 100° C.

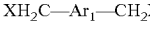

<General Formula (1-1)> wherein $Ar_1$ represents a substituted or unsubstituted aromatic hydrocarbon group; and X represents a halogen atom.

<General Formula (1-2)>

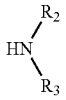

wherein $R_2$ and $R_3$ represent a substituted or unsubstituted alkyl group or an aromatic hydrocarbon group, and may be the same or different, provided that either one of $R_2$ and $R_3$ is a substituted or unsubstituted aromatic hydrocarbon group; and $R_2$ and $R_3$ may be bonded to each other to form a substituted or unsubstituted heterocyclic group containing a nitrogen atom.

Examples of the basic compound include potassium carbonate, sodium carbonate, potassium hydroxide, sodium hydroxide, sodium hydride, sodium methylate, and potassium-t-butoxide. Examples of the reaction solvent include dioxane, tetrahydrofuran, toluene, xylene, dimethyl sulfoxide, N,N-dimethylformamide, N-methylpyrrolidone, 1,3-dimethyl-2-imidazolidinone, and acetonitrile.

Examples of the alkyl group in the description of the general formula (1) and the general formula (1-2) include a methyl group, an ethyl group, a propyl group, a butyl group, a hexyl group, and an undecanyl group. In addition, examples of the aromatic hydrocarbon group include aromatic rings, such as benzene, biphenyl, naphthalene, anthracene, fluorene, and pyrene, and groups of aromatic heterocycles, such as pyridine, quinoline, thiophene, furan, oxazole, oxadiazole, and carbazole. In addition examples of the substituents on these include those mentioned in the specific examples of the alkyl group, alkoxy groups, such as a methoxy group, an ethoxy group, a propoxy group, and a butoxy group, halogen atoms, a fluorine atom, a chlorine atom, a bromine atom, and an iodine atom, the aromatic hydrocarbon group, and groups of heterocycles, such as pyrrolidine, piperidine, and piperazine. Further, when $R_2$ and $R_3$ are bonded to each other to form a heterocyclic group containing a nitrogen atom, examples of the heterocyclic group can include condensed heterocyclic groups in which a pyrrolidino group, a piperidino group, a piperazino group, or the like is condensed with an aromatic hydrocarbon group.

Preferred examples of the compounds represented by the general formula (1) are given below. However, the present invention is not limited to these compounds.

<General Formula (1)>

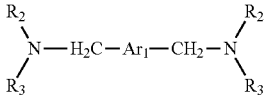

TABLE X1
| Compound No. | $Ar_1$ | $R_2$ | $R_3$ |
|---|---|---|---|
| 1 | 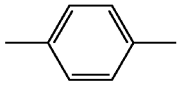 | $—CH_3$ | 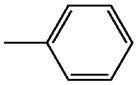 |
| 2 | 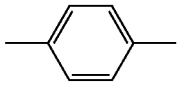 | $—CH_2CH_3$ | 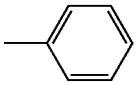 |
| 3 | 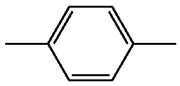 | $—CH_3$ | 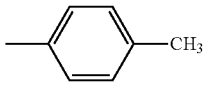 |
| 4 | 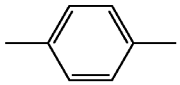 | $—CH_2CH_3$ | 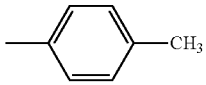 |
| 5 | 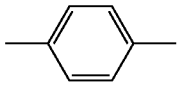 | $—CH_2CH_2CH_3$ | 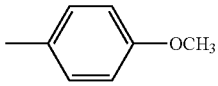 |
| 6 | 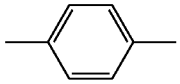 | $—CH_2CH_3$ | 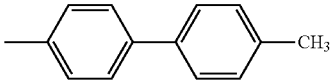 |
| 7 | 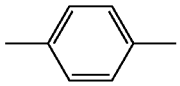 | 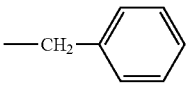 | 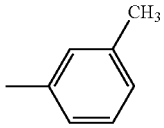 |
| 8 | 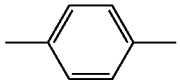 | 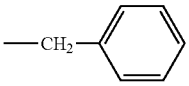 | 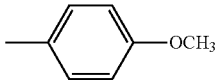 |
| 9 | 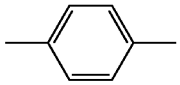 | $—CH_2CH_3$ | 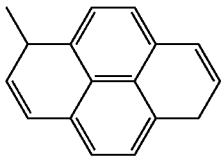 |
| 10 | 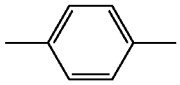 | 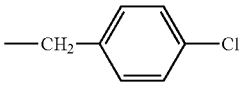 | 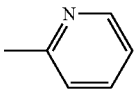 |
| 11 | 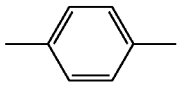 | $—CH_2CH_3$ | 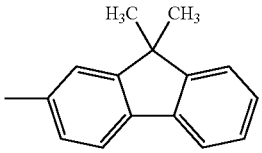 |
| 12 | 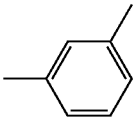 | $—CH_2CH_3$ | 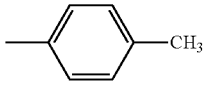 |
| 13 | 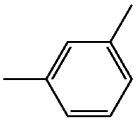 | 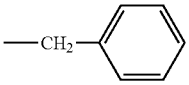 | 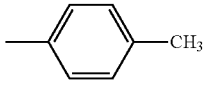 |

TABLE X2
| Compound No. | $Ar_1$ | $R_2$ | $R_3$ |
|---|---|---|---|
| 14 | 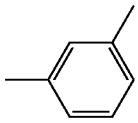 | 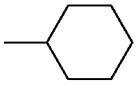 | 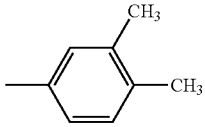 |
| 15 | 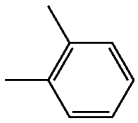 | $—CH_2CH_3$ | 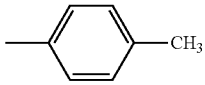 |
| 16 | 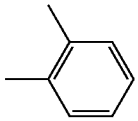 | $—CH_3$ | 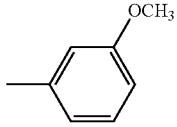 |
| 17 | 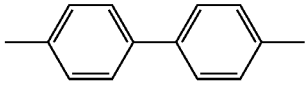 | $—CH_2CH_3$ | 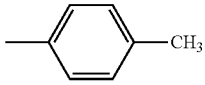 |
| 18 | 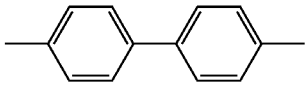 | 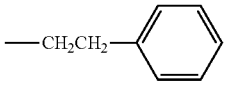 | 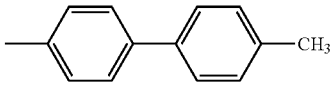 |
| 19 | 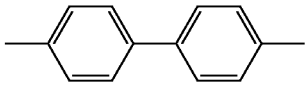 | $—CH_3$ | 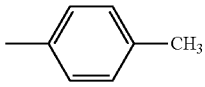 |
| 20 | 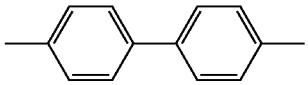 | $—CH_2CH_3$ | 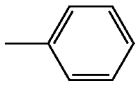 |
| 21 | 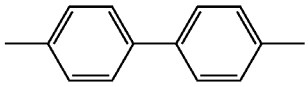 | 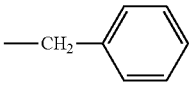 | 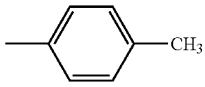 |
| 22 | 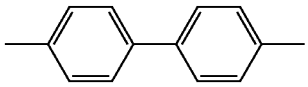 | 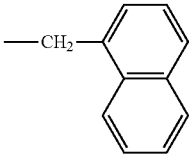 | 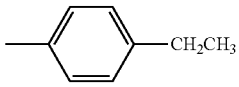 |
| 23 | 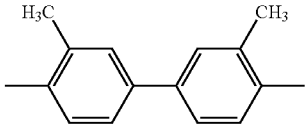 | $—CH_2CH_3$ | 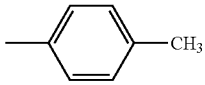 |
| 24 | 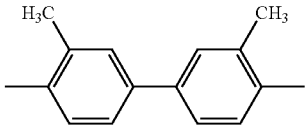 | 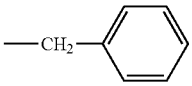 | 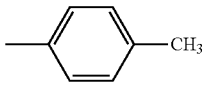 |
| 25 | 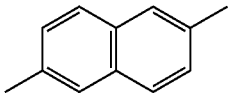 | $—CH_2CH_3$ | 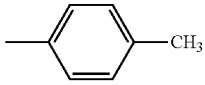 |

TABLE X3
| Compd. No. | $Ar_1$ | $R_2$ | $R_3$ |
|---|---|---|---|
| 26 | 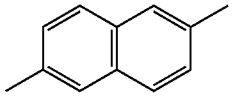 | —$CH_3$ | 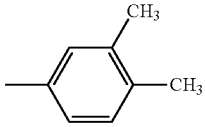 |
| 27 | 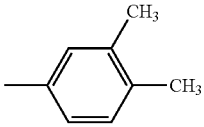 | 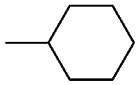 | 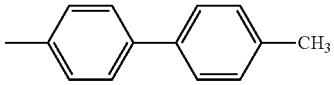 |
| 28 | 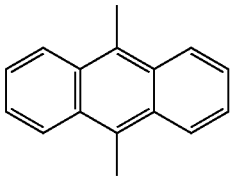 | —$CH_2CH_3$ | 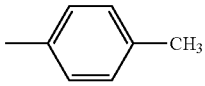 |
| 29 | 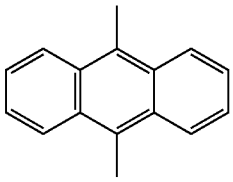 | —$CH_3$ | 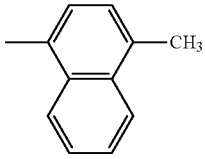 |
| 30 | 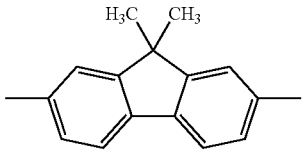 | —$CH_2CH_3$ | 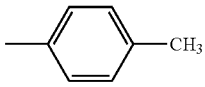 |
| 31 | 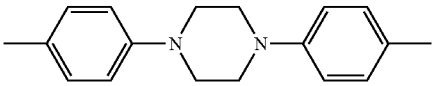 | —$CH_2CH_3$ | 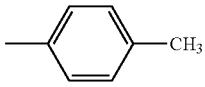 |
| 32 | 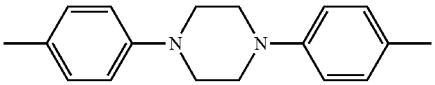 | —$CH_2CH_3$ | 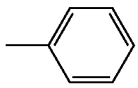 |
| 33 | 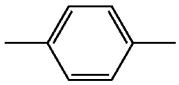 | —$CH_2CH_3$ | 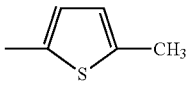 |
| 34 | 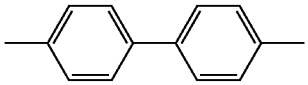 | —$CH_2CH_2CH_3$ <br> \| <br> $CH_3$ | 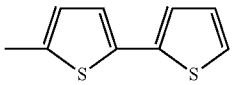 |
| 35 | 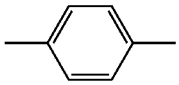 | | 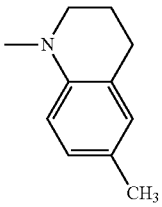 |

TABLE X4

| Compd. No. | $Ar_1$ | $R_2$ | $R_3$ |
|---|---|---|---|
| 36 | 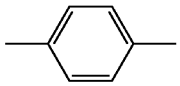 | 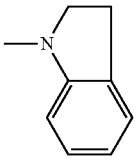 | |
| 37 | 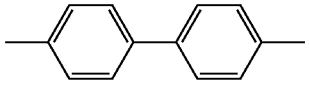 | 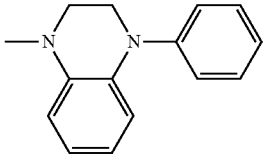 | |

In the present invention, the compounds represented by the general formula (1) may be used alone, or two or more types may be used in combination.

<Arylmethane Compounds Having Alkylamino Group>

The reason why the problems caused by the ionic substances are solved by containing arylmethane compounds having an alkylamino group represented by the following general formulas (2) to (5) is not clarified at present, but it is presumed that the $R_2$ and $R_3$-substituted amino groups (aromatic hydrocarbon group-substituted or unsubstituted alkylamino groups having 1 to 4 carbon atoms) contained in the structures represented by the following general formulas (2) to (5) effectively inhibit radical substance production for oxidizing gases.

The arylmethane compounds having an alkylamino group also have charge transport ability, and therefore do not themselves function as traps for charge carriers, and the deterioration of electrical properties, such as residual potential increase with addition, is hardly seen.

Preferred examples of the arylmethane compounds having an alkylamino group include compounds represented by the following general formulas (2) to (5).

<General Formula (2)>

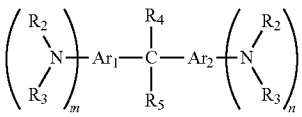

wherein $R_2$ and $R_3$ represent either of a substituted or unsubstituted aromatic hydrocarbon group and a substituted or unsubstituted alkyl group, and may be the same or different, and $R_2$ and $R_3$ may be bonded to each other to form a heterocyclic group containing a nitrogen atom; m and n represent an integer of 0 to 3, and m and n are not simultaneously 0; $R_4$ and $R_5$ represent any of a hydrogen atom, a substituted or unsubstituted alkyl group having 1 to 11 carbon atoms, and a substituted or unsubstituted aromatic hydrocarbon group, and may be the same or different; and $Ar_1$ and $Ar_2$ represent a substituted or unsubstituted aromatic hydrocarbon group, and may be the same or different.

<General Formula (3)>

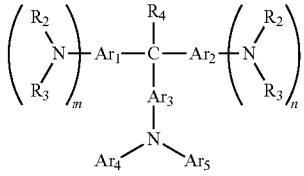

wherein $R_2$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $R_4$ represents a hydrogen atom, a substituted or unsubstituted alkyl group having 1 to 11 carbon atoms, or a substituted or unsubstituted aromatic hydrocarbon group; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

<General Formula (4)>

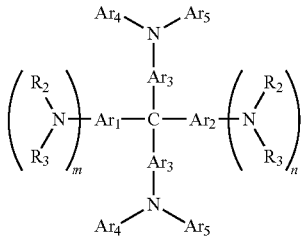

wherein $R_9$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

<General Formula (5)>

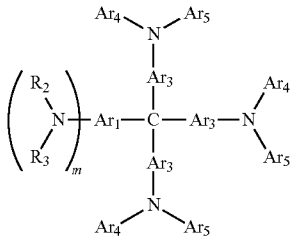

wherein $R_2$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

Specific examples of the alkyl group in the description of the general formulas (2) to (5) can include a methyl group, an ethyl group, a propyl group, and a butyl group. Examples of the aromatic hydrocarbon group include monovalent to hexavalent aromatic hydrocarbon groups of aromatic hydrocarbon rings, such as benzene, naphthalene, anthracene, and pyrene, and monovalent to hexavalent aromatic heterocyclic groups of aromatic heterocycles, such as pyridine, quinoline, thiophene, furan, oxazole, oxadiazole, and carbazole. Examples of the substituents on these include those mentioned in the above specific examples of the alkyl group, alkoxy groups, such as a methoxy group, an ethoxy group, a propoxy group, and a butoxy group, halogen atoms, such as a fluorine atom, a chlorine atom, a bromine atom, and an iodine atom, and aromatic hydrocarbon groups. Specific examples of the heterocyclic group containing a nitrogen atom in which $R_2$ and $R_3$ are bonded to each other include a pyrrolidinyl group, a piperidinyl group, and a pyrrolinyl group. Examples of other heterocyclic groups containing a nitrogen atom together can include aromatic heterocyclic groups, N-methylcarbazole, N-ethylcarbazole, N-phenylcarbazole, indole, and quinoline.

Specific examples of the structures of the compounds represented by the general formulas (2) to (5) are shown in the following Table Y1 to Table Y7. However, the present invention is not limited to these compounds.

TABLE Y1

| Compd. No. | Examples of compound |
|---|---|
| 2-1 | 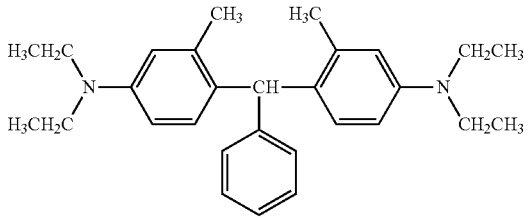 |
| 2-2 | 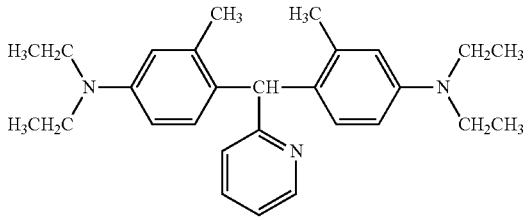 |
| 2-3 | 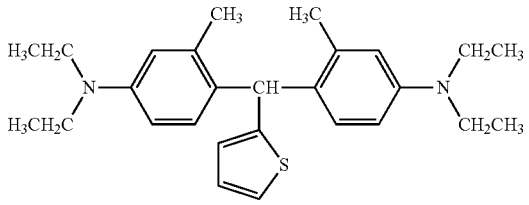 |
| 2-4 | 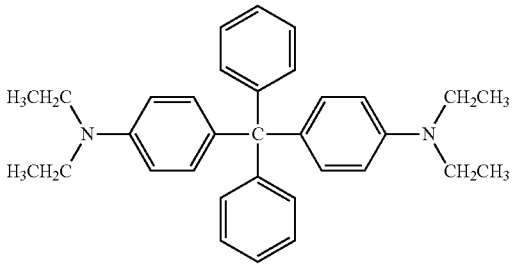 |

TABLE Y1-continued
| Compd. No. | Examples of compound |
|---|---|
| 2-5 | 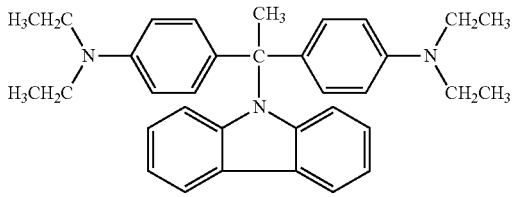 |
| 2-6 | 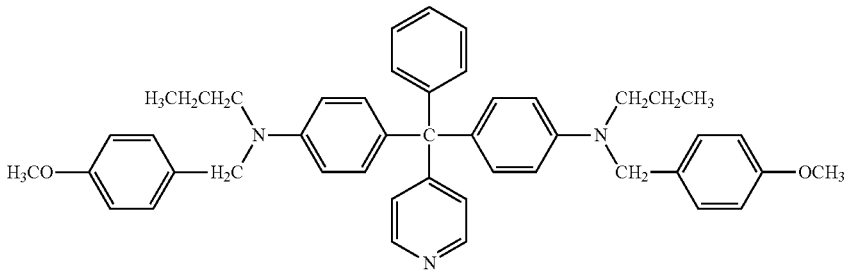 |
TABLE Y2
| Compd. No. | Examples of compound |
|---|---|
| 3-1 | 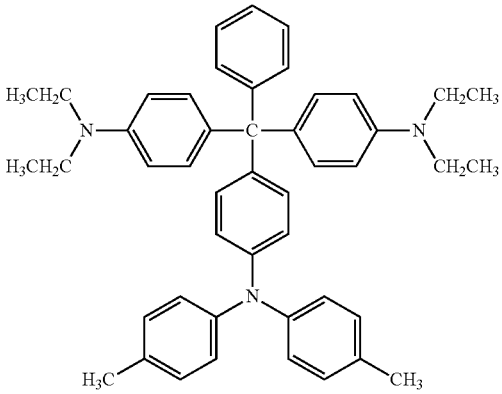 |
| 3-2 | 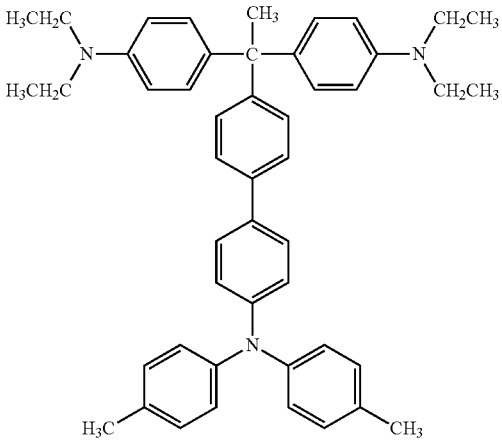 |
TABLE Y2-continued
| Compd. No. | Examples of compound |
|---|---|
| 3-3 | 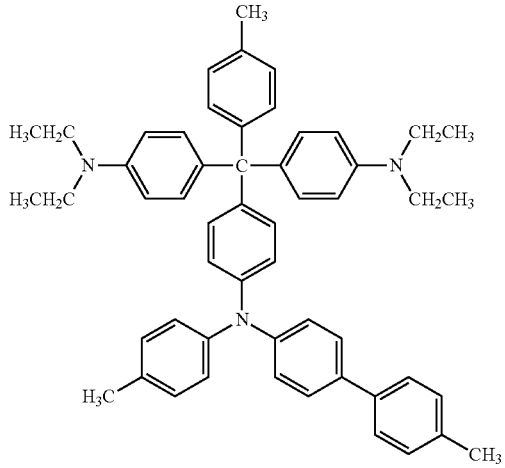 |
| 3-4 | 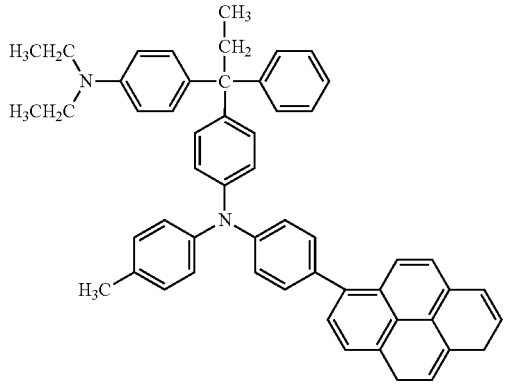 |

TABLE Y3
| Compd. No. | Examples of compound |
|---|---|
| 3-5 | 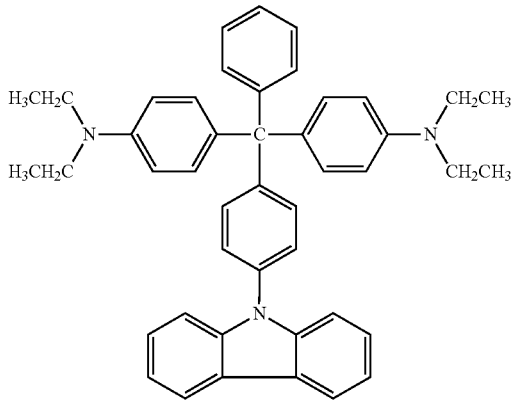 |
| 3-6 | 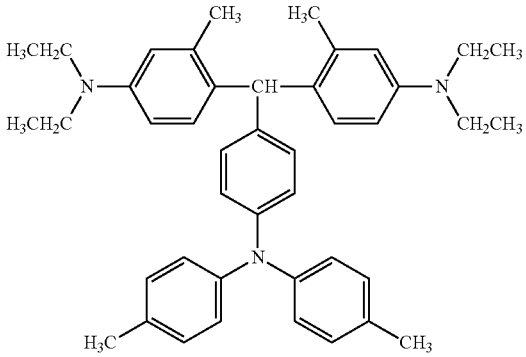 |
| 3-7 | 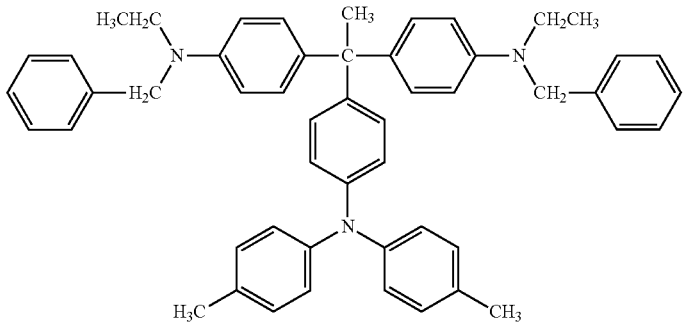 |

TABLE Y4
| Compd. No. | Examples of compound |
|---|---|
| 4-1 | 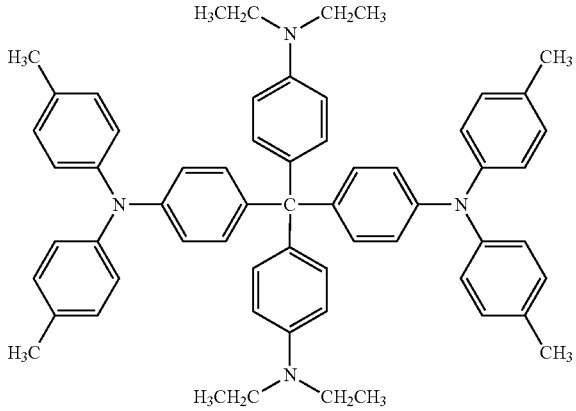 |
| 4-2 | 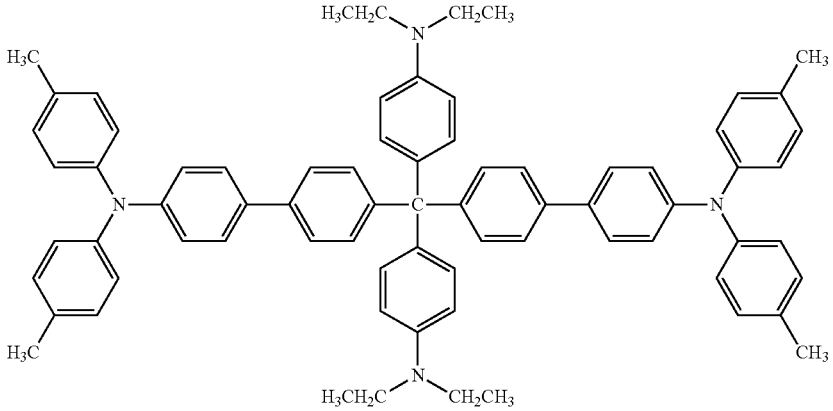 |
| 4-3 | 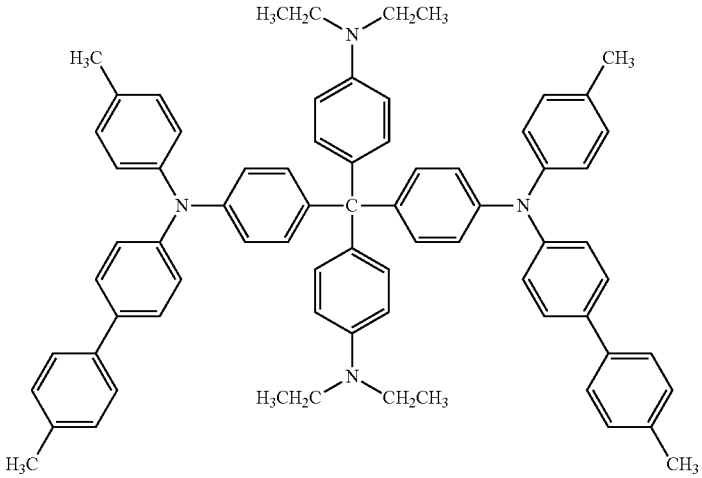 |

TABLE Y5
| Compd. No. | Examples of compound |
|---|---|
| 4-4 | 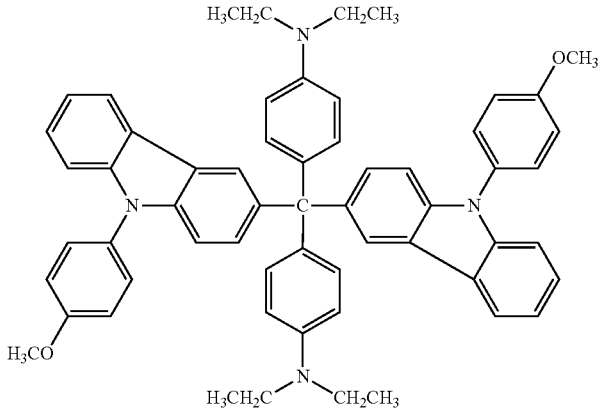 |
| 4-5 | 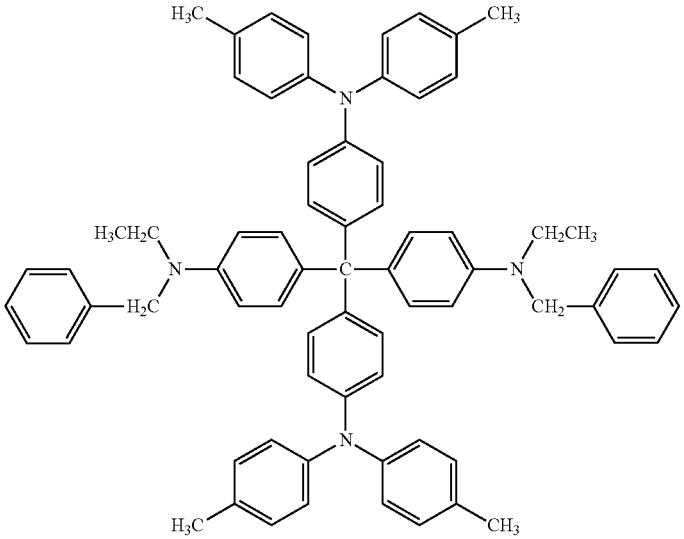 |
TABLE Y6
| Compd. No. | Examples of compound |
|---|---|
| 5-1 | 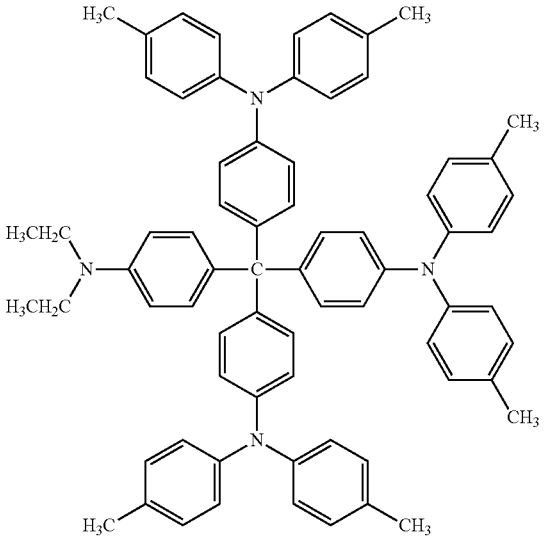 |

TABLE Y6-continued
| Compd. No. | Examples of compound |
|---|---|
| 5-2 | 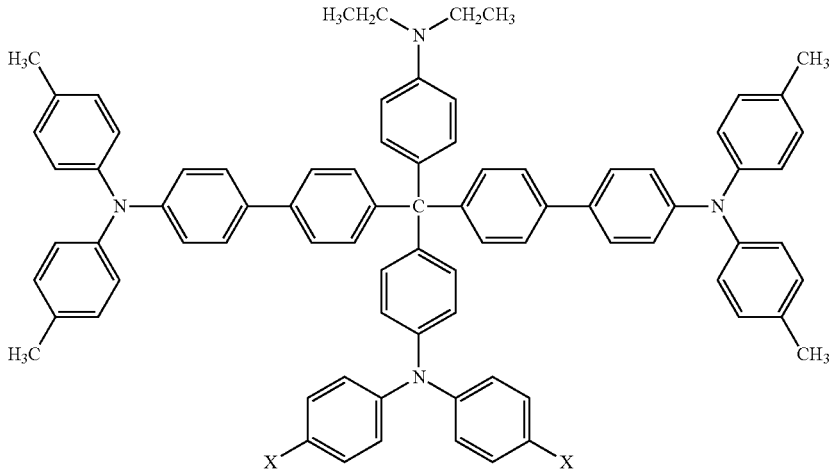 |
| 5-3 | 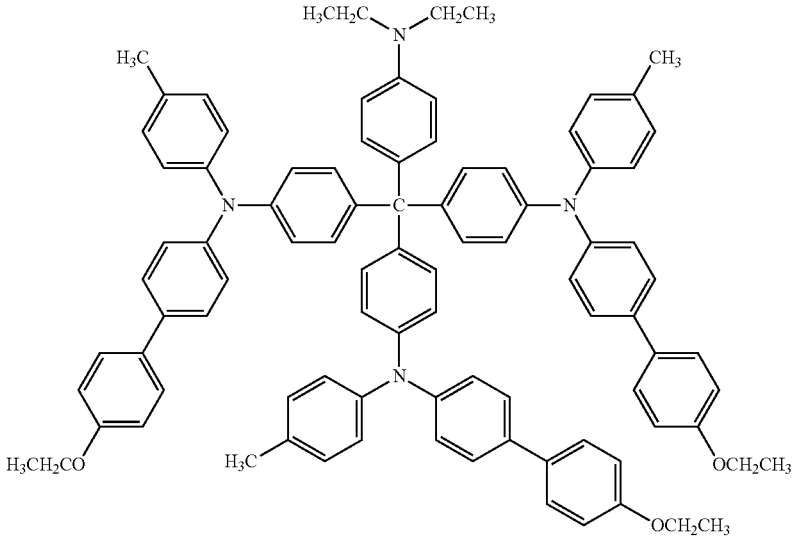 |

TABLE Y7

| Compd. No. | Examples of compound |
|---|---|
| 5-4 | 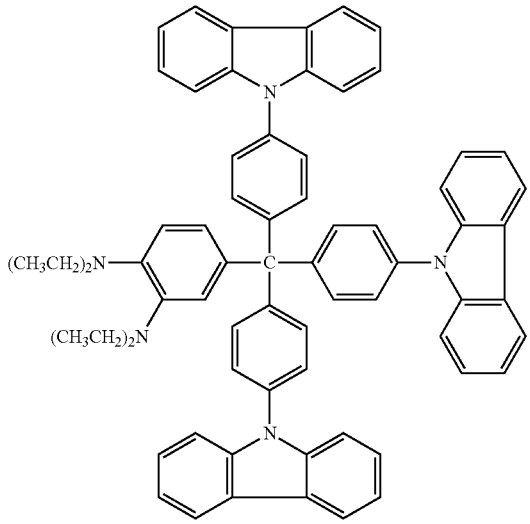 |
| 5-5 | 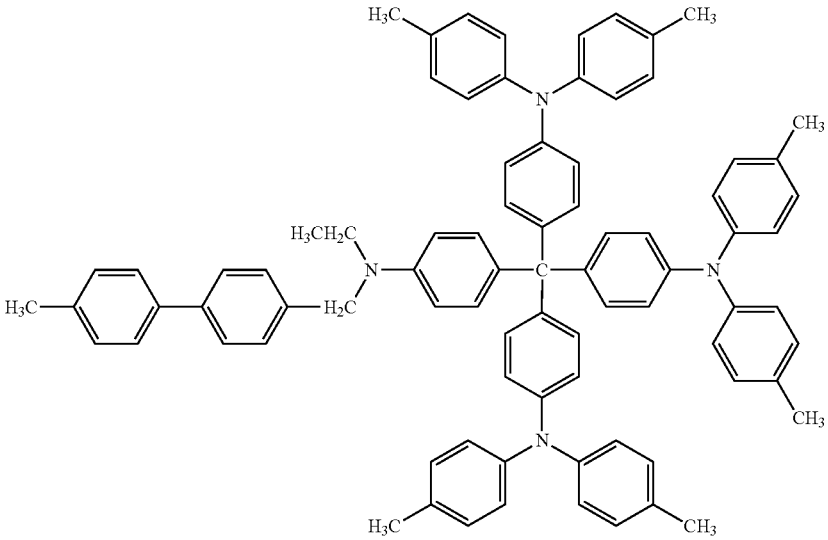 |

In the present invention, the compounds represented by the general formulas (2) to (5) may be used alone, or two or more types may be used in combination.

<<Compounds Represented by General Formulas (6) to (7)>>

The reason why the problems caused by the ionic substances are solved by containing the compounds represented by the following general formulas (6) to (7) is not clarified at present, but it is presumed that the substituted amino groups contained in the structures of the compounds effectively inhibit radical substance production for oxidizing gases. In addition, the compounds represented by the following general formulas (6) to (7) also have charge transport ability, and therefore, the compounds themselves do not function as traps for charge carriers, and the deterioration of electrical properties, such as residual potential increase with addition, is hardly seen.

<General Formula (6)>

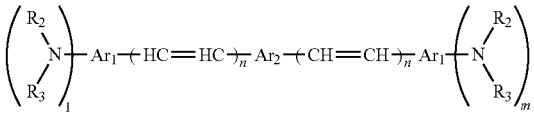

wherein $R_2$ and $R_3$ represent either of a substituted or unsubstituted aromatic hydrocarbon group and a substituted or unsubstituted alkyl group, and may be the same or different, and $R_2$ and $R_3$ may be bonded to each other to form a heterocyclic group containing a nitrogen atom; $Ar_1$ and $Ar_2$ represent a substituted or unsubstituted aromatic hydrocarbon group; 1 and m represent an integer of 0 to 3, and 1 and m are not simultaneously 0; and n represents an integer of 1 to 3.

<General Formula (7)>

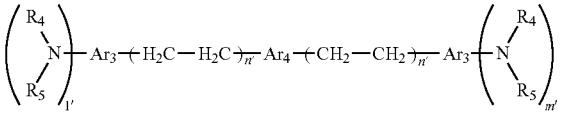

wherein $R_4$ and $R_5$ represent either of a substituted or unsubstituted aromatic hydrocarbon group and a substituted or unsubstituted alkyl group, and may be the same or different, and $R_4$ and $R_5$ may be bonded to each other to form a heterocyclic group containing a nitrogen atom; $Ar_3$ and $Ar_4$ represent a substituted or unsubstituted aromatic hydrocarbon group; l' and m' each represent an integer of 0 to 3, provided that l' and m' are not simultaneously 0; and n' represents an integer of 1 to 3.

In the general formula (6) and the general formula (7), specific examples of the aromatic hydrocarbon groups of $R_2$ to $R_5$ can include aromatic hydrocarbon ring groups, such as benzene, naphthalene, anthracene, and pyrene, and specific examples of the alkyl groups of $R_2$ to $R_5$ can include a methyl group, an ethyl group, a propyl group, a butyl group, a hexyl group, and an undecanyl group, and alkyl groups having 1 to 4 carbon atoms are preferred. Examples of the aromatic hydrocarbon groups of $Ar_1$ to $Ar_4$ include monovalent to tetravalent aromatic hydrocarbon groups of aromatic hydrocarbon rings, such as benzene, naphthalene, anthracene, and pyrene, and monovalent to tetravalent aromatic heterocyclic groups of aromatic heterocycles, such as pyridine, quinoline, thiophene, furan, oxazole, oxadiazole, and carbazole. In addition, examples of the substituents on these include those mentioned in the specific examples of the alkyl groups, alkoxy groups, such as a methoxy group, an ethoxy group, a propoxy group, and a butoxy group, halogen atoms, such as a fluorine atom, a chlorine atom, a bromine atom, and an iodine atom, and aromatic hydrocarbon groups. Specific examples of the heterocyclic groups containing a nitrogen atom in which $R_2$ and $R_3$, or $R_4$ and $R_5$ are bonded to each other include a pyrrolidinyl group, a piperidinyl group, and a pyrrolinyl group. Examples of other heterocyclic groups containing a nitrogen atom together include aromatic heterocyclic groups, such as N-methylcarbazole, N-ethylcarbazole, N-phenylcarbazole, indole, and quinoline.

Preferred examples of the compounds represented by the general formula (6) or the general formula (7) are given below. However, the present invention is not limited to these compounds.

The compounds represented by the general formula (6) and the general formula (7) also include compounds described in Japanese Patent Application Publication (JP-B) No. 58-57739, Japanese Patent (JP-B) No. 2529299, and the like. The compounds represented by the general formula (7) can be produced by the reaction of a corresponding phosphonate compound or triphenylphosphonium salt compound and a corresponding aldehyde compound, the so-called modified Wittig reaction or Wittig reaction. Further, the compounds represented by the general formula (7) can be produced by reducing the compounds represented by the general formula (6).

<General Formula (6)>

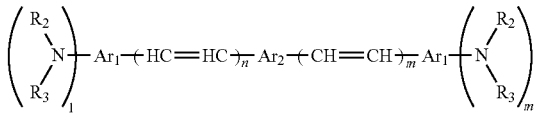

TABLE Z1

| Compd. No. | chemical structure |
|---|---|
| 6-1 | 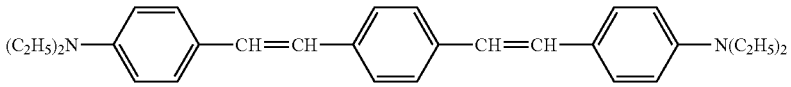 |
| 6-2 | 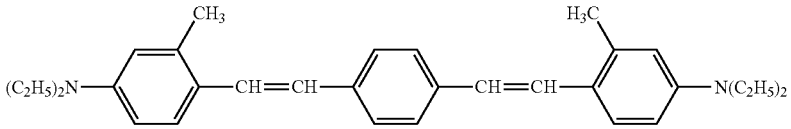 |
| 6-3 | 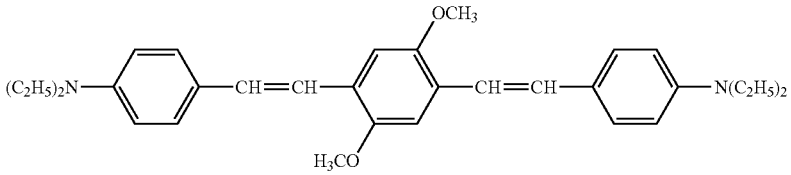 |
| 6-4 | 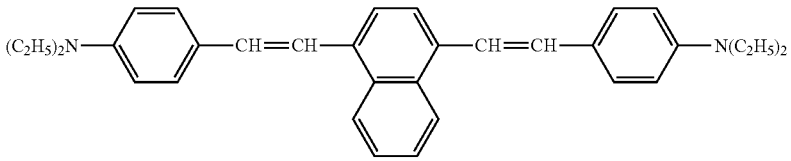 |

TABLE Z1-continued
| Compd. No. | chemical structure |
|---|---|
| 6-5 | 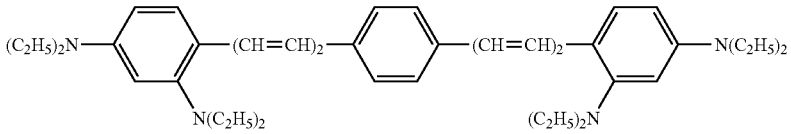 |
| 6-6 | 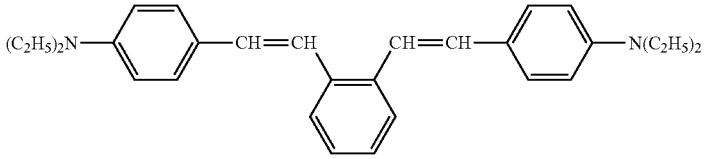 |
| 6-7 | 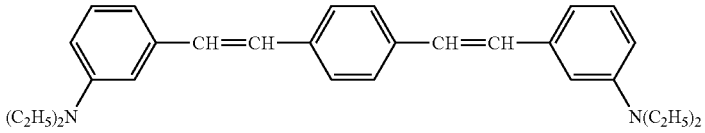 |
TABLE Z2
| Compd. No. | chemical structure |
|---|---|
| 6-8 | 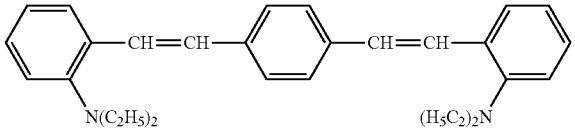 |
| 6-9 | 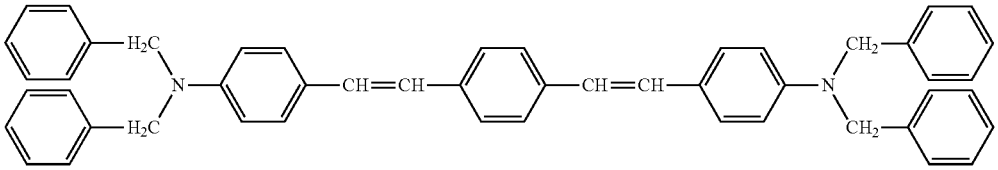 |
| 6-10 | 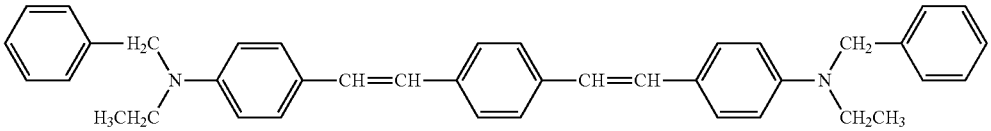 |
| 6-11 | 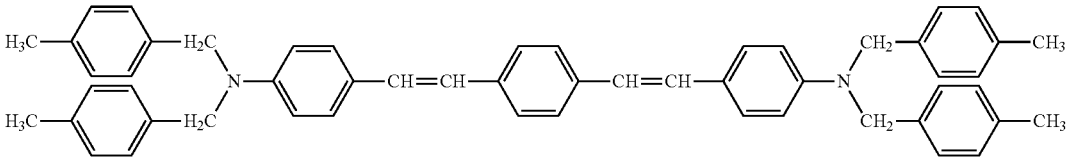 |
| 6-12 | 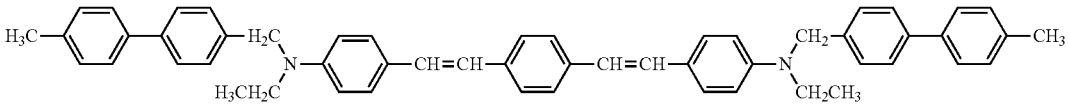 |
| 6-13 | 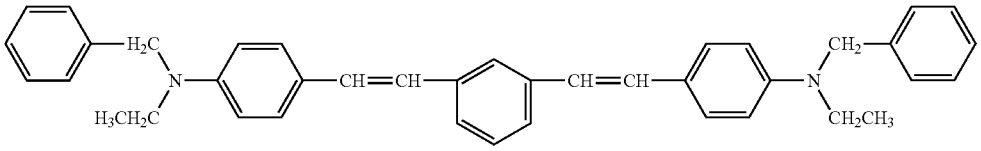 |

TABLE Z2-continued
| Compd. No. | chemical structure |
|---|---|
| 6-14 | 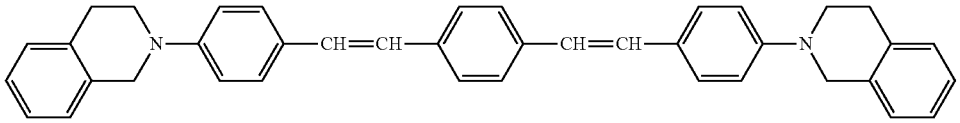 |
| 6-15 | 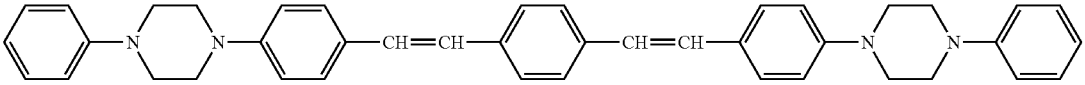 |
<General Formula (7)>
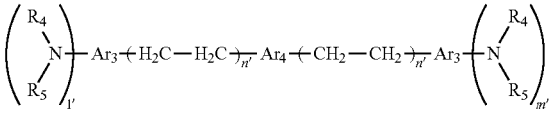
TABLE Z3
| Compd. No. | chemical structure |
|---|---|
| 7-1 | 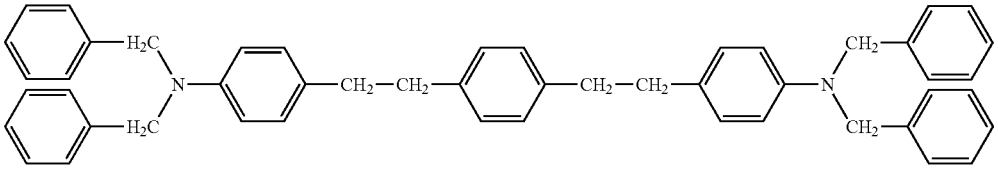 |
| 7-2 | 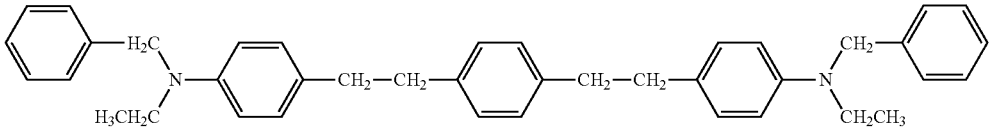 |
| 7-3 | 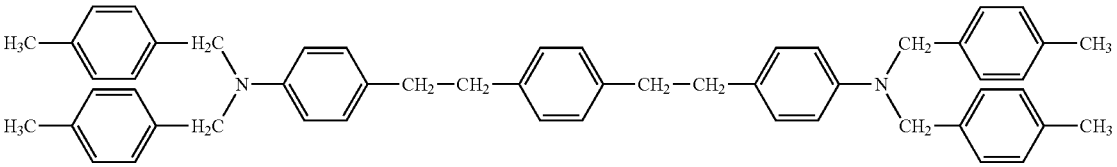 |
| 7-4 | 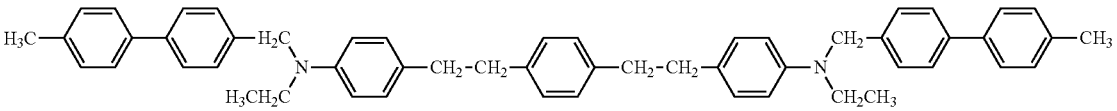 |
| 7-5 | 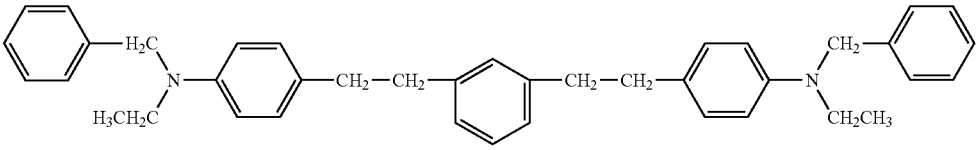 |
| 7-6 | 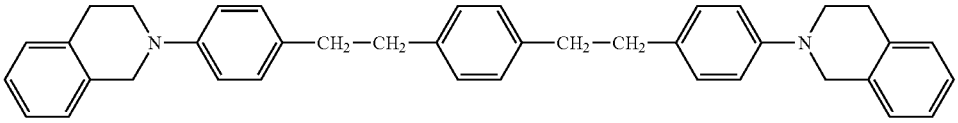 |

TABLE Z3-continued
| Compd. No. | chemical structure |
|---|---|
| 7-7 | 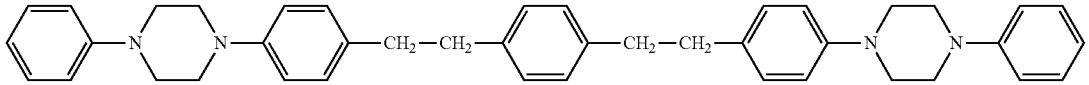 |
| 7-8 | 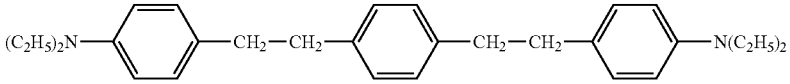 |
TABLE Z4
| Compd. No. | chemical structure |
|---|---|
| 7-9 | 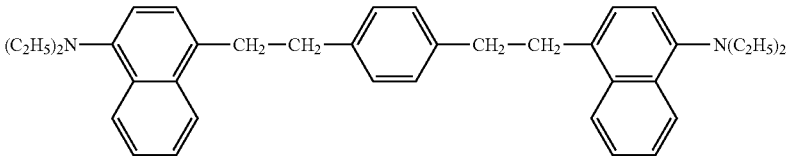 |
| 7-10 | 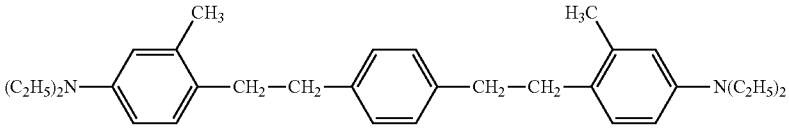 |
| 7-11 | 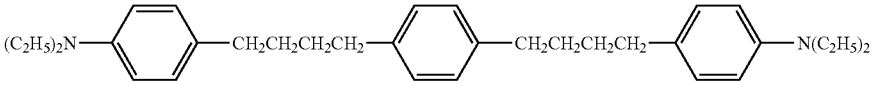 |
| 7-12 | 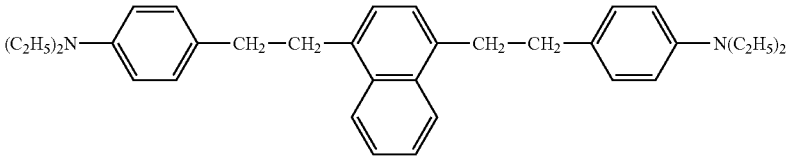 |
| 7-13 | 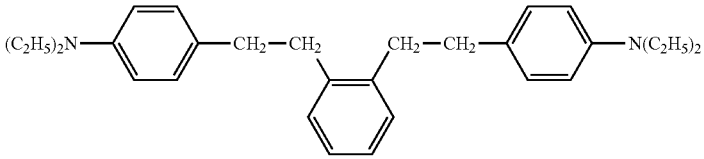 |
| 7-14 | 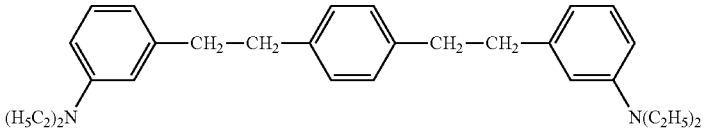 |
| 7-15 | 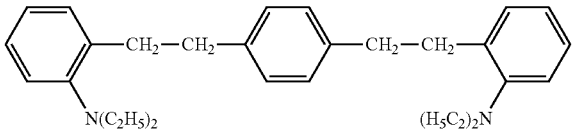 |

In the present invention, the compounds represented by the general formula (6) and the general formula (7) may be used alone, or two or more types may be used in combination.

The compounds represented by the general formulas (1) to (7) may be added to the photoconductive layer or the surface layer, or may be simultaneously added to both the photoconductive layer and the surface layer. Even in a case where the photoconductive layer has such a multilayer structure as including a charge generation layer and a charge transport layer, the compounds represented by the general formulas (1) to (7) may be applied to any layer, or two or more layers.

The content of the any of the compounds represented by the formulas (1) to (7) is not particularly limited as long as it is an amount that satisfies the desired electrical properties and mechanical properties of the photoconductor. The content can be appropriately selected according to the purpose, and is preferably 0.01 parts by mass to 150 parts by mass, more preferably 1 part by mass to 20 parts by mass, based on 100 parts by mass of the total amount of the layer to which the compound is added. If the content is less than 0.01 parts by mass, the desired oxidizing gas durability may be less likely to be obtained. If the content is more than 150 parts by mass, oxidizing gas durability is obtained, and on the other hand, the desired mechanical durability and electrical properties may not be obtained.

<<Second Inorganic Fine Particles>>

The second inorganic fine particles are not particularly limited, and can be appropriately selected according to the purpose. Examples of the second inorganic fine particles include inorganic fine particles, such as fine particles of metals, such as gold, silver, copper, and aluminum; fine particles of metal oxides, such as titanium oxide, tin oxide, zirconium oxide, indium oxide, antimony oxide, calcium oxide, ITO, silicon oxide, colloidal silica, aluminum oxide, yttrium oxide, cobalt oxide, copper oxide, iron oxide, manganese oxide, niobium oxide, vanadium oxide, selenium oxide, alumina, and zinc oxide; and fine particles of metal nitrides, such as boron nitride and silicon nitride. One of these may be used alone, or two or more of these may be used in combination.

The average primary particle diameter of the second inorganic fine particles is not particularly limited, and can be appropriately selected according to the purpose. The average primary particle diameter is preferably 100 nm to 500 nm, more preferably 200 nm to 400 nm, in terms of excellent abrasion resistance of the surface layer. If the average primary particle diameter is less than 100 nm, sufficient machine durability may not be obtained. If the average primary particle diameter is more than 500 nm, settling in the coating liquid is likely to occur, which causes spray clogging, and a stable surface layer may not be obtained. In addition, the surface roughness of the surface layer increases, and the abrasion of the blade cleaning member proceeds rapidly, and therefore, toner cleaning failure and the like may occur early.

The average primary particle diameter of the second inorganic fine particles can be measured, for example, by obtaining a 3,000× to 10,000× observed image by a scanning electron microscope, and then calculating for 20 randomly selected particles by image analysis software.

The content of the second inorganic fine particles in the surface layer is preferably 5 parts by mass or more and 30 parts by mass or less, more preferably 10 parts by mass or more and 20 parts by mass or less, based on 100 parts by mass of the resin. If the content is less than 5 parts by mass, the desired improvement in machine durability may not be obtained. If the content is more than 30 parts by mass, settling in the coating liquid is likely to occur, which causes spray clogging, and a stable surface layer may not be obtained. In addition, the surface roughness of the surface layer increases, and the abrasion of the blade cleaning member proceeds rapidly, and therefore, toner cleaning failure and the like may occur early.

The method for dispersing the inorganic fine particles into the surface layer is not particularly limited, and can be appropriately selected according to the purpose. Examples of the method include methods using a ball mill, a sand mill, a ED mill, a three-roll mill, a pressure type homogenizer, and the like, and ultrasonic dispersion, which are dispersion methods generally used for the preparation of a surface layer coating liquid.

<<Other Components>>

The other components are not particularly limited, and can be appropriately selected according to the purpose. Examples of the other components include a dispersing agent, a surfactant, a charge-transporting compound, a plasticizer, a leveling agent, and an antioxidant.

—Dispersing Agent—

When the first inorganic fine particles are well dispersed into the surface layer, a dispersing agent may be used. The dispersing agent is not particularly limited, and can be appropriately selected according to the purpose.

The content of the dispersing agent is not particularly limited, and can be appropriately selected according to the particle diameter of the inorganic fine particles, and the like. The content is preferably 0.5% by mass to 30% by mass, more preferably 1% by mass to 15% by mass, based on the total amount of the inorganic fine particles. If the content is less than 0.5% by mass, the effect of dispersing the first inorganic fine particles may not be obtained. If the content is more than 30% by mass, problems, such as causing a significant increase in residual potential, may be caused.

—Surfactant—

When the first inorganic fine particles are well dispersed into the surface layer, a surfactant may be used. The surfactant is not particularly limited, and can be appropriately selected according to the purpose.

The content of the surfactant is not particularly limited, and can be appropriately selected according to the particle diameter of the inorganic fine particles, and the like. The content is preferably 0.5% by mass to 30% by mass, more preferably 1% by mass to 15% by mass, based on the total amount of the inorganic fine particles. If the content is less than 0.5% by mass, the effect of dispersing the first inorganic fine particles may not be obtained. If the content is more than 30% by mass, problems, such as causing a significant increase in residual potential, may be caused.

—Charge-Transporting Compound—

The charge-transporting compound is not particularly limited, and can be appropriately selected according to the purpose. Examples of the charge-transporting compound include known hole transport substances having a hole-transporting structure, such as triarylamine, hydrazone, pyrazoline, and carbazole; and known electron transport substances having an electron transport structure, such as electron-withdrawing aromatic rings (condensed polycyclic quinones, diphenoquinone, a cyano group, a nitro group, and the like). One of these may be used alone, or two or more of these may be used in combination.

In addition, when the crosslinked resins are used as the resin having no charge transport properties, charge-transporting compounds having functional groups reactive with the crosslinked resins, for example, a hydroxyl group, an acryloyloxy group, and a methacryloyloxy group, may be used.

The content of the charge-transporting compound is not particularly limited, and can be appropriately selected according to the purpose. The content is preferably 20 parts by mass or less based on 100 parts by mass of the resin having no charge transport properties in that the influence of a decrease in electrophotographic photoconductor properties due to the deterioration of the charge-transporting compound can be decreased.

The method for measuring the content of the charge-transporting compound in the surface layer is not particularly limited, and can be appropriately selected according to the purpose. Examples of the method include methods of measuring the content by elementary analysis, such as the X-ray photoelectron spectroscopy method (XPS), the energy-dispersive X-ray spectroscopy method (EDX), and a wavelength-dispersive X-ray analysis apparatus (WDX), a method of measuring the content based on the amount of staining with a reagent, and a method of measuring the content by the Fourier transform infrared spectroscopy method (FT-IR). Among these, preferably, the content is quantified based on a calibration curve prepared based on the ratio of peak intensities measured by the Fourier transform infrared spectroscopy method (FT-IR), in terms of simple quantification and high versatility.

For example, a known amount of the charge-transporting compound is blended to make the surface layer, the intensities of vibration peaks (peak heights or peak areas) characteristic of the charge-transporting compound are measured by the FT-IR, and the calibration curve is prepared based on the ratio of the obtained vibration peak intensities. In order to increase the precision of the calibration curve, it is possible to make surface layers with the amounts of blending at two levels to five levels and prepare the calibration curve based on vibration peak intensities obtained by measurement by the FT-IR. As the vibration peak intensities, the intensities of vibration peaks (peak heights or peak areas) characteristic of the charge-transporting compound are preferably used, and vibration peak intensities derived from carbonyl, which has poor reactivity and for which the blending ratio in the film is known, are more preferably used.

—Plasticizer—

The plasticizer is not particularly limited, and can be appropriately selected according to the purpose. Examples of the plasticizer include dibutyl phthalate and dioctyl phthalate. One of these may be used alone, or two or more of these may be used in combination. The content of the plasticizer is not particularly limited, and can be appropriately selected according to the purpose. The content is preferably 0 parts by mass to 30 parts by mass based on 100 parts by mass of the resin having no charge transport properties.

—Leveling Agent—

The leveling agent is not particularly limited, and can be appropriately selected according to the purpose. Examples of the leveling agent include silicone oils, such as dimethyl silicone oils and methylphenyl silicone oils; and polymers or oligomers having a perfluoroalkyl group in a side chain. The content of the leveling agent is not particularly limited, and can be appropriately selected according to the purpose. The content is preferably 0 parts by mass to 1 part by mass based on 100 parts by mass of the resin having no charge transport properties.

—Antioxidant—

The antioxidant is not particularly limited. Examples of the antioxidant include phenolic compounds, paraphenylenediamines, hydroquinones, organic sulfur compounds, organic phosphorus compounds, and hindered amines. The content of the antioxidant is not particularly limited, and can be appropriately selected according to the purpose. The content is preferably 0 parts by mass to 5 parts by mass based on 100 parts by mass of the resin having no charge transport properties.

<<Method for Forming Surface Layer>>

The method for forming the surface layer is not particularly limited, and can be appropriately selected according to the purpose. Examples of the method include a method for forming the surface layer by coating the surface of the photoconductive layer in the electrophotographic photoconductor with a coating liquid containing the resin having no charge transport properties, the first inorganic fine particles, any of the compounds represented by the formulas (1) to (7), the second inorganic fine particles, and the other components followed by UV irradiation or heating and drying for curing.

The method for coating with the coating liquid is not particularly limited, and can be appropriately selected according to purposes, such as the viscosity of the coating liquid, and the desired film thickness of the surface layer. Examples of the method include an immersion coating method, a spray coating method, a bead coating method, and a ring coating method.

The coating liquid is a solid or a relatively high viscosity liquid at normal temperature, and therefore, is preferably dissolved in a solvent for making. The solvent is not particularly limited as long as it is a solvent in which the above-described components constituting the surface layer can be dissolved or dispersed. The solvent can be appropriately selected according to the purpose. Examples of the solvent include alcohol-based solvents, such as methanol, ethanol, propanol, and butanol; ketone-based solvents, such as acetone, methyl ethyl ketone, methyl isobutyl ketone, and cyclohexanone; ester-based solvents, such as ethyl acetate and butyl acetate; ether-based solvents, such as tetrahydrofuran, dioxane, and propyl ether; halogen-based solvents, such as dichloromethane, dichloroethane, trichloroethane, and chlorobenzene; aromatic solvents, such as benzene, toluene, and xylene; and cellosolve-based solvents, such as methyl cellosolve, ethyl cellosolve, and cellosolve acetate. One of these may be used alone, or two or more of these may be used in combination.

In order to remove the solvent remaining in the surface layer, heating and drying treatment is preferably performed after the surface layer is formed by the method.

The heating method is not particularly limited, and can be appropriately selected according to the purpose. Examples of the heating method include a method of heating by thermal energy, such as gases, such as air and nitrogen, vapors, various heat media, infrared rays, and electromagnetic waves, from the coated surface side or the electroconductive substrate side.

The temperature in the heating is not particularly limited, and can be appropriately selected according to the purpose. The temperature is preferably 100° C. to 170° C. If the temperature is less than 100° C., the amount of the solvent remaining in the surface layer is likely to increase, which may affect the electrophotographic photoconductor properties. On the other hand, if the temperature is more than 170° C., the low molecular weight components in the photoconductive layer adjacent to the surface layer are likely to move to the surface layer, which may cause a decrease in the control of surface resistivity described in the present invention and other properties.

When a photocurable resin is used as the resin having no charge transport properties, a lamp that can emit energy rays used for curing is used. The lamp is not particularly limited, and can be appropriately selected according to the purpose. Examples of the lamp include low pressure and high pressure mercury lamps, ultrahigh pressure mercury lamps, metal halide lamps, (pulse) xenon lamps, and electrodeless discharge lamps.

The thickness of the surface layer is not particularly limited, and can be appropriately selected according to the purpose. The thickness is preferably 10 μm or less, more preferably 8 μm or less, in terms of excellent resolution and responsivity. The lower limit value is preferably 3 μm or more in terms of charging properties and abrasion durability though different depending on the system (particularly charging potential and the like) used.

<Photoconductive Layer>

The photoconductive layer may be a laminated type photoconductive layer or a single-layer type photoconductive layer.

<<Single-Layer Type Photoconductive Layer>>

The single-layer type photoconductive layer is a layer simultaneously having a charge generation function and a charge transport function.

The single-layer type photoconductive layer contains a charge generation substance, a charge transport substance, and a binding resin, and further contains other components as required.

—Charge Generation Substance—

The charge generation substance is not particularly limited, and can be appropriately selected according to the purpose. Examples of the charge generation substance include substances similar to those used in the laminated type photoconductive layer described later. The content of the charge generation substance is not particularly limited, and can be appropriately selected according to the purpose. The content is preferably 5 parts by mass to 40 parts by mass based on 100 parts by mass of the binding resin.

—Charge Transport Substance—

The charge transport substance is not particularly limited, and can be appropriately selected according to the purpose. Examples of the charge transport substance include substances similar to those used in the laminated type photoconductive layer described later. The content of the charge transport substance is not particularly limited, and can be appropriately selected according to the purpose. The content is preferably 190 parts by mass or less, more preferably 50 parts by mass to 150 parts by mass, based on 100 parts by mass of the binding resin.

—Binding Resin—

The binding resin is not particularly limited, and can be appropriately selected according to the purpose. Examples of the binding resin include binding resins similar to those used in the laminated type photoconductive layer described later.

—Other Components—

The other components are not particularly limited, and can be appropriately selected according to the purpose. Examples of the other components include a low molecular charge transport substance, a solvent, and a leveling agent similar to those used in the laminated type photoconductive layer described later, and the above-described antioxidant.

—Method for Forming Single-Layer Type Photoconductive Layer—

The method for forming the single-layer type photoconductive layer is not particularly limited, and can be appropriately selected according to the purpose. Examples of the method include a method for forming the single-layer type photoconductive layer by applying and drying a coating liquid obtained by dissolving or dispersing a charge generation substance, a charge transport substance, a binding resin, other components, and the like in a suitable solvent (for example, tetrahydrofuran, dioxane, dichloroethane, or cyclohexane) using a dispersion machine.

The method for coating with the coating liquid is not particularly limited, and can be appropriately selected according to the purpose. Examples of the method include an immersion coating method, spray coating, bead coating, and ring coating. In addition, a plasticizer, a leveling agent, an antioxidant, and the like may be added as required.

The thickness of the single-layer type photoconductive layer is not particularly limited, and can be appropriately selected according to the purpose. The thickness is preferably 5 μm to 25 μm.

<<Laminated Type Photoconductive Layer>>

The laminated type photoconductive layer has at least a charge generation layer and a charge transport layer in this order because the independent layers have a charge generation function and a charge transport function, respectively. For the charge generation layer and the charge transport layer, conventionally known ones can be used.

The order of lamination of the charge generation layer and the charge transport layer in the laminated type photoconductive layer is not particularly limited, and can be appropriately selected according to the purpose. Many charge generation materials have poor chemical stability, and cause a decrease in charge generation efficiency, and the like when exposed to acidic gases such as discharge products around the charging device in the electrophotographic imaging process. Therefore, it is preferred that the charge transport layer is laminated on the charge generation layer.

—Charge Generation Layer—

The charge generation layer contains a charge generation substance, preferably contains a binding resin, and further contains other components, such as the above-described antioxidant, as required.

—Charge Generation Substance—

The charge generation substance is not particularly limited, and can be appropriately selected according to the purpose. Examples of the charge generation substance include inorganic materials and organic materials.

—Inorganic Materials—

The inorganic materials are not particularly limited, and can be appropriately selected according to the purpose. Examples of the inorganic materials include crystalline selenium, amorphous selenium, selenium-tellurium, selenium-tellurium-halogens, selenium-arsenic compounds, and amorphous silicon (for example, one in which a dangling bond is terminated with a hydrogen atom, a halogen atom, or the like; and one doped with boron atoms, phosphorus atoms, or the like are preferred).

—Organic Materials—

The organic materials are not particularly limited, and can be appropriately selected according to the purpose. Examples of the organic materials include phthalocyanine-based pigments, such as metal phthalocyanine and metal-free phthalocyanine; azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene-based pigments, anthraquinone- or polycyclic quinone-based pigments, quinoneimine-based pigments, diphenylmethane- and triphenylmethane-based pigments, benzoquinone- and naphthoquinone-based pigments, cyanine- and azomethine-based pigments, indigoid-based pigments, and bisbenzimidazole-based pigments. One of these may be used alone, or two or more of these may be used in combination.

—Binding Resin—

The binding resin is not particularly limited, and can be appropriately selected according to the purpose. Examples of the binding resin include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, and polyacrylamide resins. One of these may be used alone, or two or more of these may be used in combination.

The binding resin may include charge-transporting polymer materials having a charge transport function, in addition to the above-described binding resins. For example, polymer materials, such as polycarbonates, polyester, polyurethanes, polyethers, polysiloxanes, and acrylic resins, having an mylamine skeleton, a benzidine skeleton, a hydrazone skeleton, a carbazole skeleton, a stilbene skeleton, a pyrazoline skeleton, and the like, and polymer materials having a polysilane skeleton can be used.

—Other Components—

The other components are not particularly limited, and can be appropriately selected according to the purpose. Examples of the other components include a low molecular charge transport substance, a solvent, and a leveling agent. The other components may include the above-described antioxidant.

The content of the other components is not particularly limited, and can be appropriately selected according to the purpose. The content is preferably 0.01% by mass to 10% by mass based on the total mass of the layer to which the other components are added.

—Low Molecular Charge Transport Substance—

The low molecular charge transport substance is not particularly limited, and can be appropriately selected according to the purpose. Examples of the low molecular charge transport substance include electron transport substances and hole transport substances.

The electron transport substances are not particularly limited, and can be appropriately selected according to the purpose. Examples of the electron transport substances include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives. One of these may be used alone, or two or more of these may be used in combination.

The hole transport substances are not particularly limited, and can be appropriately selected according to the purpose. Examples of the hole transport substances include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives. One of these may be used alone, or two or more of these may be used in combination.

—Solvent—

The solvent is not particularly limited, and can be appropriately selected according to the purpose. Examples of the solvent include tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, and butyl acetate. One of these may be used alone, or two or more of these may be used in combination.

—Leveling Agent—

The leveling agent is not particularly limited, and can be appropriately selected according to the purpose. Examples of the leveling agent include silicone oils, such as dimethyl silicone oils and methylphenyl silicone oils. One of these may be used alone, or two or more of these may be used in combination.

—Method for Forming Charge Generation Layer—

The method for forming the charge generation layer is not particularly limited, and can be appropriately selected according to the purpose. Examples of the method include a method for forming the charge generation layer by applying, onto the electroconductive substrate, a coating liquid obtained by dissolving or dispersing the charge generation substance and the binding resin in the other components, such as the solvent, and drying the coating liquid. The coating liquid can be applied by a casting method and the like.

The thickness of the charge generation layer is not particularly limited, and can be appropriately selected according to the purpose. The thickness is preferably 0.01 μm to 5 μm, more preferably 0.05 μm to 2 μm.

—Charge Transport Layer—

The charge transport layer is a layer intended to retain a charging charge, and transfer a charge generated and separated in the charge generation layer by exposure to couple the charge to the retained charging charge. In order to achieve the purpose of retaining a charging charge, high electrical resistance is required. In addition, in order to achieve the purpose of obtaining high surface potential with the retained charging charge, a low dielectric constant and good charge transfer properties are required.

The charge transport layer contains a charge transport substance, preferably contains a binding resin, and further contains other components as required.

—Charge Transport Substance—

The charge transport substance is not particularly limited, and can be appropriately selected according to the purpose. Examples of the charge transport substance include electron transport substances, hole transport substances, and polymer charge transport substances.

The content of the charge transport substance in the total amount of the charge transport layer is not particularly limited, and can be appropriately selected according to the purpose. The content is preferably 20% by mass to 80% by mass, more preferably 30% by mass to 70% by mass. If the content is less than 20% by mass, the charge transport properties of the charge transport layer decrease, and thus, the desired light attenuation properties may not be obtained. If the content is more than 80% by mass, abrasion may occur more than necessary due to various hazards to the photoconductor from the image forming step. On the other hand, the content of the charge transport substance in the charge transport layer in the more preferred range is advantageous in that the desired light attenuation properties are obtained, and an electrophotographic photoconductor with a small amount of abrasion even with use can be obtained.

—Electron Transport Substances—

The electron transport substances (electron-accepting substances) are not particularly limited, and can be appropriately selected according to the purpose. Examples of the electron transport substances include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4 one, and 1,3,7-trinitrodibenzothiophene-5,5-dioxide. One of these may be used alone, or two or more of these may be used in combination.

—Hole Transport Substances—

The hole transport substances (electron-donating substances) are not particularly limited, and can be appropriately selected according to the purpose. Examples of the hole transport substances include oxazole derivatives, oxadiazole derivatives, imidazole derivatives, triphenylamine derivatives, 9-(p-diethylaminostyrylanthracene), 1,1-bis-(4-dibenzylaminophenyl)propane, styrylanthracene, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. One of these may be used alone, or two or more of these may be used in combination.

—Polymer Charge Transport Substances—

The polymer charge transport substances are materials having both the function of the binding resin described later and the function of the charge transport substance.

The polymer charge transport substances are not particularly limited, and can be appropriately selected according to the purpose. Examples of the polymer charge transport substances include polymers having a carbazole ring, polymers having a hydrazone structure, polysilylene polymers, polymers having a triarylamine structure (for example, polymers having a triarylamine structure described in Japanese Patent (JP-B) No. 3852812 and Japanese Patent (JP-B) No. 3990499), polymers having an electron-donating group, and other polymers. One of these may be used alone, two or more of these may be used in combination, or these may be used in combination with the binding resin described later in terms of abrasion durability and film forming properties.

The content of the polymer charge transport substance in the total mass of the charge transport layer is not particularly limited, and can be appropriately selected according to the purpose. The content is preferably 40% by mass to 90% by mass, more preferably 50% by mass to 80% by mass, when the polymer charge transport substance and the binding resin are used in combination.

—Binding Resin—

The binding resin is not particularly limited, and can be appropriately selected according to the purpose. For example, polycarbonate resins, polyester resins, methacrylic resins, acrylic resins, polyethylene resins, polyvinyl chloride resins, polyvinyl acetate resins, polystyrene resins, phenolic resins, epoxy resins, polyurethane resins, polyvinylidene chloride resins, alkyd resins, silicone resins, polyvinylcarbazole resins, polyvinyl butyral resins, polyvinyl formal resins, polyacrylate resins, polyacrylamide resins, and phenoxy resins are used. One of these may be used alone, or two or more of these may be used in combination.

The charge transport layer can also contain a copolymer of a crosslinkable binder resin and a crosslinkable charge transport substance.

—Other Components—

The other components are not particularly limited, and can be appropriately selected according to the purpose. Examples of the other components include a solvent, a plasticizer, and a leveling agent. The other components may include the above-described antioxidant.

The content of the other components is not particularly limited, and can be appropriately selected according to the purpose. The content is preferably 0.01% by mass to 10% by mass based on the total mass of the layer to which the other components are added.

—Solvent—

The solvent is not particularly limited, and can be appropriately selected according to the purpose. Those as in the charge generation layer can be used, and solvents that dissolve the charge transport substance and the binding resin well are preferred. One of these may be used alone, or two or more of these may be mixed and used.

—Plasticizer—

The plasticizer is not particularly limited, and can be appropriately selected according to the purpose. Examples of the plasticizer include plasticizers of general resins, such as dibutyl phthalate and dioctyl phthalate.

—Leveling Agent—

The leveling agent is not particularly limited, and can be appropriately selected according to the purpose. Examples of the leveling agent include silicone oils, such as dimethyl silicone oils and methylphenyl silicone oils; and polymers or oligomers having a perfluoroalkyl group in a side chain.

—Method for Forming Charge Transport Layer—

The method for forming the charge transport layer is not particularly limited, and can be appropriately selected according to the purpose. Examples of the method include a method for forming the charge transport layer by applying, onto the charge generation layer, a coating liquid obtained by dissolving or dispersing the charge transport substance and the binding resin in the other components, such as the solvent, and heating or drying the coating liquid.

The method for coating with the coating liquid used in forming the charge transport layer is not particularly limited, and can be appropriately selected according to purposes, such as the viscosity of the coating liquid, and the desired thickness of the charge transport layer. Examples of the method include an immersion coating method, a spray coating method, a bead coating method, and a ring coating method.

In terms of electrophotographic properties and film viscosity, it is necessary to heat the charge transport layer using some means to remove the solvent from the charge transport layer.

Examples of the heating method include a method of heating by thermal energy, such as gases, such as air and nitrogen, vapors, various heat media, infrared rays, and electromagnetic waves, from the coated surface side or the substrate side.

The temperature in the heating is not particularly limited, and can be appropriately selected according to the purpose. The temperature is preferably 100° C. to 170° C. If the temperature is less than 100° C., the organic solvent in the film cannot be sufficiently removed, and a decrease in electrophotographic properties and abrasion durability decrease may occur. On the other hand, if the temperature is more than 170° C., not only do orange peel-like defects and cracks in the surface, debonding at the interface with the adjacent layer, and the like occur, but also the desired electrical properties may not be obtained when the volatile components in the photoconductive layer dissipate to the outside.

The thickness of the charge transport layer is not particularly limited, and can be appropriately selected according to the purpose. The thickness is preferably 50 μm or less, more preferably 45 μm or less, in terms of resolution or responsivity. The lower limit value is preferably 5 μm or more though different depending on the system (particularly charging potential and the like) used.

<Other Layers>

The other layers are not particularly limited, and can be appropriately selected according to the purpose. Examples of the other layers include an undercoat layer and an intermediate layer.

—Undercoat Layer—

The undercoat layer can be provided between the electroconductive substrate and the photoconductive layer.

The undercoat layer contains a resin, and further contains other components, such as the above-described antioxidant, a fine powder pigment, and a coupling agent, as required.

The resin contained in the undercoat layer is not particularly limited, and can be appropriately selected according to the purpose. Examples of the resin include water-soluble resins, such as polyvinyl alcohol, casein, and sodium polyacrylate, alcohol-soluble resins, such as copolymerized nylons and methoxymethylated nylons, and curable resins forming three-dimensional network structures, such as polyurethanes, melamine resins, phenolic resins, alkyd-melamine resins, and epoxy resins.

Among these, resins having high solvent resistance to general organic solvents are preferred in terms of applying the photoconductive layer onto the resin in a solvent.

The fine powder pigment contained in the undercoat layer is not particularly limited as long as it is a pigment that can promote a moire prevention, a reduction in residual potential, and the like. The fine powder pigment can be appropriately selected according to the purpose. Examples of the fine powder pigment include metal oxides, such as titanium oxide, silica, alumina, zirconium oxide, tin oxide, and indium oxide.

The coupling agent contained in the undercoat layer is not particularly limited, and can be appropriately selected according to the purpose. Examples of the coupling agent include silane coupling agents, titanium coupling agents, and chromium coupling agents.

The undercoat layer is not particularly limited, and can be appropriately selected according to the purpose. The undercoat layer may be a single layer or two or more laminated layers.

The method for forming the undercoat layer is not particularly limited, and the undercoat layer can be formed using a suitable solvent and a coating method as in the above-described photoconductive layer. Examples of the method include a method of forming $Al_2O_3$ by anodic oxidation, and a method of forming an organic substance, such as polyparaxylylene (parylene); or an inorganic substance, such as $SiO_2$, $SnO_2$, $TiO_2$, ITO, or $CeO_2$ by a vacuum thin film making method.

The thickness of the undercoat layer is not particularly limited, and can be appropriately selected according to the purpose. The thickness is preferably 1 μm to 5 μm.

—Intermediate Layer—

The intermediate layer can be provided between the charge transport layer and the surface layer for the purpose of inhibiting the mixing of the charge transport layer components into the surface layer or improving the adhesiveness between both layers.

The intermediate layer contains a binding resin, and further contains other components, such as the above-described antioxidant, as required. As the intermediate layer coating liquid, those insoluble or poorly soluble in the surface layer coating liquid are preferred.

The binding resin contained in the intermediate layer is not particularly limited, and can be appropriately selected according to the purpose. Examples of the binding resin include polyamides, alcohol-soluble nylons, polyvinyl butyral, and polyvinyl alcohol.

The method for forming the intermediate layer is not particularly limited, and can be appropriately selected according to the purpose. Examples of the method include a method for forming the intermediate layer using a suitable solvent and a coating method similar to those of the photoconductive layer.

The thickness of the intermediate layer is not particularly limited, and can be appropriately selected according to the purpose. The thickness is preferably 0.05 μm to 2 μm.

<Electroconductive Support>

The electroconductive substrate is not particularly limited as long as it exhibits conductivity with a volume resistance value of $1\times10^{10}$ Ω·cm or less. The electroconductive substrate can be appropriately selected according to the purpose. Endless belts (an endless nickel belt, an endless stainless belt, and the like) disclosed in Japanese Patent Application Laid-Open (JP-A) No. 52-36016 may be used.

The method for forming the electroconductive substrate is not particularly limited, and can be appropriately selected according to the purpose. Examples of the method include a method for forming the electroconductive substrate by vapor-depositing or sputtering a metal (aluminum, nickel, chromium, nichrome, copper, gold, silver, platinum, or the like) or a metal oxide (tin oxide, indium oxide, or the like) to cover a support (a plastic, paper, or the like having a film shape, a cylindrical shape, or the like); and a method for forming the electroconductive substrate by subjecting a metal (aluminum, an aluminum alloy, nickel, stainless, or the like) to extrusion, drawing, or the like to form a plate, and subjecting the plate to surface treatment (cutting, superfinishing, polishing, or the like after raw tube formation).

An electroconductive layer may be provided on the electroconductive substrate.

The method for forming the electroconductive layer is not particularly limited, and can be appropriately selected according to the purpose. Examples of the method include a method for forming the electroconductive layer by applying, onto the electroconductive substrate, a coating liquid obtained by dispersing or dissolving an electroconductive powder and a binding resin in a solvent as required, and a method for forming the electroconductive layer using a heat-shrinkable tube in which the electroconductive powder is contained in a material, such as polyvinyl chloride, polypropylene, polyester, polystyrene, polyvinylidene chloride, polyethylene, chlorinated rubber, or Teflon (registered trademark).

The electroconductive powder is not particularly limited, and can be appropriately selected according to the purpose. Examples of the electroconductive powder include carbon fine particles, such as carbon black and acetylene black; powders of metals, such as aluminum, nickel, iron, nichrome, copper, zinc, and silver; and powders of metal oxides, such as electroconductive tin oxide and ITO.

The binding resin used in the electroconductive layer is not particularly limited, and can be appropriately selected according to the purpose. Examples of the binding resin include thermoplastic resins, thermosetting resins, and photocurable resins. Specific examples include polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenolic resins, and alkyd resins.

The solvent used in the electroconductive layer is not particularly limited, and can be appropriately selected according to the purpose. Examples of the solvent include tetrahydrofuran, dichloromethane, methyl ethyl ketone, and toluene.

Embodiments of Electrophotographic Photoconductor

Embodiments of the electrophotographic photoconductor of the present invention will be described below.

First Embodiment

The layer configuration of an electrophotographic photoconductor according to a first embodiment will be described using FIG. 1.

FIG. 1 shows a configuration in which an electrophotographic photoconductor has a single-layer type photoconductive layer, and is a view showing the layer configuration of an electrophotographic photoconductor in which a single-layer type photoconductive layer 26 and a surface layer 25 are sequentially laminated on an electroconductive substrate 21.

Second Embodiment

The layer configuration of an electrophotographic photoconductor according to a second embodiment will be described using FIG. 2.

Figure 2:
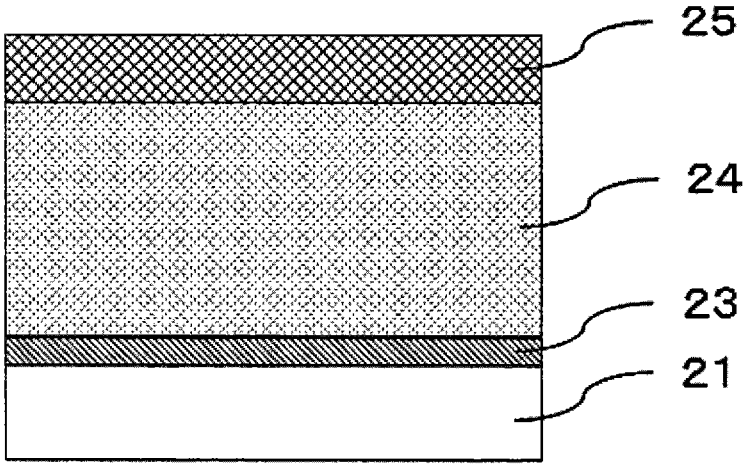
FIG. 2 is a schematic view showing one example of the layer configuration of the electrophotographic photoconductor of the present invention.

FIG. 2 shows a configuration in which an electrophotographic photoconductor has a laminated type photoconductive layer, and is a view showing the layer configuration of an electrophotographic photoconductor in which a charge generation layer 23, a charge transport layer 24, and a surface layer 25 are sequentially laminated on an electroconductive substrate 21. The charge generation layer 23 and the charge transport layer 24 correspond to a photoconductive layer.

Third Embodiment

The layer configuration of an electrophotographic photoconductor according to a third embodiment will be described using FIG. 3.

Figure 3:
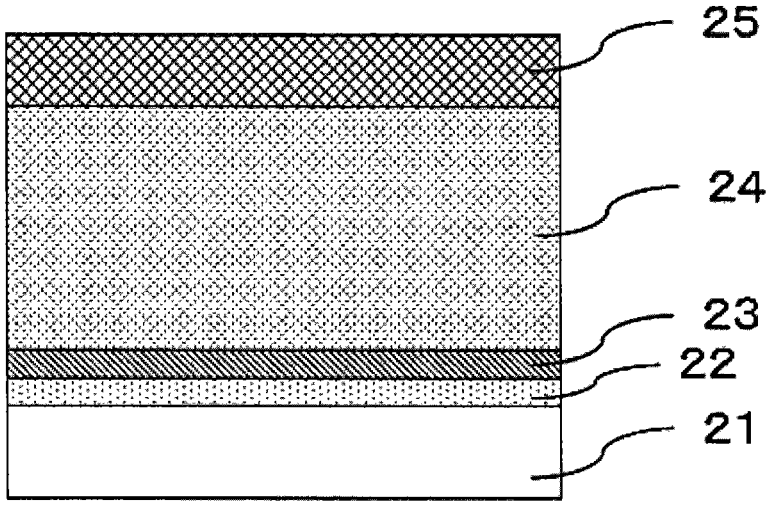
FIG. 3 is a schematic view showing one example of the layer configuration of the electrophotographic photoconductor of the present invention.

FIG. 3 has a configuration in which an intermediate layer is further provided in the electrophotographic photoconductor having the configuration of FIG. 2.

FIG. 3 is a view showing the layer configuration of an electrophotographic photoconductor in which an undercoat layer 22, a charge generation layer 23, a charge transport layer 24, and a surface layer 25 are sequentially laminated on an electroconductive substrate 21. The charge generation layer 23 and the charge transport layer 24 correspond to a photoconductive layer.

Fourth Embodiment

The layer configuration of an electrophotographic photoconductor according to a fourth embodiment will be described using FIG. 4.

Figure 4:
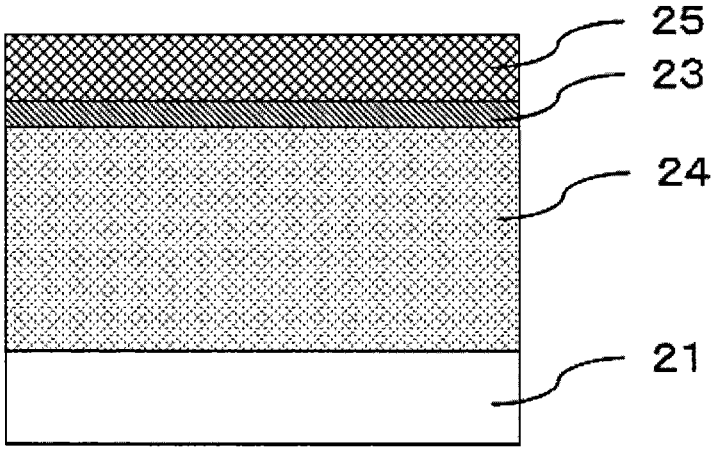
FIG. 4 is a schematic view showing one example of the layer configuration of the electrophotographic photoconductor of the present invention.

FIG. 4 shows a configuration in which an electrophotographic photoconductor has a laminated type photoconductive layer, and is a view showing the layer configuration of an electrophotographic photoconductor in which a charge transport layer 24, a charge generation layer 23, and a surface layer 25 are sequentially laminated on an electroconductive substrate 21. The charge generation layer 23 and the charge transport layer 24 correspond to a photoconductive layer.

(Image Forming Apparatus)

The image forming apparatus includes at least an electrophotographic photoconductor; a charging unit configured to charge the surface of the electrophotographic photoconductor; an exposure unit configured to expose the charged electrophotographic photoconductor surface to light to form an electrostatic latent image; a developing unit configured to develop the electrostatic latent image with a toner to form a visible image; and a transfer unit configured to transfer the visible image to a recording medium, and further includes other units as required. The electrophotographic photoconductor used in the image forming apparatus is the electrophotographic photoconductor of the present invention described above. The charging unit and the exposure unit together may also be referred to as an electrostatic latent image forming unit.

<Charging Unit>

The charging unit is not particularly limited, and can be appropriately selected according to the purpose. Examples of the charging unit include contact charging devices, themselves known, equipped with an electroconductive or semi-electroconductive roll, a brush, a film, a rubber blade, and the like, and noncontact charging devices utilizing corona discharge, such as corotrons and scorotrons, (including proximity type noncontact charging devices having a gap of 100 μm or less between the electrophotographic photoconductor surface and the charging device).

<Exposure Unit>

The exposure unit is not particularly limited as long as it can imagewise expose a surface of the electrophotographic photoconductor charged by the charging unit. The exposure unit can be appropriately selected according to the purpose. For example, various exposure devices, such as copying optical systems, rod lens array systems, laser optical systems, liquid crystal shutter optical systems, and LED optical systems. Examples of the light sources in the exposure devices include light sources that can ensure high brightness, such as light-emitting diodes (LED), semiconductor lasers (LD), and electroluminescence (EL). In the present invention, a backlight system in which exposure is performed imagewise from the back surface side of the electrophotographic photoconductor may be adopted.

<Developing Unit>

The developing unit is not particularly limited as long as it can perform developing using the toner or a developer. The developing unit can be appropriately selected according to the purpose. Those containing the developer and having at least a developing device that can apply the developer to the electrostatic latent image in a contact or noncontact manner are preferred. The developing device may be a dry developing system or a wet developing system, and may be a single-color developing device or a multicolor developing device. For example, those having a stirring device that frictionally stirs the developer for charging, and a rotatable magnet roller, and the like are preferred. In the developing device, for example, the toner and the carrier are mixed and stirred, the toner is charged by friction at this time, and held on the surface of the rotating magnet roller in an earing state, and a magnetic brush is formed. The magnet roller is disposed in the vicinity of the electrophotographic photoconductor, and therefore, a part of the toner constituting the magnetic brush formed on the surface of the magnet roller moves to the surface of the electrophotographic photoconductor by electrical attraction. As a result, the electrostatic latent image is developed with the toner, and a visible image with the toner is formed on the surface of the electrophotographic photoconductor.

<Transfer Unit>

The transfer unit is a unit configured to transfer the visible image to a recording medium, and includes a method of directly transferring the visible image from the electrophotographic photoconductor surface to the recording medium, and a method of using an intermediate transfer body, and primarily transferring the visible image onto the intermediate transfer body, and then secondarily transferring the visible image onto the recording medium. Both aspects can be used well. In such a case that the adverse effect of transfer is large in achieving higher image quality, the former (direct transfer) method with a smaller number of transfers is preferred. The transfer can be performed, for example, by charging the electrophotographic photoconductor using a transfer charging device for the visible image, and can be performed by the transfer unit.

<Other Units>

The other units are not particularly limited, and can be appropriately selected according to the purpose. Examples of the other units include a fixing unit, a static eliminator, a cleaning unit, a recycling unit, and a control unit.

—Fixing Unit—

The fixing unit is not particularly limited, and can be appropriately selected according to the purpose. Known heating and pressurization units are preferred. Examples of the heating and pressurization units include combinations of heating rollers and pressure rollers, and combinations of heating rollers, pressure rollers, and endless belts. As the heating in the heating and pressurization units, 80° C. to 200° C. is usually preferred. For example, the fixing may be performed for toners of colors for each transfer to the recording medium, or may be simultaneously performed for toners of colors at a time in a state in which the toners are laminated.

—Static Eliminator—

The static eliminator is not particularly limited, and is acceptable as long as it can apply a static elimination bias to the electrophotographic photoconductor. The static eliminator can be appropriately selected from among known static elimination devices. Preferred examples of the static eliminator include static elimination lamps.

—Cleaning Unit—

The cleaning unit is not particularly limited, and is acceptable as long as it can remove the electrophotographic toner remaining on the electrophotographic photoconductor. The cleaning unit can be appropriately selected from among known cleaners. Preferred examples of the cleaning unit include magnetic brush cleaners, electrostatic brush cleaners, magnetic roller cleaners, blade cleaners, brush cleaners, and web cleaners.

—Recycling Unit—

The recycling unit is not particularly limited. Examples of the recycling unit include known conveyance units.

—Control Unit—

The control unit is not particularly limited as long as it can control the movement of the units. The control unit can be appropriately selected according to the purpose. Examples of the control unit include equipment, such as sequencers and computers.

[Embodiment of Image Forming Apparatus]

An embodiment of the image forming apparatus of the present invention will be described below.

Figure 5:
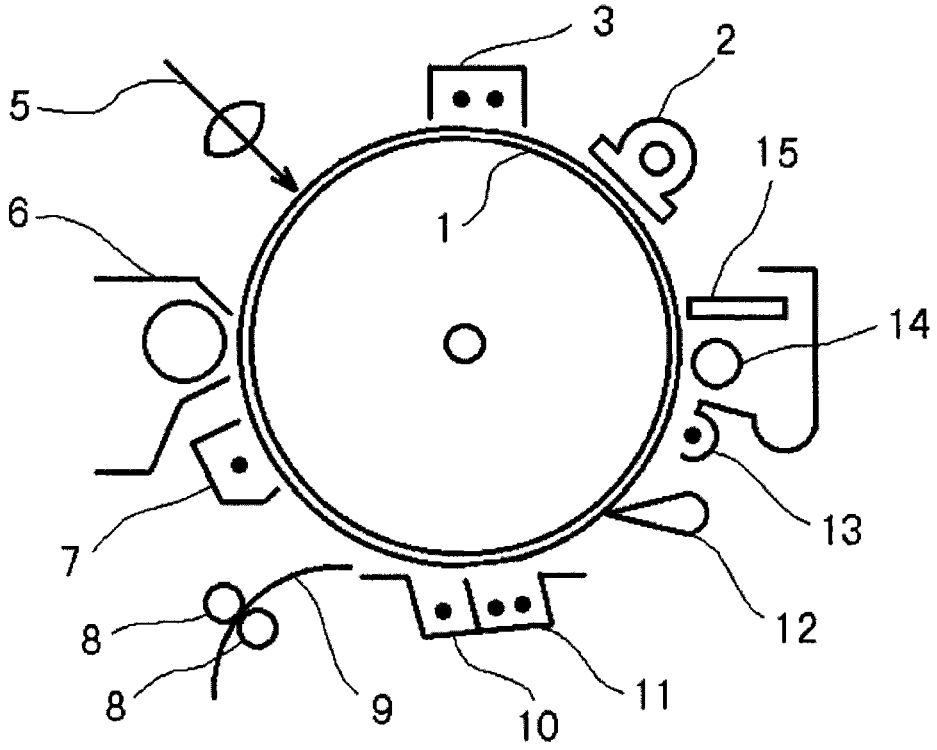
FIG. 5 is a schematic view showing one example of the image forming apparatus of the present invention.

FIG. 5 is a schematic view for explaining the image forming apparatus of the present invention, and a charging unit 3, an exposure unit 5, a developing unit 6, a transfer unit 10, and the like are disposed around an electrophotographic photoconductor 1.

First, the electrophotographic photoconductor 1 is averagely charged by the charging unit 3 shown in FIG. 5. As the charging unit 3, corotron devices, scorotron devices, solid discharge elements, needle electrode devices, roller charging devices, electroconductive brush devices, and the like are used, and known systems can be used.

Next, an electrostatic latent image is formed on the uniformly charged electrophotographic photoconductor 1 by the exposure unit 5 shown in FIG. 5. For this light source, all light-emitting objects, such as fluorescent lamps, tungsten lamps, halogen lamps, mercury lamps, sodium lamps, light-emitting diodes (LED), semiconductor lasers (LD), and electroluminescence (EL), can be used. In order to emit only light in the desired wavelength region, various filters, such as sharp cut filters, band pass filters, near-infrared cut filters, dichroic filters, interference filters, and color temperature conversion filters, can also be used.

Next, the electrostatic latent image formed on the electrophotographic photoconductor 1 is visualized by the developing unit 6 shown in FIG. 5. Examples of this developing system include a one-component developing method and a two-component developing method using a dry toner, and a wet developing method using a wet toner. When the electrophotographic photoconductor 1 is positively (negatively) charged, and image exposure is performed, a positive (negative) electrostatic latent image is formed on the photoconductor surface. When the positive (negative) electrostatic latent image is developed with a toner having negative (positive) polarity (electroscopic fine particles), a positive image is obtained. When the positive (negative) electrostatic latent image is developed with a toner having positive (negative) polarity, a negative image is obtained.

Next, the toner image visualized on the electrophotographic photoconductor 1 is transferred onto a recording medium 9 by the transfer unit 10 shown in FIG. 5. In addition, in order to perform transfer well, a pre-transfer charger 7 may be used. As the transfer unit 10, electrostatic transfer systems using transfer chargers, bias rollers, and the like; mechanical transfer systems, such as an adhesive transfer method and a pressure transfer method; magnetic transfer systems; and the like can be utilized.

As units configured to separate the recording medium 9 shown in FIG. 5 from the electrophotographic photoconductor 1, a separation charger 11 and a separation claw 12 may be further used as required. As other separation units, electrostatic adsorption-induced separation, side end belt separation, tip grip conveyance, curvature separation, and the like are used. As the separation charger 11, the charging units can be utilized. In addition, in order to clean the toner left on the photoconductor after the transfer, cleaning units, such as a fur brush 14 and a cleaning blade 15, are used. In order to perform cleaning more efficiently, a pre-cleaning charger 13 may be used. Other cleaning units include web systems and magnet brush systems. Each may be used alone, or a plurality of systems may be used together. In addition, in order to remove the latent image on the electrophotographic photoconductor 1, a static eliminator 2 may be used. As the static eliminator 2, static elimination lamps, static elimination chargers, and the like are used. The exposure light sources and charging units can be utilized for each. In addition, for the processes of manuscript reading, paper feeding, fixing, paper ejection, and the like not in proximity with the photoconductor, known ones can be used.

(Process Cartridge)

The process cartridge of the present invention includes an electrophotographic photoconductor, and at least one unit of a charging unit configured to charge a surface of the electrophotographic photoconductor, an exposure unit configured to expose the charged surface of the electrophotographic photoconductor to light to form an electrostatic latent image, a developing unit configured to develop the electrostatic latent image with a toner to form a visible image, and a transfer unit configured to transfer the visible image to a recording medium, and further includes other units as required. The electrophotographic photoconductor used in the process cartridge of the present invention is the electrophotographic photoconductor of the present invention described above.

Figure 6:
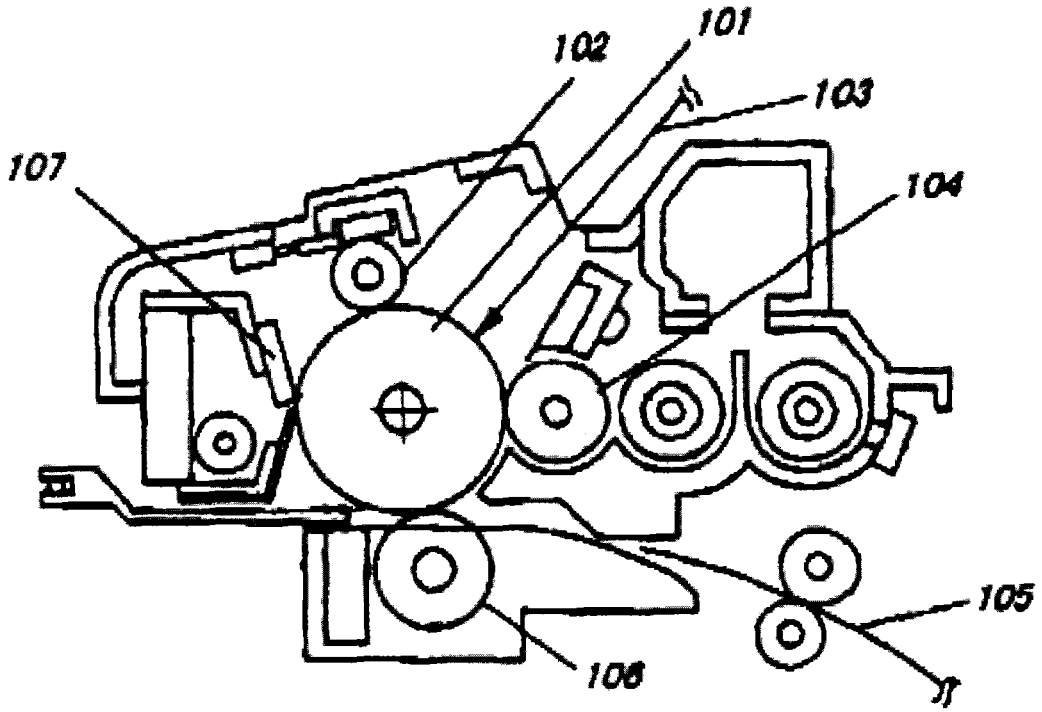
FIG. 6 is a schematic view showing one example of the process cartridge of the present invention.

The process cartridge is, for example, an apparatus (part) that contains an electrophotographic photoconductor 101, and, in addition, includes at least one of a charging unit 102, a developing unit 104, a transfer unit 106, a cleaning unit 107, and a discharging unit (not shown), as shown in FIG. 6, and is detachable from an image forming apparatus main body. An image forming step by the process cartridge in FIG. 6 is shown. While the photoconductor 101 rotates in the direction of the arrow, an electrostatic latent image corresponding to an exposed image is formed on the surface of the photoconductor 101 by charging by the charging unit 102 and exposure by the exposure unit 103. This electrostatic latent image is toner-developed by the developing unit 104, and the toner-developed image is transferred to a recording medium 105 by the transfer unit 106, and printed out. Then, the photoconductor surface after the image transfer is cleaned by the cleaning unit 107, and static electricity is further eliminated by the static eliminator (not shown), and the above operation is repeated again.

EXAMPLES

Next, the present invention will be more specifically described by giving Examples and Comparative Examples, but the present invention is not limited to the following Examples. "Parts" used in the Examples represent parts by mass.

Production Example 1

Production of Ga-Doped Zinc Oxide Fine Particles 1 Modified with N-Phenyl-3-Aminopropyltrimethoxysilane 2.5 g of N-phenyl-3-aminopropyltrimethoxysilane (KBM-573, manufactured by Shin-Etsu Chemical Co., Ltd.) and 25 g of Ga-doped zinc oxide fine particles (Pazet GK-40, primary particle average particle diameter 32 nm, manufactured by HakusuiTech Co., Ltd.) were added to 100 g of methanol. The mixture was refluxed at 95° C. for 2 hours, and then, the solvent was removed under reduced pressure. At a point when the solvent disappeared, the residue was heated to 150° C., and held for 2 hours to obtain Ga-doped zinc oxide fine particles modified with N-phenyl-3-aminopropyltrimethoxysilane (volume resistivity $9.2\times10^{1}$ Ω·cm).

<Measurement of Volume Resistivity>

The volume resistivity of the produced Ga-doped zinc oxide fine particles modified with N-phenyl-3-aminopropyltrimethoxysilane was measured based on JIS-K6911 using a combination of Model MCP-PD51 and Loresta GP or a combination of Model MCP-PD51 and Hiresta UP (all manufactured by Mitsubishi Chemical Analytech Co., Ltd.). The value of powder resistivity at a cylinder porosity of 50% was calculated from three measurement results by interpolation, and this value was taken as the volume resistivity of the Ga-doped zinc oxide fine particles modified with N-phenyl-3-aminopropyltrimethoxysilane. For the approximation, exponential function approximation is used. The conditions are as follows.

Cylinder porosity (%)=(1−weight of measured fine particles÷density of fine particles÷volume of fine particles during pressurization)×100

Amount of inorganic fine particles used for specimen: 1.0 g

Specimen shape: cylinder (diameter 20 mm)

Pressures during making of specimen: 10 MPa, 20 MPa

Specimen electrodes: W

Applied voltage: 0.1 V

Production Example 2

Production of Zinc Oxide Fine Particles Modified with N-Phenyl-3-Aminopropyltrimethoxysilane Zinc oxide fine particles modified with N-phenyl-3-aminopropyltrimethoxysilane (volume resistivity $3.0\times10^{4}$ Ω·cm) were obtained as in Production Example 1 except that the Ga-doped zinc oxide fine particles were changed to zinc oxide fine particles (Nanotek (registered trademark) ZnO, primary particle average particle diameter 28 nm, manufactured by C. I. Kasei Company, Limited).

Production Example 3

Production of Titanium Oxide Fine Particles 1 Modified with N-Phenyl-3-Aminopropyltrimethoxysilane Titanium oxide fine particles modified with N-phenyl-3-aminopropyltrimethoxysilane (volume resistivity $5.0\times10^{1}$ Ω·cm) were obtained as in Production Example 1 except that the Ga-doped zinc oxide fine particles were changed to titanium oxide fine particles (ET-300, primary particle average particle diameter 40 nm, manufactured by ISHIHARA SANGYO KAISHA, LTD.).

Production Example 4

Production of Tin Oxide Fine Particles Modified with N-Phenyl-3-Aminopropyltrimethoxysilane Tin oxide fine particles modified with N-phenyl-3-aminopropyltrimethoxysilane (volume resistivity $2.0\times10^{2}$ Ω·cm) were obtained as in Production Example 1 except that the Ga-doped zinc oxide fine particles were changed to tin oxide fine particles (S-2000, primary particle average particle diameter 30 nm, manufactured by Mitsubishi Materials Corporation).

Production Example 5

Production of Tin Oxide Fine Particles Modified with N-Phenyl-3-Aminopropyltrimethoxysilane Tin oxide fine particles modified with N-phenyl-3-aminopropyltrimethoxysilane (volume resistivity $7.0\times10^{7}$ Ω·cm) were obtained as in Production Example 1 except that the Ga-doped zinc oxide fine particles were changed to tin oxide fine particles (S-1, primary particle average particle diameter 43 nm, manufactured by Mitsubishi Materials Corporation).

Production Example 6

Production of Ga-Doped Zinc Oxide Fine Particles Modified with N-2-(Aminoethyl)-3-Aminopropyltrimethoxysilane Ga-doped zinc oxide fine particles modified with N-2-(aminoethyl)-3-aminopropyltrimethoxysilane (volume resistivity $7.2\times10^{1}$ Ω·cm) were obtained as in Production Example 1 except that N-phenyl-3-aminopropyltrimethoxysilane was changed to N-2-(aminoethyl)-3-aminopropyltrimethoxysilane (KBM-603, manufactured by Shin-Etsu Chemical Co., Ltd.).

Production Example 7

Production of Ga-Doped Zinc Oxide Fine Particles Modified with 3-Aminopropyltrimethoxysilane Ga-doped zinc oxide fine particles modified with 3-aminopropyltrimethoxysilane (volume resistivity $8.4\times10^{1}$ Ω·cm) were obtained as in Production Example 1 except that N-phenyl-3-aminopropyltrimethoxysilane was changed to 3-aminopropyltrimethoxysilane (KBM-903, manufactured by Shin-Etsu Chemical Co., Ltd.).

Production Example 8

Production of Silica Fine Particles Modified with N-Phenyl-3-Aminopropyltrimethoxysilane Silica fine particles modified with N-phenyl-3-aminopropyltrimethoxysilane (volume resistivity $4.0\times10^{12}$ Ω·cm) were obtained as in Production Example 1 except that the Ga-doped zinc oxide fine particles were changed to silica fine particles (R972CF, primary particle average particle diameter 20 nm, manufactured by NIPPON AEROSIL CO., LTD.).

Production Example 10

Production of Ga-Doped Zinc Oxide Fine Particles Modified with 4-[2-(Triethoxysilyl)ethyl]triphenylamine Ga-doped zinc oxide fine particles modified with 4-[2-(triethoxysilyl)ethyl]triphenylamine (volume resistivity $5.0\times10^{1}$ Ω·cm) were obtained as in Production Example 1 except that N-phenyl-3-aminopropyltrimethoxysilane was changed to 4-[2-(triethoxysilyl)ethyl]triphenylamine.

Production Example 11

Production of Silica Fine Particles Modified with N-Phenyl-3-Aminopropyltrimethoxysilane Silica fine particles modified with N-phenyl-3-aminopropyltrimethoxysilane (volume resistivity $3.0\times10^{9}$ Ω·cm) were obtained as in Production Example 1 except that the Ga-doped zinc oxide fine particles were changed to silica fine particles (Sciqas 0.05 μm, primary particle average particle diameter 50 nm, manufactured by Sakai Chemical Industry Co., Ltd.).

Production Example 12

Production of Tin Oxide Fine Particles Modified with Compound A-1

Tin oxide fine particles modified with a compound A-1 (volume resistivity $2.0\times10^{2}$ Ω·cm) were obtained as in Production Example 1 except that the Ga-doped zinc oxide fine particles were changed to tin oxide fine particles (S-2000, primary particle average particle diameter 30 nm, manufactured by Mitsubishi Materials Corporation), and N-phenyl-3-aminopropyltrimethoxysilane was changed to a compound A-1 represented by the following structural formula (1):

Compound A-1

Structural formula (I)

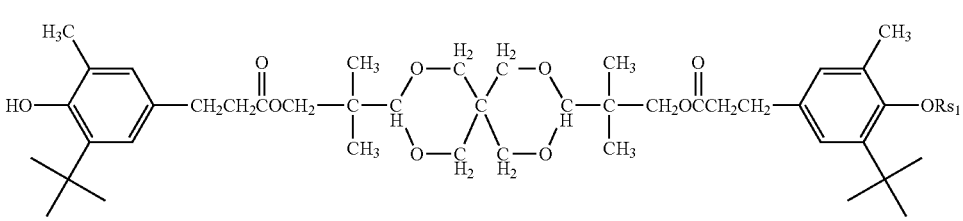

Production Example 9

Production of Ga-Doped Zinc Oxide Fine Particles Modified with 3-Methacryloxypropyltrimethoxysilane Ga-doped zinc oxide fine particles modified with 3-methacryloxypropyltrimethoxysilane (volume resistivity $8.0\times10^{1}$ Ω·cm) were obtained as in Production Example 1 except that N-phenyl-3-aminopropyltrimethoxysilane was changed to 3-methacryloxypropyltrimethoxysilane (KBM-503, manufactured by Shin-Etsu Chemical Co., Ltd.).

wherein $Rs_1$ is a functional group represented by $—Si(OCH_3)_3$.

Production Example 13

Production of Titanium Oxide Fine Particles 2 Modified with N-Phenyl-3-Aminopropyltrimethoxysilane Titanium oxide fine particles modified with N-phenyl-3-aminopropyltrimethoxysilane (volume resistivity $7.4\times10^{6}$ Ω·cm) were obtained as in Production Example 1 except that the Ga-doped zinc oxide fine particles were changed to titanium oxide fine particles (PT-401M, primary particle average particle diameter 70 nm, manufactured by ISHIHARA SANGYO KAISHA, LTD.).

Production Example 14

Production of Ga-Doped Zinc Oxide Fine Particles 2 Modified with N-Phenyl-3-Aminopropyltrimethoxysilane 2.5 g of N-phenyl-3-aminopropyltrimethoxysilane (KBM-573, manufactured by Shin-Etsu Chemical Co., Ltd.) and 25 g of Ga-doped zinc oxide fine particles (inorganic fine particles A, primary particle average particle diameter 31 nm) were added to 100 g of methanol. The mixture was refluxed at 95° C. for 2 hours, and then, the solvent was removed under reduced pressure. At a point when the solvent disappeared, the residue was heated to 150° C., and held for 2 hours to obtain Ga-doped zinc oxide fine particles 2 modified with N-phenyl-3-aminopropyltrimethoxysilane (volume resistivity $5.8\times10^4$ Ω·cm).

<<Method for Making Inorganic Fine Particles A (Zinc Oxide Doped with a Group 13 Element)>>

100 g of zinc oxide was added to an aqueous hydrochloric acid solution containing 250 g of 35% by mass hydrochloric acid and 350 g of pure water, and dissolved to make an aqueous zinc chloride solution. Next, 14.7 g of gallium nitrate octahydrate was added to the aqueous zinc chloride solution made. Apart from this, 230 g of ammonium bicarbonate (special grade reagent) was dissolved in 1500 g of purified water to separately prepare an aqueous ammonium bicarbonate solution. The aqueous zinc chloride solution in which gallium nitrate was dissolved was slowly added to the aqueous ammonium bicarbonate solution to produce a precipitate. Then, 150 mL of an aqueous solution containing 23.5 g of sodium metasilicate nonahydrate, and 10% by mass sulfuric acid were added while the flow rates were adjusted so that the pH was in the range of 7 to 9. They were simultaneously added over 90 minutes. Then, the precipitate was sufficiently washed, then separated from the liquid phase, and dried at 130° C. for 5 hours. Finally, the dry powder was crushed in an agate mortar to provide a firing precursor, and this precursor was placed in a boat made of alumina, and heated at 200° C./h to 700° C. using a tubular furnace while a mixed gas of 0.2 liters/min of a nitrogen gas and 0.1 liters/min of a hydrogen gas was flowed. The material was held for 2 hours as it was, and then allowed to cool to room temperature to obtain inorganic fine particles A having an average particle diameter of 31 nm suitable for the present invention.

Production Example 15

Production of Ga-Doped Zinc Oxide Fine Particles 2 Modified with N-2-(Aminoethyl)-3-Aminopropyltrimethoxysilane Ga-doped zinc oxide fine particles 2 modified with N-2-(aminoethyl)-3-aminopropyltrimethoxysilane (volume resistivity $5.8\times10^4$ Ω·cm) were obtained as in Production Example 14 except that N-phenyl-3-aminopropyltrimethoxysilane was changed to N2-(aminoethyl)-3-aminopropyltrimethoxysilane (KBM-603, manufactured by Shin-Etsu Chemical Co., Ltd.).

Production Example 16

Production of Ga-Doped Zinc Oxide Fine Particles 2 Modified with 3-Aminopropyltrimethoxysilane Ga-doped zinc oxide fine particles 2 modified with 3-aminopropyltrimethoxysilane (volume resistivity $3.8\times10^4$ Ω·cm) were obtained as in Production Example 14 except that N-phenyl-3-aminopropyltrimethoxysilane was changed to 3-aminopropyltrimethoxysilane (KBM-903, manufactured by Shin-Etsu Chemical Co., Ltd.).

Production Example 17

Production of Ga-Doped Zinc Oxide Fine Particles Modified with 3-Methacryloxypropyltrimethoxysilane Ga-doped zinc oxide fine particles modified with 3-methacryloxypropyltrimethoxysilane (volume resistivity $6.9\times10^4$ Ω·cm) were obtained as in Production Example 14 except that N-phenyl-3-aminopropyltrimethoxysilane was changed to 3-methacryloxypropyltrimethoxysilane (KBM-503, manufactured by Shin-Etsu Chemical Co., Ltd.).

Production Example 18

Production of Ga-Doped Zinc Oxide Fine Particles Modified with 4-[2-(Triethoxysilyl)ethyl]triphenylamine Ga-doped zinc oxide fine particles modified with 4-[2-(triethoxysilyl)ethyl]triphenylamine (volume resistivity $1.3\times10^4$ Ω·cm) were obtained as in Production Example 14 except that N-phenyl-3-aminopropyltrimethoxysilane was changed to 4-[2-(triethoxysilyl)ethyl]triphenylamine.

Example 1

An undercoat layer coating liquid, a charge generation layer coating liquid, and a charge transport layer coating liquid having the following compositions were sequentially applied onto an aluminum cylinder having a diameter ϕ of 40 mm and dried to form an undercoat layer having an average thickness of 3.5 μm, a charge generation layer having an average thickness of 0.2 μm, and a charge transport layer having an average thickness of 20 μm, respectively.

[Undercoat Layer Coating Liquid]

Alkyd resin: 12 parts (BECKOSOL 1307-60-EL, manufactured by DIC CORPORATION)

Melamine resin: 8 parts (SUPER BECKAMINE G-821-60, manufactured by DIC CORPORATION)

Titanium oxide: 80 parts (CR-EL, manufactured by ISHIHARA SANGYO KAISHA, LTD.)

Methyl ethyl ketone: 250 parts

[Charge Generation Layer Coating Liquid]

Bisazo pigment of the following structural formula (2): 2.5 parts

Polyvinyl butyral (XYHL, manufactured by UCC): 0.5 parts

Cyclohexanone: 200 parts

Methyl ethyl ketone: 80 parts

Structural formula (2)

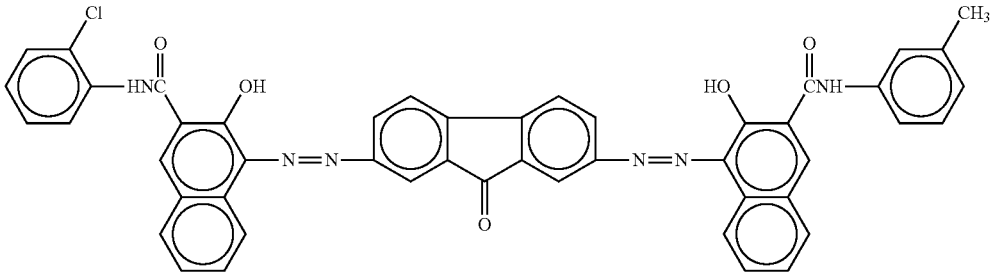

[Charge Transport Layer Coating Liquid]

Bisphenol Z polycarbonate: 10 parts (Panlite TS-2050, manufactured by Teijin Chemicals Ltd.)

Charge-transporting compound of the following structural formula (3): 7 parts

Tetrahydrofuran: 100 parts

Tetrahydrofuran solution of 1% by mass silicone oil: 1 part (KF50-100CS, manufactured by Shin-Etsu Chemical Co., Ltd.)

Structural formula (3)

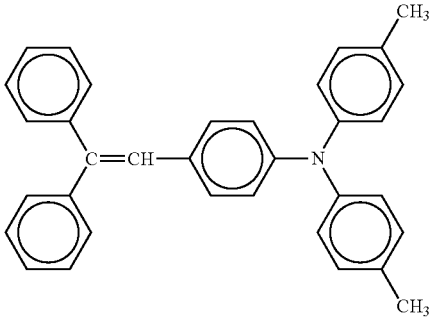

[Surface Layer Coating Process]

A surface layer having an average thickness of 4.5 μm was formed on the laminate having the electroconductive substrate, undercoat layer, charge generation layer, and charge transport layer in this order by a spray coating method using the following surface layer coating liquid 1.

[Surface Layer Coating Liquid 1]

Trimethylolpropane triacrylate: 100 parts (TMPTA, manufactured by TOKYO CHEMICAL INDUSTRY CO., LTD.)

Ga-doped zinc oxide fine particles 1 modified with N-phenyl-3-aminopropyltrimethoxysilane (volume resistivity $9.2\times10^{1}$ Ω·cm) in Production Example 1: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts

[Ultraviolet Irradiation and Drying Process]

The laminate in which the surface layer was formed was subjected to light irradiation under the conditions of an illuminance of 900 mW/cm$^2$ and an irradiation time of 120 seconds using a metal halide lamp while the laminate was rotated, to crosslink the surface layer. Then, the laminate was dried under the conditions of 130° C. and 30 minutes to obtain an electrophotographic photoconductor.

Example 2

An electrophotographic photoconductor was made as in Example 1 except that the surface layer coating liquid 1 used in Example 1 was changed to the following surface layer coating liquid 2.

[Surface Layer Coating Liquid 2]

Trimethylolpropane triacrylate: 100 parts (TMPTA, manufactured by TOKYO CHEMICAL INDUSTRY CO., LTD.)

Ga-doped zinc oxide fine particles 1 modified with N-phenyl-3-aminopropyltrimethoxysilane (volume resistivity $9.2\times10^{1}$ Ω·cm) in Production Example 1: 33.3 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,245 parts

Example 3

An electrophotographic photoconductor was made as in Example 1 except that the surface layer coating liquid 1 used in Example 1 was changed to the following surface layer coating liquid 3.

[Surface Layer Coating Liquid 3]

Trimethylolpropane triacrylate: 100 parts (TMPTA, manufactured by TOKYO CHEMICAL INDUSTRY CO., LTD.)

Ga-doped zinc oxide fine particles 1 modified with N-phenyl-3-aminopropyltrimethoxysilane (volume resistivity $9.2\times10^{1}$ Ω·cm) in Production Example 1: 150 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 2,295 parts

Example 4

The surface layer coating liquid 1 used in Example 1 was changed to the following surface layer coating liquid 4, and a surface layer having an average thickness of 4.5 μm was formed on the laminate having the electroconductive substrate, undercoat layer, charge generation layer, and charge transport layer in this order described in Example 1 by a spray coating method, and dried under the conditions of 150° C. for 30 minutes to obtain an electrophotographic photoconductor.

[Surface Layer Coating Liquid 4]

Compound obtained by adjusting the following two compounds at OH value/NCO value=1.0: 100 parts 1. Polyol compound of the following structural formula (4)

Structural formula (4)

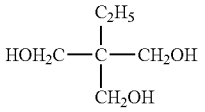

2. Isocyanate compound (TAKENATE (registered trademark) D140N, manufactured by Mitsui Takeda Chemicals Inc.)

Ga-doped zinc oxide fine particles 1 modified with N-phenyl-3-aminopropyltrimethoxysilane (volume resistivity $9.2\times10^{1}$ Ω·cm) in Production Example 1: 100 parts Methyl ethyl ketone: 1,845 parts Example 5

An electrophotographic photoconductor was made as in Example 4 except that the surface layer coating liquid 1 used in Example 4 was changed to the following surface layer coating liquid 5.

[Surface Layer Coating Liquid 5]

Compound obtained by adjusting the following two compounds at OH value/NCO value=1.0: 100 parts 1. Polyol compound of the structural formula (4)

2. Isocyanate compound (TAKENATE (registered trademark) D140N, manufactured by Mitsui Takeda Chemicals Inc.)

Ga-doped zinc oxide fine particles 1 modified with N-phenyl-3-aminopropyltrimethoxysilane (volume resistivity $9.2\times10^{1}$ Ω·cm) in Production Example 1: 33.3 parts Methyl ethyl ketone: 1,245 parts Example 6

An electrophotographic photoconductor was made as in Example 4 except that the surface layer coating liquid 1 used in Example 4 was changed to the following surface layer coating liquid 6.

[Surface Layer Coating Liquid 6]

Compound obtained by adjusting the following two compounds at OH value/NCO value=1.0: 100 parts 1. Polyol compound of the structural formula (4)

2. Isocyanate compound (TAKENATE (registered trademark) D140N, manufactured by Mitsui Takeda Chemicals Inc.)

Ga-doped zinc oxide fine particles 1 modified with N-phenyl-3-aminopropyltrimethoxysilane (volume resistivity $9.2\times10^{1}$ Ω·cm) in Production Example 1: 150 parts Methyl ethyl ketone: 2,295 parts Example 7

An electrophotographic photoconductor was made as in Example 4 except that the surface layer coating liquid 1 used in Example 4 was changed to the following surface layer coating liquid 7.

[Surface Layer Coating Liquid 7]

Bisphenol Z polycarbonate: 100 parts (Panlite (registered trademark) TS-2050, manufactured by Teijin Chemicals Ltd.)

Ga-doped zinc oxide fine particles 1 modified with N-phenyl-3-aminopropyltrimethoxysilane (volume resistivity $9.2\times10^{1}$ Ω·cm) in Production Example 1: 100 parts Tetrahydrofuran: 4,612 parts Example 8

An electrophotographic photoconductor was made as in Example 4 except that the surface layer coating liquid 1 used in Example 4 was changed to the following surface layer coating liquid 8.

[Surface Layer Coating Liquid 8]

Bisphenol Z polycarbonate: 100 parts (Panlite (registered trademark) TS-2050, manufactured by Teijin Chemicals Ltd.)

Ga-doped zinc oxide fine particles 1 modified with N-phenyl-3-aminopropyltrimethoxysilane (volume resistivity $9.2\times10^{1}$ Ω·cm) in Production Example 1: 33.3 parts Tetrahydrofuran: 3,113 parts Example 9

An electrophotographic photoconductor was made as in Example 4 except that the surface layer coating liquid 1 used in Example 4 was changed to the following surface layer coating liquid 9.

[Surface Layer Coating Liquid 9]

Bisphenol Z polycarbonate: 100 parts (Panlite (registered trademark) TS-2050, manufactured by Teijin Chemicals Ltd.)

Ga-doped zinc oxide fine particles 1 modified with N-phenyl-3-aminopropyltrimethoxysilane (volume resistivity $9.2\times10^{1}$ Ω·cm) in Production Example 1: 150 parts Tetrahydrofuran: 5,738 parts Example 10

An electrophotographic photoconductor was made as in Example 1 except that the surface layer coating liquid 1 used in Example 1 was changed to the following surface layer coating liquid 10.

[Surface Layer Coating Liquid 10]

Trimethylolpropane triacrylate: 100 parts (TMPTA, manufactured by TOKYO CHEMICAL INDUSTRY CO., LTD.)

Zinc oxide fine particles modified with N-phenyl-3-aminopropyltrimethoxysilane (volume resistivity $3.0\times10^{4}$ Ω·cm) in Production Example 2: 120 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 2,025 parts Example 11

An electrophotographic photoconductor was made as in Example 1 except that the surface layer coating liquid 1 used in Example 1 was changed to the following surface layer coating liquid 11.

[Surface Layer Coating Liquid 11]

Trimethylolpropane triacrylate: 100 parts (TMPTA, manufactured by TOKYO CHEMICAL INDUSTRY CO., LTD.)

Titanium oxide fine particles modified with N-phenyl-3-aminopropyltrimethoxysilane (volume resistivity $5.0\times10^{1}$ Ω·cm) in Production Example 3: 10 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,035 parts Example 12

An electrophotographic photoconductor was made as in Example 1 except that the surface layer coating liquid 1 used in Example 1 was changed to the following surface layer coating liquid 12.

[Surface Layer Coating Liquid 12]

Trimethylolpropane triacrylate: 100 parts (TMPTA, manufactured by TOKYO CHEMICAL INDUSTRY CO., LTD.)

Titanium oxide fine particles 2 modified with N-phenyl-3-aminopropyltrimethoxysilane (volume resistivity $7.4\times10^{6}$ Ω·cm) in Production Example 13: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Example 13

An electrophotographic photoconductor was made as in Example 1 except that the surface layer coating liquid 1 used in Example 1 was changed to the following surface layer coating liquid 13.

[Surface Layer Coating Liquid 13]

Trimethylolpropane triacrylate: 100 parts (TMPTA, manufactured by TOKYO CHEMICAL INDUSTRY CO., LTD.)

Tin oxide fine particles modified with N-phenyl-3-aminopropyltrimethoxysilane (volume resistivity $2.0\times10^{2}$ Ω·cm) in Production Example 4: 20 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,125 parts Example 14

An electrophotographic photoconductor was made as in Example 1 except that the surface layer coating liquid 1 used in Example 1 was changed to the following surface layer coating liquid 14.

[Surface Layer Coating Liquid 14]

Trimethylolpropane triacrylate: 100 parts (TMPTA, manufactured by TOKYO CHEMICAL INDUSTRY CO., LTD.)

Tin oxide fine particles modified with N-phenyl-3-aminopropyltrimethoxysilane (volume resistivity $7.0\times10^{7}$ Ω·cm) in Production Example 5: 130 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 2,115 parts Example 15

An electrophotographic photoconductor was made as in Example 1 except that the surface layer coating liquid 1 used in Example 1 was changed to the following surface layer coating liquid 15.

[Surface Layer Coating Liquid 15]

Trimethylolpropane triacrylate: 100 parts (TMPTA, manufactured by TOKYO CHEMICAL INDUSTRY CO., LTD.)

Ga-doped zinc oxide fine particles modified with N-2-(aminoethyl)-3-aminopropyltrimethoxysilane (volume resistivity $7.2\times10^{1}$ Ω·cm) in Production Example 6: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Example 16

An electrophotographic photoconductor was made as in Example 1 except that the surface layer coating liquid 1 used in Example 1 was changed to the following surface layer coating liquid 16.

[Surface Layer Coating Liquid 16]

Trimethylolpropane triacrylate: 100 parts (TMPTA, manufactured by TOKYO CHEMICAL INDUSTRY CO., LTD.)

Ga-doped zinc oxide fine particles modified with 3-aminopropyltrimethoxysilane (volume resistivity $8.4\times10^{1}$ Ω·cm) in Production Example 7: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Example 17

An electrophotographic photoconductor was made as in Example 1 except that the surface layer coating liquid 1 used in Example 1 was changed to the following surface layer coating liquid 17.

[Surface Layer Coating Liquid 17]

Trimethylolpropane triacrylate: 100 parts (TMPTA, manufactured by TOKYO CHEMICAL INDUSTRY CO., LTD.)

Ga-doped zinc oxide fine particles 2 modified with N-phenyl-3-aminopropyltrimethoxysilane (volume resistivity $5.8\times10^{4}$ Ω·cm) in Production Example 14: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Example 18

An electrophotographic photoconductor was made as in Example 1 except that the surface layer coating liquid 1 used in Example 1 was changed to the following surface layer coating liquid 18.

[Surface Layer Coating Liquid 18]

Trimethylolpropane triacrylate: 100 parts (TMPTA, manufactured by TOKYO CHEMICAL INDUSTRY CO., LTD.)

Ga-doped zinc oxide fine particles 2 modified with N-phenyl-3-aminopropyltrimethoxysilane (volume resistivity $5.8\times10^{4}$ Ω·cm) in Production Example 14: 33 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,245 parts Example 19

An electrophotographic photoconductor was made as in Example 1 except that the surface layer coating liquid 1 used in Example 1 was changed to the following surface layer coating liquid 19.

[Surface Layer Coating Liquid 19]

Trimethylolpropane triacrylate: 100 parts (TMPTA, manufactured by TOKYO CHEMICAL INDUSTRY CO., LTD.)

Ga-doped zinc oxide fine particles 2 modified with N-phenyl-3-aminopropyltrimethoxysilane (volume resistivity $5.8\times10^4$ Ω·cm) in Production Example 14: 150 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 2,295 parts Example 20

An electrophotographic photoconductor was made as in Example 4 except that the surface layer coating liquid 1 used in Example 4 was changed to the following surface layer coating liquid 20.

[Surface Layer Coating Liquid 20]

Compound obtained by adjusting the following two compounds at OH value/NCO value=1.0: 100 parts 1. Polyol compound of the structural formula (4)

2. Isocyanate compound (TAKENATE (registered trademark) D140N, manufactured by Mitsui Takeda Chemicals Inc.)

Ga-doped zinc oxide fine particles 2 modified with N-phenyl-3-aminopropyltrimethoxysilane (volume resistivity $5.8\times10^4$ Ω·cm) in Production Example 14: 100 parts Methyl ethyl ketone: 1,845 parts Example 21

An electrophotographic photoconductor was made as in Example 4 except that the surface layer coating liquid 1 used in Example 4 was changed to the following surface layer coating liquid 21.

[Surface Layer Coating Liquid 21]

Compound obtained by adjusting the following two compounds at OH value/NCO value=1.0: 100 parts 1. Polyol compound of the structural formula (4)

2. Isocyanate compound (TAKENATE (registered trademark) D140N, manufactured by Mitsui Takeda Chemicals Inc.)

Ga-doped zinc oxide fine particles 2 modified with N-phenyl-3-aminopropyltrimethoxysilane (volume resistivity $5.8\times10^4$ Ω·cm) in Production Example 14: 33.3 parts Methyl ethyl ketone: 1,245 parts Example 22

An electrophotographic photoconductor was made as in Example 4 except that the surface layer coating liquid 1 used in Example 4 was changed to the following surface layer coating liquid 22.

[Surface Layer Coating Liquid 22]

Compound obtained by adjusting the following two compounds at OH value/NCO value=1.0: 100 parts 1. Polyol compound of the structural formula (4)

2. Isocyanate compound (TAKENATE (registered trademark) D140N, manufactured by Mitsui Takeda Chemicals Inc.)

Ga-doped zinc oxide fine particles 2 modified with N-phenyl-3-aminopropyltrimethoxysilane (volume resistivity $5.8\times10^4$ Ω·cm) in Production Example 14: 150 parts Methyl ethyl ketone: 2,295 parts Example 23

An electrophotographic photoconductor was made as in Example 4 except that the surface layer coating liquid 1 used in Example 4 was changed to the following surface layer coating liquid 23.

[Surface Layer Coating Liquid 23]

Bisphenol Z polycarbonate: 100 parts (Panlite (registered trademark) TS-2050, manufactured by Teijin Chemicals Ltd.)

Ga-doped zinc oxide fine particles 2 modified with N-phenyl-3-aminopropyltrimethoxysilane (volume resistivity $5.8\times10^4$ Ω·cm) in Production Example 14: 100 parts Tetrahydrofuran: 4,612 parts Example 24

An electrophotographic photoconductor was made as in Example 4 except that the surface layer coating liquid 1 used in Example 4 was changed to the following surface layer coating liquid 24.

[Surface Layer Coating Liquid 24]

Bisphenol Z polycarbonate: 100 parts (Panlite (registered trademark) TS-2050, manufactured by Teijin Chemicals Ltd.)

Ga-doped zinc oxide fine particles 2 modified with N-phenyl-3-aminopropyltrimethoxysilane (volume resistivity $5.8\times10^4$ Ω·cm) in Production Example 14: 33.3 parts Tetrahydrofuran: 3,113 parts Example 25

An electrophotographic photoconductor was made as in Example 4 except that the surface layer coating liquid 1 used in Example 4 was changed to the following surface layer coating liquid 25.

[Surface Layer Coating Liquid 25]

Bisphenol Z polycarbonate: 100 parts (Panlite (registered trademark) TS-2050, manufactured by Teijin Chemicals Ltd.)

Ga-doped zinc oxide fine particles 2 modified with N-phenyl-3-aminopropyltrimethoxysilane (volume resistivity $5.8\times10^4$ Ω·cm) in Production Example 14: 150 parts Tetrahydrofuran: 5,738 parts Example 26

An electrophotographic photoconductor was made as in Example 1 except that the surface layer coating liquid 1 used in Example 1 was changed to the following surface layer coating liquid 26.

[Surface Layer Coating Liquid 26]

Trimethylolpropane triacrylate: 100 parts (TMPTA, manufactured by TOKYO CHEMICAL INDUSTRY CO., LTD.)

Ga-doped zinc oxide fine particles 2 modified with N-2-(aminoethyl)-3-aminopropyltrimethoxysilane (volume resistivity $5.8\times10^4$ Ω·cm) in Production Example 15: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Example 27

An electrophotographic photoconductor was made as in Example 1 except that the surface layer coating liquid 1 used in Example 1 was changed to the following surface layer coating liquid 27.

[Surface Layer Coating Liquid 27]

Trimethylolpropane triacrylate: 100 parts (TMPTA, manufactured by TOKYO CHEMICAL INDUSTRY CO., LTD.)

Ga-doped zinc oxide fine particles 2 modified with 3-aminopropyltrimethoxysilane (volume resistivity $3.8\times10^4$ Ω·cm) in Production Example 16: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Example 28

An electrophotographic photoconductor was made as in Example 1 except that the surface layer coating liquid 1 used in Example 1 was changed to the following surface layer coating liquid 28.

[Surface Layer Coating Liquid 28]

Trimethylolpropane triacrylate: 100 parts (TMPTA, manufactured by TOKYO CHEMICAL INDUSTRY CO., LTD.)

Ga-doped zinc oxide fine particles 2 modified with N-phenyl-3-aminopropyltrimethoxysilane (volume resistivity $5.8\times10^4$ Ω·cm) in Production Example 14: 100 parts Charge transport material of the following structural formula (A): 10 parts <Structural Formula (A)>

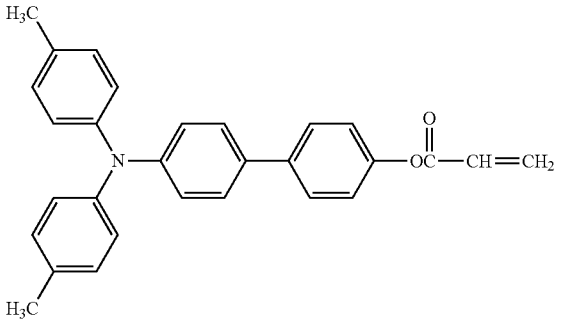

Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Example 29

An electrophotographic photoconductor was made as in Example 1 except that the surface layer coating liquid 1 used in Example 1 was changed to the following surface layer coating liquid 29.

[Surface Layer Coating Liquid 29]

Trimethylolpropane triacrylate: 100 parts (TMPTA, manufactured by TOKYO CHEMICAL INDUSTRY CO., LTD.)

Ga-doped zinc oxide fine particles 2 modified with N-phenyl-3-aminopropyltrimethoxysilane (volume resistivity $5.8\times10^4$ Ω·cm) in Production Example 14: 100 parts Charge transport material of the above structural formula (A): 20 parts Photopolymerization initiator (1-hydroxy-cyclohexyl-phenyl-ketone, IRGACURE (registered trademark) 184, manufactured by Cibty Chemicals): 5 parts Methyl ethyl ketone: 2,025 parts Example 30

An electrophotographic photoconductor was made as in Example 1 except that the surface layer coating liquid 1 used in Example 1 was changed to the following surface layer coating liquid 30.

[Surface Layer Coating Liquid 30]

Trimethylolpropane triacrylate: 100 parts (TMPTA, manufactured by TOKYO CHEMICAL INDUSTRY CO., LTD.)

Ga-doped zinc oxide fine particles 2 modified with N-phenyl-3-aminopropyltrimethoxysilane (volume resistivity $5.8\times10^4$ Ω·cm) in Production Example 14: 100 parts Charge transport material of the above structural formula (A): 40 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 2,205 parts Example 31

An electrophotographic photoconductor was made as in Example 4 except that the surface layer coating liquid 1 used in Example 4 was changed to the following surface layer coating liquid 31.

[Surface Layer Coating Liquid 31]

Bisphenol Z polycarbonate: 100 parts (Panlite (registered trademark) TS-2050, manufactured by Teijin Chemicals Ltd.)

Ga-doped zinc oxide fine particles 2 modified with N-phenyl-3-aminopropyltrimethoxysilane (volume resistivity $5.8\times10^4$ Ω·cm) in Production Example 14: 100 parts Charge transport material of the following structural formula (B): 10 parts <Structural Formula (B)>

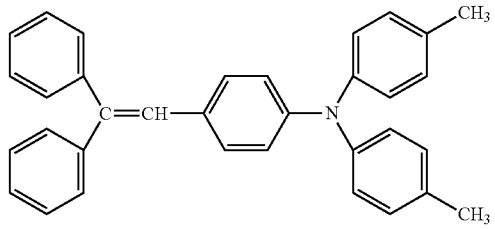

Tetrahydrofuran: 4,838 parts

Example 32

An electrophotographic photoconductor was made as in Example 4 except that the surface layer coating liquid 1 used in Example 4 was changed to the following surface layer coating liquid 32.

[Surface Layer Coating Liquid 32]

Bisphenol Z polycarbonate: 100 parts (Panlite (registered trademark) TS-2050, manufactured by Teijin Chemicals Ltd.)

Ga-doped zinc oxide fine particles 2 modified with N-phenyl-3-aminopropyltrimethoxysilane (volume resistivity $5.8\times10^4$ Ω·cm) in Production Example 14: 100 parts Charge transport material of the above structural formula (B): 20 parts Tetrahydrofuran: 5,062 parts Example 33

An electrophotographic photoconductor was made as in Example 4 except that the surface layer coating liquid 1 used in Example 4 was changed to the following surface layer coating liquid 33.

[Surface Layer Coating Liquid 33]

Bisphenol Z polycarbonate: 100 parts (Panlite (registered trademark) TS-2050, manufactured by Teijin Chemicals Ltd.)

Ga-doped zinc oxide fine particles 2 modified with N-phenyl-3-aminopropyltrimethoxysilane (volume resistivity $5.8\times10^4$ Ω·cm) in Production Example 14: 100 parts Charge transport material of the above structural formula (B): 40 parts Tetrahydrofuran: 5,513 parts Example 34

An electrophotographic photoconductor was made as in Example 1 except that the surface layer coating liquid 1 used in Example 1 was changed to the following surface layer coating liquid 34.

[Surface Layer Coating Liquid 34]

Trimethylolpropane triacrylate: 100 parts (TMPTA, manufactured by TOKYO CHEMICAL INDUSTRY CO., LTD.)

Ga-doped zinc oxide fine particles 1 modified with N-phenyl-3-aminopropyltrimethoxysilane (volume resistivity $9\times10^1$ Ω·cm) in Production Example 1: 45.5 parts Silica particles (Sciqas Series 0.1 μm, manufactured by Sakai Chemical Industry Co., Ltd., average particle diameter 100 nm): 27.3 parts Photopolymerization initiator (1-hydroxy-cyclohexyl-phenyl-ketone): 5 parts (IRGACURE 184, manufactured by Ciba Specialty Chemicals)

Methyl ethyl ketone: 1,340 parts

Cyclohexanone: 148.9 parts

Example 35

An electrophotographic photoconductor was made as in Example 1 except that the surface layer coating liquid 1 used in Example 1 was changed to the following surface layer coating liquid 35.

[Surface Layer Coating Liquid 35]

Trimethylolpropane triacrylate: 100 parts (TMPTA, manufactured by TOKYO CHEMICAL INDUSTRY CO., LTD.)

Ga-doped zinc oxide fine particles 1 modified with N-phenyl-3-aminopropyltrimethoxysilane (volume resistivity $9\times10^1$ Ω·cm) in Production Example 1; 142.9 parts Titanium oxide particles (JR-301, manufactured by Tayca Corporation, average particle diameter 300 nm): 28.6 parts Photopolymerization initiator (1-hydroxy-cyclohexyl-phenyl-ketone): 5 parts (IRGACURE 184, manufactured by Ciba Specialty Chemicals)

Methyl ethyl ketone: 2,089 parts

Cyclohexanone: 232.1 parts

Example 36

An electrophotographic photoconductor was made as in Example 1 except that the surface layer coating liquid 1 used in Example 1 was changed to the following surface layer coating liquid 36.

[Surface Layer Coating Liquid 36]

Trimethylolpropane triacrylate: 100 parts (TMPTA, manufactured by TOKYO CHEMICAL INDUSTRY CO., LTD.)

Ga-doped zinc oxide fine particles modified with 3-aminopropyltrimethoxysilane (volume resistivity $1\times10^3$ Ω·cm) in Production Example 7: 142.9 parts Titanium oxide particles (JR-301, manufactured by Tayca Corporation, average particle diameter 300 nm): 28.6 parts Photopolymerization initiator (1-hydroxy-cyclohexyl-phenyl-ketone): 5 parts Methyl ethyl ketone: 2,089 parts Cyclohexanone: 232.1 parts Example 37

An electrophotographic photoconductor was made as in Example 1 except that the surface layer coating liquid 1 used in Example 1 was changed to the following surface layer coating liquid 37.

[Surface Layer Coating Liquid 37]

Trimethylolpropane triacrylate: 100 parts (TMPTA, manufactured by TOKYO CHEMICAL INDUSTRY CO., LTD.)

Ga-doped zinc oxide fine particles 2 modified with N-phenyl-3-aminopropyltrimethoxysilane (volume resistivity $6\times10^4$ Ω·cm) in Production Example 14: 45.5 parts Alumina particles (AA-05, manufactured by Sumitomo Chemical Co., Ltd., average particle diameter 500 nm): 27.3 parts Photopolymerization initiator (1-hydroxy-cyclohexyl-phenyl-ketone): 5 parts (IRGACURE 184, manufactured by Ciba Specialty Chemicals)

Methyl ethyl ketone: 1,340 parts

Cyclohexanone: 148.9 parts

Example 38

An electrophotographic photoconductor was made as in Example 1 except that the surface layer coating liquid 1 used in Example 1 was changed to the following surface layer coating liquid 38.

[Surface Layer Coating Liquid 38]

Trimethylolpropane triacrylate: 100 parts (TMPTA, manufactured by TOKYO CHEMICAL INDUSTRY CO., LTD.)

Ga-doped zinc oxide fine particles 2 modified with N-phenyl-3-aminopropyltrimethoxysilane (volume resistivity $6\times10^4$ Ω·cm) in Production Example 14: 200 parts Alumina particles (AA-03, manufactured by Sumitomo Chemical Co., Ltd., average particle diameter 300 nm): 16.7 parts Photopolymerization initiator (1-hydroxy-cyclohexyl-phenyl-ketone): 5 parts (IRGACURE 184, manufactured by Ciba Specialty Chemicals)

Methyl ethyl ketone: 2,790 parts

Cyclohexanone: 148.9 parts

Example 39

An electrophotographic photoconductor was made as in Example 4 except that the surface layer coating liquid 1 used in Example 4 was changed to the following surface layer coating liquid 39.

[Surface Layer Coating Liquid 39]

Compound obtained by adjusting the following two compounds at OH value/NCO value=1.0: 100 parts 1. Polyol compound of the structural formula (4)

2. Isocyanate compound (TAKENATE (registered trademark) D140N, manufactured by Mitsui Takeda Chemicals Inc.)

Ga-doped zinc oxide fine particles 2 modified with N-phenyl-3-aminopropyltrimethoxysilane (volume resistivity $6\times10^4$ Ω·cm) in Production Example 14: 41.7 parts Alumina particles (AA-03, manufactured by Sumitomo Chemical Co., Ltd., average particle diameter 300 nm): 25 parts Methyl ethyl ketone: 1,309 parts Cyclohexanone: 145.5 parts Example 40

An electrophotographic photoconductor was made as in Example 4 except that the surface layer coating liquid 1 used in Example 4 was changed to the following surface layer coating liquid 40.

[Surface Layer Coating Liquid 40]

Compound obtained by adjusting the following two compounds at OH value/NCO value=1.0: 100 parts 1. Polyol compound of the structural formula (4)

2. Isocyanate compound (TAKENATE (registered trademark) D140N, manufactured by Mitsui Takeda Chemicals Inc.)

Ga-doped zinc oxide fine particles 2 modified with N-phenyl-3-aminopropyltrimethoxysilane (volume resistivity $6\times10^4$ Ω·cm) in Production Example 14: 171.4 parts Alumina particles (AA-03, manufactured by Sumitomo Chemical Co., Ltd., average particle diameter 300 nm): 14.3 parts Methyl ethyl ketone: 2,280 parts Cyclohexanone: 253.3 parts Example 41

An electrophotographic photoconductor was made as in Example 7 except that the surface layer coating liquid 7 used in Example 7 was changed to the following surface layer coating liquid 41.

[Surface Layer Coating Liquid 41]

Bisphenol Z polycarbonate: 100 parts (Panlite (registered trademark) TS-2050, manufactured by Teijin Chemicals Ltd.)

Ga-doped zinc oxide fine particles 2 modified with N-phenyl-3-aminopropyltrimethoxysilane (volume resistivity $6\times10^4$ Ω·cm) in Production Example 14: 41.7 parts Alumina particles (AA-05, manufactured by Sumitomo Chemical Co., Ltd., average particle diameter 500 nm): 25 parts Tetrahydrofuran: 4,612 parts Example 42

An electrophotographic photoconductor was made as in Example 7 except that the surface layer coating liquid 7 used in Example 7 was changed to the following surface layer coating liquid 42.

[Surface Layer Coating Liquid 42]

Bisphenol Z polycarbonate: 100 parts (Panlite (registered trademark) TS-2050, manufactured by Teijin Chemicals Ltd.)

Ga-doped zinc oxide fine particles 2 modified with N-phenyl-3-aminopropyltrimethoxysilane (volume resistivity $6\times10^4$ Ωcm) in Production Example 14: 171.4 parts Alumina particles (AA-03, manufactured by Sumitomo Chemical Co., Ltd., average particle diameter 300 nm): 14.3 parts Tetrahydrofuran: 2,533 parts Example 43

An electrophotographic photoconductor was made as in Example 1 except that the surface layer coating liquid 1 used in Example 1 was changed to the following surface layer coating liquid 43.

[Surface Layer Coating Liquid 43]

Trimethylolpropane triacrylate (TMPTA, manufactured by TOKYO CHEMICAL INDUSTRY CO., LTD.): 100 parts Ga-doped zinc oxide fine particles 1 modified with N-phenyl-3-aminopropyltrimethoxysilane (volume resistivity $9\times10^1$ Ω·cm) in Production Example 1: 100 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 17): 5 parts Methyl ethyl ketone: 1701 parts Cyclohexanone: 189 parts Example 44

An electrophotographic photoconductor was made as in Example 1 except that the surface layer coating liquid 1 used in Example 1 was changed to the following surface layer coating liquid 44.

[Surface Layer Coating Liquid 44]

Trimethylolpropane triacrylate (TMPTA, manufactured by TOKYO CHEMICAL INDUSTRY CO., LTD.): 100 parts Ga-doped zinc oxide fine particles 1 modified with N-phenyl-3-aminopropyltrimethoxysilane (volume resistivity $9\times10^1$ Ω·cm) in Production Example 1: 100 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 17): 10 parts Methyl ethyl ketone: 1741.5 parts Cyclohexanone: 193.5 parts Example 45

An electrophotographic photoconductor was made as in Example 4 except that the surface layer coating liquid 1 used in Example 4 was changed to the following surface layer coating liquid 45.

[Surface Layer Coating Liquid 45]

Compound obtained by adjusting the following two compounds at OH value/NCO value=1.0: 100 parts 1. Polyol compound of the following structural formula (A4)

Structural Formula (A4)

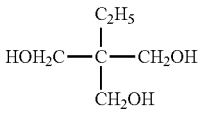

2. Isocyanate compound (TAKENATE (registered trademark) D140N, manufactured by Mitsui Takeda Chemicals Inc.)

Ga-doped zinc oxide fine particles 1 modified with N-phenyl-3-aminopropyltrimethoxysilane (volume resistivity $9\times10^{1}$ Ω·cm) in Production Example 1: 100 parts Compound represented by the general formula (1) (exemplary compound No. 17): 5 parts Methyl ethyl ketone: 1,701 parts Cyclohexanone: 189 parts Example 46

An electrophotographic photoconductor was made as in Example 4 except that the surface layer coating liquid 1 used in Example 4 was changed to the following surface layer coating liquid 46.

[Surface Layer Coating Liquid 46]

Compound obtained by adjusting the following two compounds at OH value/NCO value=1.0: 100 parts 1. Polyol compound of the following structural formula (A4)

Structural Formula (A4)

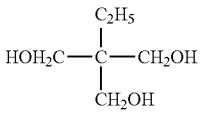

2. Isocyanate compound (TAKENATE (registered trademark) D140N, manufactured by Mitsui Takeda Chemicals Inc.)

Ga-doped zinc oxide fine particles 1 modified with N-phenyl-3-aminopropyltrimethoxysilane (volume resistivity $9\times10^{1}$ Ω·cm) in Production Example 1: 100 parts Compound represented by the general formula (1) (exemplary compound No. 17): 10 parts Methyl ethyl ketone: 1,741.5 parts Cyclohexanone: 193.5 parts Example 47

An electrophotographic photoconductor was made as in Example 7 except that the surface layer coating liquid 1 used in Example 7 was changed to the following surface layer coating liquid 47.

[Surface Layer Coating Liquid 47]

Bisphenol Z polycarbonate (Panlite (registered trademark) TS-2050, manufactured by Teijin Chemicals Ltd.): 100 parts Ga-doped zinc oxide fine particles 1 modified with N-phenyl-3-aminopropyltrimethoxysilane (volume resistivity $9\times10^{1}$ Ω·cm) in Production Example 1: 100 parts Compound represented by the general formula (1) (exemplary compound No. 17): 5 parts Tetrahydrofuran: 5,670 parts Example 48

An electrophotographic photoconductor was made as in Example 7 except that the surface layer coating liquid 1 used in Example 7 was changed to the following surface layer coating liquid 48.

[Surface Layer Coating Liquid 48]

Bisphenol Z polycarbonate (Panlite (registered trademark) TS-2050, manufactured by Teijin Chemicals Ltd.): 100 parts Ga-doped zinc oxide fine particles 1 modified with N-phenyl-3-aminopropyltrimethoxysilane (volume resistivity $9\times10^{1}$ Ω·cm) in Production Example 1: 100 parts Compound represented by the general formula (1) (exemplary compound No. 17): 10 parts Tetrahydrofuran: 5,805 parts Example 49

An electrophotographic photoconductor was made as in Example 1 except that the surface layer coating liquid 1 used in Example 1 was changed to the following surface layer coating liquid 49.

[Surface Layer Coating Liquid 49]

Trimethylolpropane triacrylate (TMPTA, manufactured by TOKYO CHEMICAL INDUSTRY CO., LTD.): 100 parts Ga-doped zinc oxide fine particles 1 modified with N-phenyl-3-aminopropyltrimethoxysilane (volume resistivity $9\times10^{1}$ Ω·cm) in Production Example 1: 100 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 2): 10 parts Methyl ethyl ketone: 1,741.5 parts Cyclohexanone: 193.5 parts Example 50

An electrophotographic photoconductor was made as in Example 1 except that the surface layer coating liquid 1 used in Example 1 was changed to the following surface layer coating liquid 50.

[Surface Layer Coating Liquid 50]

Trimethylolpropane triacrylate (TMPTA, manufactured by TOKYO CHEMICAL INDUSTRY CO., LTD.): 100 parts Ga-doped zinc oxide fine particles 1 modified with N-phenyl-3-aminopropyltrimethoxysilane (volume resistivity $9\times10^{1}$ Ω·cm) in Production Example 1: 100 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 4): 10 parts Methyl ethyl ketone: 1,741.5 parts Cyclohexanone: 193.5 parts Example 51

An electrophotographic photoconductor was made as in Example 1 except that the surface layer coating liquid 1 used in Example 1 was changed to the following surface layer coating liquid 51.

[Surface Layer Coating Liquid 51]

Trimethylolpropane triacrylate (TMPTA, manufactured by TOKYO CHEMICAL INDUSTRY CO., LTD.): 100 parts Zinc oxide fine particles modified with N-phenyl-3-aminopropyltrimethoxysilane (volume resistivity $3\times10^4$ Ω·cm) in Production Example 2: 100 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 17): 10 parts Methyl ethyl ketone: 1,741.5 parts Cyclohexanone: 193.5 parts Example 52

An electrophotographic photoconductor was made as in Example 1 except that the surface layer coating liquid 1 used in Example 1 was changed to the following surface layer coating liquid 52.

[Surface Layer Coating Liquid 52]

Trimethylolpropane triacrylate (TMPTA, manufactured by TOKYO CHEMICAL INDUSTRY CO., LTD.): 100 parts Titanium oxide fine particles modified with N-phenyl-3-aminopropyltrimethoxysilane (volume resistivity $5\times10^1$ Ω·cm) in Production Example 3: 50 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 4): 5 parts Methyl ethyl ketone: 1,295.3 parts Cyclohexanone: 143.9 parts Example 53

An electrophotographic photoconductor was made as in Example 1 except that the surface layer coating liquid 1 used in Example 1 was changed to the following surface layer coating liquid 53.

[Surface Layer Coating Liquid 53]

Trimethylolpropane triacrylate (TMPTA, manufactured by TOKYO CHEMICAL INDUSTRY CO., LTD.): 100 parts Titanium oxide fine particles 2 modified with N-phenyl-3-aminopropyltrimethoxysilane (volume resistivity $7\times10^6$ Ω·cm) in Production Example 13: 100 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 4): 10 parts Methyl ethyl ketone: 1,741.5 parts Cyclohexanone: 193.5 parts Example 54

An electrophotographic photoconductor was made as in Example 1 except that the surface layer coating liquid 1 used in Example 1 was changed to the following surface layer coating liquid 54.

[Surface Layer Coating Liquid 54]

Trimethylolpropane triacrylate (TMPTA, manufactured by TOKYO CHEMICAL INDUSTRY CO., LTD.): 100 parts Tin oxide fine particles modified with N-phenyl-3-aminopropyltrimethoxysilane (volume resistivity $2\times10^2$ Ω·cm) in Production Example 4: 100 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 4): 10 parts Methyl ethyl ketone: 1,741.5 parts Cyclohexanone: 193.5 parts Example 55

An electrophotographic photoconductor was made as in Example 1 except that the surface layer coating liquid 1 used in Example 1 was changed to the following surface layer coating liquid 55.

[Surface Layer Coating Liquid 55]

Trimethylolpropane triacrylate (TMPTA, manufactured by TOKYO CHEMICAL INDUSTRY CO., LTD.): 100 parts Tin oxide fine particles modified with N-phenyl-3-aminopropyltrimethoxysilane (volume resistivity $7\times10^7$ Ω·cm) in Production Example 5: 100 parts Photopolymerization initiator (1-hydroxy-cyclohexyl-phenyl-ketone, IRGACURE 184, manufactured by Ciba Specialty Chemicals): 5 parts Compound represented by the general formula (1) (exemplary compound No. 4): 10 parts Methyl ethyl ketone: 1,741.5 parts Cyclohexanone: 193.5 parts Example 56

An electrophotographic photoconductor was made as in Example 44 except that the Ga-doped zinc oxide fine particles 1 used in the surface layer coating liquid in Example 44 were changed to the Ga-doped zinc oxide fine particles 2 (volume resistivity $5.8\times10^4$ Ω·cm) in Production Example 14.

Example 57

An electrophotographic photoconductor was made as in Example 44 except that the Ga-doped zinc oxide fine particles 1 used in the surface layer coating liquid in Example 46 were changed to the Ga-doped zinc oxide fine particles 2 (volume resistivity $5.8\times10^4$ Ω·cm) in Production Example 14.

Example 58

An electrophotographic photoconductor was made as in Example 48 except that the Ga-doped zinc oxide fine particles 1 used in the surface layer coating liquid in Example 48 were changed to the Ga-doped zinc oxide fine particles 2 (volume resistivity $5.8\times10^4$ Ω·cm) in Production Example 14.

Examples 59 to 64

Electrophotographic photoconductors were made as in Examples 43 to 48 except that the compound represented by general formula (1) used in the surface layer coating liquids in Examples 43 to 48 was changed to the following compound.

Compound represented by the general formula (2) (exemplary compound No. 2-1)

Example 65

An electrophotographic photoconductor was made as in Example 44 except that the compound represented by general formula (1) used in the surface layer coating liquid in Example 44 was changed to the following compound.

Compound represented by the general formula (3) (exemplary compound No. 3-1)

Examples 66

An electrophotographic photoconductor was made as in Example 44 except that the compound represented by general formula (1) used in the surface layer coating liquid in Example 44 was changed to the following compound.

Compound represented by the general formula (4) (exemplary compound No. 4-1)

Examples 67

An electrophotographic photoconductor was made as in Example 44 except that the compound represented by general formula (1) used in the surface layer coating liquid in Example 44 was changed to the following compound.

Compound represented by the general formula (5) (exemplary compound No. 5-1)

Examples 68 to 75

Electrophotographic photoconductors were made as in Examples 51 to 58 except that the compound represented by general formula (1) used in the surface layer coating liquids in Examples 51 to 58 was changed to the following compound.

Compound represented by the general formula (2) (exemplary compound No. 2-1)

Examples 76 to 81

Electrophotographic photoconductors were made as in Examples 43 to 48 except that the compound represented by general formula (1) used in the surface layer coating liquids in Examples 43 to 48 was changed to the following compound.

Compound represented by the general formula (6) (exemplary compound No. 6-1)

Examples 82

An electrophotographic photoconductor was made as in Example 44 except that the compound represented by general formula (1) used in the surface layer coating liquid in Example 44 was changed to the following compound.

Compound represented by the general formula (7) (exemplary compound No. 7-1)

Examples 83 to 90

Electrophotographic photoconductors were made as in Examples 51 to 58 except that the compound represented by general formula (1) used in the surface layer coating liquids in Examples 51 to 58 was changed to the following compound.

Compound represented by the general formula (6) (exemplary compound No. 6-1)

Comparative Example 1

An electrophotographic photoconductor was made as in Example 1 except that the surface layer coating liquid 1 used in Example 1 was changed to the following surface layer coating liquid 56.

[Surface Layer Coating Liquid 56]

Trimethylolpropane triacrylate: 100 parts (TMPTA, manufactured by TOKYO CHEMICAL INDUSTRY CO., LTD.)

Charge transport agent (N,N-diphenyl-N,N-bis(3-methylphenyl)-[1,1']biphenyl-4,4'-diamine): 67 parts Silica fine particles modified with N-phenyl-3-aminopropyltrimethoxysilane (volume resistivity $4.0\times10^{12}$ Ω·cm) in Production Example 8: 5 parts Ethylene tetrafluoride resin particles: 10 parts (AD911L, average particle diameter 0.25 μm, manufactured by Asahi Glass Co., Ltd.)

Alkyl fluoride group-containing methacrylic copolymer: 0.25 parts (weight average molecular weight 30,000)

Photopolymerization initiator (1-hydroxy-cyclohexyl-phenyl-ketone, IRGACURE (registered trademark) 184, manufactured by Ciba Specialty Chemicals): 5 parts Antioxidant (2,6-di-t-butyl-4-methylphenol, manufactured by TOKYO CHEMICAL INDUSTRY CO., LTD.): 1.6 parts Tetrahydrofuran: 1,486 parts Toluene: 200 parts Comparative Example 2

An electrophotographic photoconductor was made as in Example 1 except that the surface layer coating liquid 1 used in Example 1 was changed to the following surface layer coating liquid 57.

[Surface Layer Coating Liquid 57]

Trimethylolpropane triacrylate: 100 parts (TMPTA, manufactured by TOKYO CHEMICAL INDUSTRY CO., LTD.)

Silica fine particles modified with N-phenyl-3-aminopropyltrimethoxysilane (volume resistivity $4.0\times10^{12}$ Ω·cm) in Production Example 8: 5 parts Ethylene tetrafluoride resin particles: 10 parts (AD911L, average particle diameter 0.25 μm, manufactured by Asahi Glass Co., Ltd.)

Alkyl fluoride group-containing methacrylic copolymer: 0.25 parts (weight average molecular weight 30,000)

Photopolymerization initiator (1-hydroxy-cyclohexyl-phenyl-ketone, IRGACURE (registered trademark) 184, manufactured by Ciba Specialty Chemicals): 5 parts Antioxidant (2,6-di-t-butyl-4-methylphenol, manufactured by TOKYO CHEMICAL INDUSTRY CO., LTD.): 1.6 parts Tetrahydrofuran: 880 parts Toluene: 200 parts Comparative Example 3

An electrophotographic photoconductor was made as in Example 1 except that the surface layer coating liquid 1 used in Example 1 was changed to the following surface layer coating liquid 58.

[Surface Layer Coating Liquid 58]

Trimethylolpropane triacrylate: 100 parts (TMPTA, manufactured by TOKYO CHEMICAL INDUSTRY CO., LTD.)

Ga-doped zinc oxide fine particles 1 (volume resistivity $2.4\times10^{1}$ Ω·cm): 100 parts (Pazet GK-40, primary particle average particle diameter 32 nm, manufactured by HakusuiTech Co., Ltd.)

Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Comparative Example 4

An electrophotographic photoconductor was made as in Example 1 except that the surface layer coating liquid 1 used in Example 1 was changed to the following surface layer coating liquid 59.

[Surface Layer Coating Liquid 59]

Trimethylolpropane triacrylate: 100 parts (TMPTA, manufactured by TOKYO CHEMICAL INDUSTRY CO., LTD.)

Ga-doped zinc oxide fine particles 1 (volume resistivity $2.4\times10^{1}$ Ω·cm): 100 parts (Pazet GK-40, primary particle average particle diameter 32 nm, manufactured by HakusuiTech Co., Ltd.)

Photopolymerization initiator (1-hydroxy-cyclohexyl-phenyl-ketone, IRGACURE (registered trademark) 184, manufactured by Ciba Specialty Chemicals): 5 parts Antioxidant (2,6-di-t-butyl-4-methylphenol, manufactured by TOKYO CHEMICAL INDUSTRY CO., LTD.): 1.7 parts Methyl ethyl ketone: 1,845 parts Comparative Example 5

An electrophotographic photoconductor was made as in Example 4 except that the surface layer coating liquid 1 used in Example 4 was changed to the following surface layer coating liquid 60.

[Surface Layer Coating Liquid 60]

Bisphenol Z polycarbonate: 100 parts (Panlite (registered trademark) TS-2050, manufactured by Teijin Chemicals Ltd.)

Ga-doped zinc oxide fine particles 1 (volume resistivity $2.4\times10^{1}$ Ω·cm): 100 parts (Pazet GK-40, primary particle average particle diameter 32 nm, manufactured by HakusuiTech Co., Ltd.)

Antioxidant (2,6-di-t-butyl-4-methylphenol, manufactured by TOKYO CHEMICAL INDUSTRY CO., LTD.): 1.7 parts Tetrahydrofuran: 4,612 parts Comparative Example 6

An electrophotographic photoconductor was made as in Example 1 except that the surface layer coating liquid 1 used in Example 1 was changed to the following surface layer coating liquid 61.

[Surface Layer Coating Liquid 61]

Trimethylolpropane triacrylate: 100 parts (TMPTA, manufactured by TOKYO CHEMICAL INDUSTRY CO., LTD.)

Ga-doped zinc oxide fine particles modified with 3-methacryloxypropyltrimethoxysilane (volume resistivity $8.0\times10^{1}$ Ω·cm) in Production Example 9: 100 parts Photopolymerization initiator (1-hydroxy-cyclohexyl-phenyl-ketone, IRGACURE 184, manufactured by Ciba Specialty Chemicals): 5 parts Methyl ethyl ketone: 1,845 parts Comparative Example 7

An electrophotographic photoconductor was made as in Example 1 except that the surface layer coating liquid 1 used in Example 1 was changed to the following surface layer coating liquid 62.

[Surface Layer Coating Liquid 62]

Trimethylolpropane triacrylate: 100 parts (TMPTA, manufactured by TOKYO CHEMICAL INDUSTRY CO., LTD.)

Ga-doped zinc oxide fine particles modified with 4-[2-(triethoxysilyl)ethyl]triphenylamine (volume resistivity $5.0\times10^{1}$ Ω·cm) in Production Example 10: 100 parts Photopolymerization initiator (1-hydroxy-cyclohexyl-phenyl-ketone, IRGACURE 184, manufactured by Ciba Specialty Chemicals): 5 parts Methyl ethyl ketone: 1,845 parts Comparative Example 8

An electrophotographic photoconductor was made as in Example 1 except that the surface layer coating liquid 1 used in Example 1 was changed to the following surface layer coating liquid 63.

[Surface Layer Coating Liquid 63]

Trimethylolpropane triacrylate: 100 parts (TMPTA, manufactured by TOKYO CHEMICAL INDUSTRY CO., LTD.)

Ga-doped zinc oxide fine particles (inorganic fine particles A, volume resistivity $3.2\times10^{4}$ Ω·cm): 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Comparative Example 9

An electrophotographic photoconductor was made as in Example 1 except that the surface layer coating liquid 1 used in Example 1 was changed to the following surface layer coating liquid 64.

[Surface Layer Coating Liquid 64]

Trimethylolpropane triacrylate: 100 parts (TMPTA, manufactured by TOKYO CHEMICAL INDUSTRY CO., LTD.)

Ga-doped zinc oxide fine particles (inorganic fine particles A, volume resistivity $3.2\times10^{4}$ Ω·cm): 100 parts Photopolymerization initiator (1-hydroxy-cyclohexyl-phenyl-ketone, IRGACURE (registered trademark) 184, manufactured by Ciba Specialty Chemicals): 5 parts Antioxidant (2,6-di-t-butyl-4-methylphenol, manufactured by TOKYO CHEMICAL INDUSTRY CO., LTD.): 1.7 parts Methyl ethyl ketone: 1,845 parts Comparative Example 10

An electrophotographic photoconductor was made as in Example 1 except that the surface layer coating liquid 1 used in Example 1 was changed to the following surface layer coating liquid 65.

[Surface Layer Coating Liquid 65]

Trimethylolpropane triacrylate: 100 parts (TMPTA, manufactured by TOKYO CHEMICAL INDUSTRY CO., LTD.)

Ga-doped zinc oxide fine particles 2 modified with 3-methacryloxypropyltrimethoxysilane (volume resistivity $6.9\times10^{4}$ Ω·cm) in Production Example 17: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts Comparative Example 11

An electrophotographic photoconductor was made as in Example 1 except that the surface layer coating liquid 1 used in Example 1 was changed to the following surface layer coating liquid 66.

[Surface Layer Coating Liquid 66]

Trimethylolpropane triacrylate: 100 parts (TMPTA, manufactured by TOKYO CHEMICAL INDUSTRY CO., LTD.)

Ga-doped zinc oxide fine particles 2 modified with 4-[2-(triethoxysilyl)ethyl]triphenylamine (volume resistivity $1.3\times10^4$ Ω·cm) in Production Example 18: 100 parts Photopolymerization initiator (1-hydroxy-cyclohexyl-phenyl-ketone, IRGACURE 184, manufactured by Ciba Specialty Chemicals): 5 parts Methyl ethyl ketone: 1,845 parts Comparative Example 12

An electrophotographic photoconductor was made as in Example 1 except that the surface layer coating liquid 1 used in Example 1 was changed to the following surface layer coating liquid 67.

[Surface Layer Coating Liquid 67]

Trimethylolpropane triacrylate: 100 parts (TMPTA, manufactured by TOKYO CHEMICAL INDUSTRY CO., LTD.)

Silica fine particles modified with N-phenyl-3-aminopropyltrimethoxysilane (volume resistivity $3.0\times10^9$ Ω·cm) in Production Example 11: 100 parts Photopolymerization initiator (1-hydroxy-cyclohexyl-phenyl-ketone, IRGACURE 184, manufactured by Ciba Specialty Chemicals): 5 parts Methyl ethyl ketone: 1,845 parts Comparative Example 13

An electrophotographic photoconductor was made as in Example 1 except that the surface layer coating liquid 1 used in Example 1 was changed to the following surface layer coating liquid 68.

[Surface Layer Coating Liquid 68]

Trimethylolpropane triacrylate: 100 parts (TMPTA, manufactured by TOKYO CHEMICAL INDUSTRY CO., LTD.)

Tin oxide fine particles modified with a compound A-1 (volume resistivity $2.0\times10^2$ Ω·cm) in Production Example 12: 100 parts Photopolymerization initiator (1-hydroxy-cyclohexyl-phenyl-ketone, IRGACURE (registered trademark) 184, manufactured by Ciba Specialty Chemicals): 5 parts Methyl ethyl ketone: 1,845 parts <Properties of Electrophotographic Photoconductors>

The electrophotographic photoconductors made in the Examples and the Comparative Examples are collectively shown in Table 1-1 to Table 1-6.

TABLE 1-1

| | | First inorganic fine particles | | | | | |
|---|---|---|---|---|---|---|---|
| | Resin having no charge transport properties | Type | Presence or absence of surface-modifying compound | Surface-modifying functional group | Volume resistivity (Ω · cm) | Primary particle average particle diameter (nm) | Si content (% by mass) |
| Example 1 | Acrylic resin | Ga-doped ZnO 1 | Present | Secondary amino group | $9.2\times10^1$ | 32 | 1.27 |
| Example 2 | Acrylic resin | Ga-doped ZnO 1 | Present | Secondary amino group | $9.2\times10^1$ | 32 | 1.27 |
| Example 3 | Acrylic resin | Ga-doped ZnO 1 | Present | Secondary amino group | $9.2\times10^1$ | 32 | 1.27 |
| Example 4 | Urethane resin | Ga-doped ZnO 1 | Present | Secondary amino group | $9.2\times10^1$ | 32 | 1.27 |
| Example 5 | Urethane resin | Ga-doped ZnO 1 | Present | Secondary amino group | $9.2\times10^1$ | 32 | 1.27 |
| Example 6 | Urethane resin | Ga-doped ZnO 1 | Present | Secondary amino group | $9.2\times10^1$ | 32 | 1.27 |
| Example 7 | Polycarbonate resin | Ga-doped ZnO 1 | Present | Secondary amino group | $9.2\times10^1$ | 32 | 1.27 |
| Example 8 | Polycarbonate resin | Ga-doped ZnO 1 | Present | Secondary amino group | $9.2\times10^1$ | 32 | 1.27 |
| Example 9 | Polycarbonate resin | Ga-doped ZnO 1 | Present | Secondary amino group | $9.2\times10^1$ | 32 | 1.27 |
| Example 10 | Acrylic resin | ZnO | Present | Secondary amino group | $3.0\times10^4$ | 28 | — |
| Example 11 | Acrylic resin | $TiO_2$ | Present | Secondary amino group | $5.0\times10^1$ | 40 | — |
| Example 12 | Acrylic resin | $TiO_2$ | Present | Secondary amino group | $7.4\times10^6$ | 70 | — |
| Example 13 | Acrylic resin | $SnO_2$ | Present | Secondary amino group | $2.0\times10^2$ | 30 | — |
| Example 14 | Acrylic resin | $SnO_2$ | Present | Secondary amino group | $7.0\times10^7$ | 43 | 1.27 |
| Example 15 | Acrylic resin | Ga-doped ZnO 1 | Present | Secondary amino group | $7.2\times10^1$ | 32 | 1.27 |
| Example 16 | Acrylic resin | Ga-doped ZnO 1 | Present | Primary amino group | $8.4\times10^1$ | 32 | 1.27 |
| Example 17 | Acrylic resin | Ga-doped ZnO 2 | Present | Secondary amino group | $5.8\times10^4$ | 31 | 3.71 |
| Example 18 | Acrylic resin | Ga-doped ZnO 2 | Present | Secondary amino group | $5.8\times10^4$ | 31 | 3.71 |
| Example 19 | Acrylic resin | Ga-doped ZnO 2 | Present | Secondary amino group | $5.8\times10^4$ | 31 | 3.71 |
| Example 20 | Urethane resin | Ga-doped ZnO 2 | Present | Secondary amino group | $5.8\times10^4$ | 31 | 3.71 |
| Example 21 | Urethane resin | Ga-doped ZnO 2 | Present | Secondary amino group | $5.8\times10^4$ | 31 | 3.71 |
| Example 22 | Urethane resin | Ga-doped ZnO 2 | Present | Secondary amino group | $5.8\times10^4$ | 31 | 3.71 |
| Example 23 | Polycarbonate resin | Ga-doped ZnO 2 | Present | Secondary amino group | $5.8\times10^4$ | 31 | 3.71 |
| Example 24 | Polycarbonate resin | Ga-doped ZnO 2 | Present | Secondary amino group | $5.8\times10^4$ | 31 | 3.71 |
| Example 25 | Polycarbonate resin | Ga-doped ZnO 2 | Present | Secondary amino group | $5.8\times10^4$ | 31 | 3.71 |
| Example 26 | Acrylic resin | Ga-doped ZnO 2 | Present | Secondary amino group | $5.8\times10^4$ | 31 | 3.71 |
| Example 27 | Acrylic resin | Ga-doped ZnO 2 | Present | Secondary amino group | $3.8\times10^4$ | 31 | 3.71 |
| Example 28 | Acrylic resin | Ga-doped ZnO 2 | Present | Secondary amino group | $7.8\times10^4$ | 31 | 3.71 |
| Example 29 | Acrylic resin | Ga-doped ZnO 2 | Present | Secondary amino group | $5.8\times10^4$ | 31 | 3.71 |
| Example 30 | Acrylic resin | Ga-doped ZnO 2 | Present | Secondary amino group | $5.8\times10^4$ | 31 | 3.71 |
| Example 31 | Polycarbonate resin | Ga-doped ZnO 2 | Present | Secondary amino group | $5.8\times10^4$ | 31 | 3.71 |
| Example 32 | Polycarbonate resin | Ga-doped ZnO 2 | Present | Secondary amino group | $5.8\times10^4$ | 31 | 3.71 |
| Example 33 | Polycarbonate resin | Ga-doped ZnO 2 | Present | Secondary amino group | $5.8\times10^4$ | 31 | 3.71 |
| Example 34 | Acrylic resin | Ga-doped ZnO 1 | Present | Secondary amino group | $9.2\times10^1$ | 32 | 1.27 |

TABLE 1-1-continued

| | Resin having no charge transport properties | First inorganic fine particles | | | | | |
|---|---|---|---|---|---|---|---|
| | | Type | Presence or absence of surface-modifying compound | Surface-modifying functional group | Volume resistivity (Ω · cm) | Primary particle average particle diameter (nm) | Si content (% by mass) |
| Example 35 | Acrylic resin | Ga-doped ZnO 1 | Present | Secondary amino group | $9.2 \times 10^1$ | 32 | 1.27 |
| Example 36 | Acrylic resin | Ga-doped ZnO 2 | Present | Secondary amino group | $8.4 \times 10^1$ | 32 | 3.71 |
| Example 37 | Acrylic resin | Ga-doped ZnO 2 | Present | Secondary amino group | $5.8 \times 10^4$ | 31 | 3.71 |
| Example 38 | Acrylic resin | Ga-doped ZnO 2 | Present | Secondary amino group | $5.8 \times 10^4$ | 31 | 3.71 |
| Example 39 | Urethane resin | Ga-doped ZnO 2 | Present | Secondary amino group | $5.8 \times 10^4$ | 31 | 3.71 |
| Example 40 | Urethane resin | Ga-doped ZnO 2 | Present | Secondary amino group | $5.8 \times 10^4$ | 31 | 3.71 |
| Example 41 | Polycarbonate resin | Ga-doped ZnO 2 | Present | Secondary amino group | $5.8 \times 10^4$ | 31 | 3.71 |
| Example 42 | Polycarbonate resin | Ga-doped ZnO 2 | Present | Secondary amino group | $5.8 \times 10^4$ | 31 | 3.71 |
| Example 43 | Acrylic resin | Ga-doped ZnO 1 | Present | Secondary amino group | $9.2 \times 10^1$ | 32 | 1.27 |
| Example 44 | Acrylic resin | Ga-doped ZnO 1 | Present | Secondary amino group | $9.2 \times 10^1$ | 32 | 1.27 |
| Example 45 | Urethane resin | Ga-doped ZnO 1 | Present | Secondary amino group | $9.2 \times 10^1$ | 32 | 1.27 |

* The Si content of the inorganic fine particles used for the Ga-doped zinc oxide fine particles 1 (Ga-doped ZnO 1) is 0.8% by mass, and the Si content of the inorganic fine particles used for the Ga-doped zinc oxide fine particles 2 (Ga-doped ZnO 2) is 3.2% by mass.

TABLE 1-2

| | Compound represented by any of general formulas (1) to (7) | Second inorganic fine particles | | Antioxidant |
|---|---|---|---|---|
| | | Type | Primary particle average particle diameter (nm) | |
| Example 1 | — | — | — | — |
| Example 2 | — | — | — | — |
| Example 3 | — | — | — | — |
| Example 4 | — | — | — | — |
| Example 5 | — | — | — | — |
| Example 6 | — | — | — | — |
| Example 7 | — | — | — | — |
| Example 8 | — | — | — | — |
| Example 9 | — | — | — | — |
| Example 10 | — | — | — | — |
| Example 11 | — | — | — | — |
| Example 12 | — | — | — | — |
| Example 13 | — | — | — | — |
| Example 14 | — | — | — | — |
| Example 15 | — | — | — | — |
| Example 16 | — | — | — | — |
| Example 17 | — | — | — | — |
| Example 18 | — | — | — | — |
| Example 19 | — | — | — | — |
| Example 20 | — | — | — | — |
| Example 21 | — | — | — | — |
| Example 22 | — | — | — | — |
| Example 23 | — | — | — | — |

TABLE 1-2-continued

| | Compound represented by any of general formulas (1) to (7) | Second inorganic fine particles | | Antioxidant |
|---|---|---|---|---|
| | | Type | Primary particle average particle diameter (nm) | |
| Example 24 | — | — | — | — |
| Example 25 | — | — | — | — |
| Example 26 | — | — | — | — |
| Example 27 | — | — | — | — |
| Example 28 | — | — | — | — |
| Example 29 | — | — | — | — |
| Example 30 | — | — | — | — |
| Example 31 | — | — | — | — |
| Example 32 | — | — | — | — |
| Example 33 | — | — | — | — |
| Example 34 | — | $SiO_2$ | 100 | — |
| Example 35 | — | $TiO_2$ | 300 | — |
| Example 36 | — | $TiO_2$ | 300 | — |
| Example 37 | — | Alumina | 500 | — |
| Example 38 | — | Alumina | 300 | — |
| Example 39 | — | Alumina | 300 | — |
| Example 40 | — | Alumina | 300 | — |
| Example 41 | — | Alumina | 300 | — |
| Example 42 | — | Alumina | 300 | — |
| Example 43 | Exemplary compound 17 | — | — | — |
| Example 44 | Exemplary compound 17 | — | — | — |
| Example 45 | Exemplary compound 17 | — | — | — |

TABLE 1-3

| | Resin having no charge transport properties | First inorganic fine particles | | | | | |
|---|---|---|---|---|---|---|---|
| | | Type | Presence or absence of surface-modifying compound | Surface-modifying functional group | Volume resistivity (Ω · cm) | Primary particle average particle diameter (nm) | Si content (% by mass) |
| Example 46 | Urethane resin | Ga-doped ZnO 1 | Present | Secondary amino group | $9.2 \times 10^1$ | 32 | 1.27 |
| Example 47 | Polycarbonate resin | Ga-doped ZnO 1 | Present | Secondary amino group | $9.2 \times 10^1$ | 32 | 1.27 |
| Example 48 | Polycarbonate resin | Ga-doped ZnO 1 | Present | Secondary amino group | $9.2 \times 10^1$ | 32 | 1.27 |
| Example 49 | Acrylic resin | Ga-doped ZnO 1 | Present | Secondary amino group | $9.2 \times 10^1$ | 32 | 1.27 |
| Example 50 | Acrylic resin | Ga-doped ZnO 1 | Present | Secondary amino group | $9.2 \times 10^1$ | 32 | 1.27 |
| Example 51 | Acrylic resin | ZnO | Present | Secondary amino group | $3.0 \times 10^4$ | 28 | — |
| Example 52 | Acrylic resin | $TiO_2$ | Present | Secondary amino group | $5.0 \times 10^1$ | 40 | — |

TABLE 1-3-continued

| | Resin having no charge transport properties | First inorganic fine particles | | | | | |
|---|---|---|---|---|---|---|---|
| | | Type | Presence or absence of surface-modifying compound | Surface-modifying functional group | Volume resistivity (Ω · cm) | Primary particle average particle diameter (nm) | Si content (% by mass) |
| Example 53 | Acrylic resin | $TiO_2$ | Present | Secondary amino group | $7.4 \times 10^6$ | 70 | — |
| Example 54 | Acrylic resin | $SnO_2$ | Present | Secondary amino group | $2.0 \times 10^2$ | 30 | — |
| Example 55 | Acrylic resin | $SnO_2$ | Present | Secondary amino group | $7.0 \times 10^7$ | 43 | — |
| Example 56 | Acrylic resin | Ga-doped ZnO 2 | Present | Secondary amino group | $5.8 \times 10^4$ | 31 | 3.71 |
| Example 57 | Urethane resin | Ga-doped ZnO 2 | Present | Secondary amino group | $5.8 \times 10^4$ | 31 | 3.71 |
| Example 58 | Polycarbonate resin | Ga-doped ZnO 2 | Present | Secondary amino group | $5.8 \times 10^4$ | 31 | 3.71 |
| Example 59 | Acrylic resin | Ga-doped ZnO 1 | Present | Secondary amino group | $9.2 \times 10^1$ | 32 | 1.27 |
| Example 60 | Acrylic resin | Ga-doped ZnO 1 | Present | Secondary amino group | $9.2 \times 10^1$ | 32 | 1.27 |
| Example 61 | Urethane resin | Ga-doped ZnO 1 | Present | Secondary amino group | $9.2 \times 10^1$ | 32 | 1.27 |
| Example 62 | Urethane resin | Ga-doped ZnO 1 | Present | Secondary amino group | $9.2 \times 10^1$ | 32 | 1.27 |
| Example 63 | Polycarbonate resin | Ga-doped ZnO 1 | Present | Secondary amino group | $9.2 \times 10^1$ | 32 | 1.27 |
| Example 64 | Polycarbonate resin | Ga-doped ZnO 1 | Present | Secondary amino group | $9.2 \times 10^1$ | 32 | 1.27 |
| Example 65 | Acrylic resin | Ga-doped ZnO 1 | Present | Secondary amino group | $9.2 \times 10^1$ | 32 | 12.7 |
| Example 66 | Acrylic resin | Ga-doped ZnO 1 | Present | Secondary amino group | $9.2 \times 10^1$ | 32 | 1.27 |
| Example 67 | Acrylic resin | Ga-doped ZnO 1 | Present | Secondary amino group | $9.2 \times 10^1$ | 32 | 1.27 |
| Example 68 | Acrylic resin | ZnO | Present | Secondary amino group | $3.0 \times 10^4$ | 28 | — |
| Example 69 | Acrylic resin | $TiO_2$ | Present | Secondary amino group | $5.0 \times 10^1$ | 40 | — |
| Example 70 | Acrylic resin | $TiO_2$ | Present | Secondary amino group | $7.4 \times 10^6$ | 70 | — |
| Example 71 | Acrylic resin | $SnO_2$ | Present | Secondary amino group | $2.0 \times 10^2$ | 30 | — |
| Example 72 | Acrylic resin | $SnO_2$ | Present | Secondary amino group | $7.0 \times 10^7$ | 43 | — |
| Example 73 | Acrylic resin | Ga-doped ZnO 2 | Present | Secondary amino group | $5.8 \times 10^4$ | 31 | 3.71 |
| Example 74 | Urethane resin | Ga-doped ZnO 2 | Present | Secondary amino group | $5.8 \times 10^4$ | 31 | 3.71 |
| Example 75 | Polycarbonate resin | Ga-doped ZnO 2 | Present | Secondary amino group | $5.8 \times 10^4$ | 31 | 3.71 |
| Example 76 | Acrylic resin | Ga-doped ZnO 1 | Present | Secondary amino group | $9.2 \times 10^1$ | 32 | 1.27 |
| Example 77 | Acrylic resin | Ga-doped ZnO 1 | Present | Secondary amino group | $9.2 \times 10^1$ | 32 | 1.27 |
| Example 78 | Urethane resin | Ga-doped ZnO 1 | Present | Secondary amino group | $9.2 \times 10^1$ | 32 | 1.27 |
| Example 79 | Urethane resin | Ga-doped ZnO 1 | Present | Secondary amino group | $9.2 \times 10^1$ | 32 | 1.27 |
| Example 80 | Polycarbonate resin | Ga-doped ZnO 1 | Present | Secondary amino group | $9.2 \times 10^1$ | 32 | 1.27 |
| Example 81 | Polycarbonate resin | Ga-doped ZnO 1 | Present | Secondary amino group | $9.2 \times 10^1$ | 32 | 1.27 |
| Example 82 | Acrylic resin | Ga-doped ZnO 1 | Present | Secondary amino group | $9.2 \times 10^1$ | 32 | 1.27 |
| Example 83 | Acrylic resin | ZnO | Present | Secondary amino group | $3.0 \times 10^4$ | 28 | — |
| Example 84 | Acrylic resin | $TiO_2$ | Present | Secondary amino group | $5.0 \times 10^1$ | 40 | — |
| Example 85 | Acrylic resin | $TiO_2$ | Present | Secondary amino group | $7.4 \times 10^6$ | 70 | — |
| Example 86 | Acrylic resin | $SnO_2$ | Present | Secondary amino group | $2.0 \times 10^2$ | 30 | — |
| Example 87 | Acrylic resin | $SnO_2$ | Present | Secondary amino group | $7.0 \times 10^7$ | 43 | — |
| Example 88 | Acrylic resin | Ga-doped ZnO 2 | Present | Secondary amino group | $5.8 \times 10^4$ | 31 | 3.71 |
| Example 89 | Urethane resin | Ga-doped ZnO 2 | Present | Secondary amino group | $5.8 \times 10^4$ | 31 | 3.71 |
| Example 90 | Polycarbonate resin | Ga-doped ZnO 2 | Present | Secondary amino group | $5.8 \times 10^4$ | 31 | 3.71 |

* The Si content of the inorganic fine particles used for the Ga-doped zinc oxide fine particles 1 (Ga-doped ZnO 1) is 0.8% by mass, and the Si content of the inorganic fine particles used for the Ga-doped zinc oxide fine particles 2 (Ga-doped ZnO 2) is 3.2% by mass.

TABLE 1-4

| | Compound represented by any of general formulas (1) to (7) | Second inorganic fine particles | | An-tioxidant |
|---|---|---|---|---|
| | | Type | Primary particle average particle diameter (nm) | |
| Example 46 | Exemplary compound 17 | — | — | — |
| Example 47 | Exemplary compound 17 | — | — | — |
| Example 48 | Exemplary compound 17 | — | — | — |
| Example 49 | Exemplary compound 2 | — | — | — |
| Example 50 | Exemplary compound 4 | — | — | — |
| Example 51 | Exemplary compound 17 | — | — | — |
| Example 52 | Exemplary compound 17 | — | — | — |
| Example 53 | Exemplary compound 17 | — | — | — |
| Example 54 | Exemplary compound 17 | — | — | — |
| Example 55 | Exemplary compound 17 | — | — | — |
| Example 56 | Exemplary compound 17 | — | — | — |
| Example 57 | Exemplary compound 17 | — | — | — |
| Example 58 | Exemplary compound 17 | — | — | — |
| Example 59 | Exemplary compound 2-1 | — | — | — |
| Example 60 | Exemplary compound 2-1 | — | — | — |
| Example 61 | Exemplary compound 2-1 | — | — | — |

TABLE 1-4-continued

| | Compound represented by any of general formulas (1) to (7) | Second inorganic fine particles | | An-tioxidant |
|---|---|---|---|---|
| | | Type | Primary particle average particle diameter (nm) | |
| Example 62 | Exemplary compound 2-1 | — | — | — |
| Example 63 | Exemplary compound 2-1 | — | — | — |
| Example 64 | Exemplary compound 2-1 | — | — | — |
| Example 65 | Exemplary compound 3-1 | — | — | — |
| Example 66 | Exemplary compound 4-1 | — | — | — |
| Example 67 | Exemplary compound 5-1 | — | — | — |
| Example 68 | Exemplary compound 2-1 | — | — | — |
| Example 69 | Exemplary compound 2-1 | — | — | — |
| Example 70 | Exemplary compound 2-1 | — | — | — |
| Example 71 | Exemplary compound 2-1 | — | — | — |
| Example 72 | Exemplary compound 2-1 | — | — | — |
| Example 73 | Exemplary compound 2-1 | — | — | — |
| Example 74 | Exemplary compound 2-1 | — | — | — |
| Example 75 | Exemplary compound 2-1 | — | — | — |
| Example 76 | Exemplary compound 6-1 | — | — | — |
| Example 77 | Exemplary compound 6-1 | — | — | — |

TABLE 1-4-continued

| | Compound represented by any of general formulas (1) to (7) | Second inorganic fine particles Type | Primary particle average particle diameter (nm) | Antioxidant |
|---|---|---|---|---|
| Example 78 | Exemplary compound 6-1 | — | — | — |
| Example 79 | Exemplary compound 6-1 | — | — | — |
| Example 80 | Exemplary compound 6-1 | — | — | — |
| Example 81 | Exemplary compound 6-1 | — | — | — |
| Example 82 | Exemplary compound 7-1 | — | — | — |
| Example 83 | Exemplary compound 6-1 | — | — | — |
| Example 84 | Exemplary compound 6-1 | — | — | — |

TABLE 1-4-continued

| | Compound represented by any of general formulas (1) to (7) | Second inorganic fine particles Type | Primary particle average particle diameter (nm) | Antioxidant |
|---|---|---|---|---|
| Example 85 | Exemplary compound 6-1 | — | — | — |
| Example 86 | Exemplary compound 6-1 | — | — | — |
| Example 87 | Exemplary compound 6-1 | — | — | — |
| Example 88 | Exemplary compound 6-1 | — | — | — |
| Example 89 | Exemplary compound 6-1 | — | — | — |
| Example 90 | Exemplary compound 6-1 | — | — | — |

TABLE 1-5

| | Resin having no charge transport properties | First inorganic fine particles Type | Presence or absence of surface-modifying compound | Surface-modifying functional group | Volume resistivity (Ω · cm) | Primary particle average particle diameter (nm) | Si content (% by mass) |
|---|---|---|---|---|---|---|---|
| Comparative Example 1 | Acrylic resin | $SiO_2$ | Present | Secondary amino group | $4.0 \times 10^{12}$ | 16 | — |
| Comparative Example 2 | Acrylic resin | $SiO_2$ | Present | Secondary amino group | $4.0 \times 10^{12}$ | 16 | — |
| Comparative Example 3 | Acrylic resin | Ga-doped ZnO 1 | Absent | — | $2.4 \times 10^{1}$ | 32 | 1.27 |
| Comparative Example 4 | Acrylic resin | Ga-doped ZnO 1 | Absent | — | $2.4 \times 10^{1}$ | 32 | 1.27 |
| Comparative Example 5 | Polycarbonate resin | Ga-doped ZnO 1 | Absent | — | $2.4 \times 10^{1}$ | 32 | 1.27 |
| Comparative Example 6 | Acrylic resin | Ga-doped ZnO 1 | Present | Methacrylic group | $8.0 \times 10^{1}$ | 32 | 1.27 |
| Comparative Example 7 | Acrylic resin | Ga-doped ZnO 1 | Present | (Tertiary amino group) | $5.0 \times 10^{1}$ | 32 | 1.27 |
| Comparative Example 8 | Acrylic resin | Ga-doped ZnO 2 | Absent | — | $3.2 \times 10^{4}$ | 31 | 3.71 |
| Comparative Example 9 | Acrylic resin | Ga-doped ZnO 2 | Absent | — | $3.2 \times 10^{4}$ | 31 | 3.71 |
| Comparative Example 10 | Acrylic resin | Ga-doped ZnO 2 | Present | Methacrylic group | $6.9 \times 10^{4}$ | 31 | 3.71 |
| Comparative Example 11 | Acrylic resin | Ga-doped ZnO 2 | Present | (Tertiary amino group) | $1.3 \times 10^{4}$ | 31 | 3.71 |
| Comparative Example 12 | Acrylic resin | $SiO_2$ | Present | Secondary amino group | $3.0 \times 10^{9}$ | 50 | — |
| Comparative Example 13 | Acrylic resin | $SnO_2$ | Present | Structural formula (1) | $2.0 \times 10^{2}$ | 30 | — |

TABLE 1-6

| | Compound represented by any of general formulas (1) to (7) | Second inorganic fine particles Type | Primary particle average particle diameter (nm) | Antioxidant |
|---|---|---|---|---|
| Comparitive Example 1 | — | — | — | BHT |
| Comparitive Example 2 | — | — | — | BHT |
| Comparitive Example 3 | — | — | — | — |
| Comparitive Example 4 | — | — | — | BHT |
| Comparitive Example 5 | — | — | — | — |
| Comparitive Example 6 | — | — | — | — |
| Comparitive Example 7 | — | — | — | — |
| Comparitive Example 8 | — | — | — | — |
| Comparitive Example 9 | — | — | — | BHT |
| Comparitive Example 10 | — | — | — | — |

TABLE 1-6-continued

| | | Second inorganic fine particles | | |
|---|---|---|---|---|
| | Compound represented by any of general formulas (1) to (7) | Type | Primary particle average particle diameter (nm) | Antioxidant |
| Comparitive Example 11 | — | — | — | — |
| Comparitive Example 12 | — | — | — | — |
| Comparitive Example 13 | — | — | — | — |

* Antioxidant BHT: 2,6-di-t-butyl-4-methylphenol

* The surface layer materials in Comparative Example 1 include an ethylene tetrafluoride resin, an alkyl fluoride group containing methacrylic copolymer, and a charge transport material (N,N'-diphenyl-N,N'-bis(3-methylphenyl)-[1,1']biphenyl-4,4'-diamine).

* The surface layer materials in Comparative Example 2 include an ethylene tetrafluoride resin and an alkyl fluoride group-containing methacrylic copolymer.

* The structural formula (1) of the surface-modifying functional group in Comparative Example 13 is as follows.

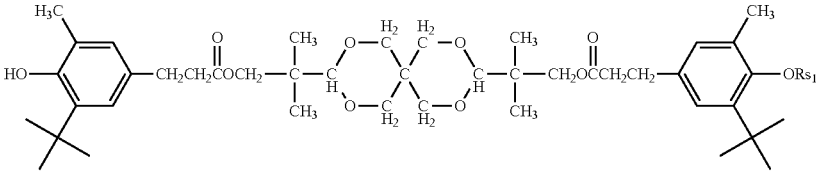

Compound A-1 Structural formula (1)

wherein $Rs_1$ is a functional group represented by $—Si(OCH_3)_3$.

* The Si content of the inorganic fine particles used for the Ga-doped zinc oxide fine particles 1 (Ga-doped ZnO 1) is 0.8% by mass, and the Si content of the inorganic fine particles used for the Ga-doped zinc oxide fine particles 2 (Ga-doped ZnO 2) is 3.2% by mass.

(Evaluations)

For the electrophotographic photoconductors made in the Examples and the Comparative Examples, the following evaluations were carried out.

<Evaluation of Electrical Properties (Exposed Portion Potential)>

The developing unit of imagio Neo 270 (manufactured by Ricoh Company, Ltd.) was disassembled, and a probe connected to a surface potential meter MODEL 344 (manufactured by TREK) was attached to the developing unit. Then, each of the photoconductors in the Examples and the Comparative Examples was mounted. The potential applied to the photoconductor was adjusted in an environment of 23° C. and 55% RH so that the charging potential was −800 V. Then, a black solid image was output, and the exposed portion potential before a paper passing test was measured.

Next, the following abrasion durability evaluation was performed, and then, the potential of the exposed portion after the paper passing test was measured by a similar method using the photoconductors in the Examples and the Comparative Examples. The exposed portion potential before the paper passing and after the paper passing, and the change in exposed portion potential before and after the paper passing are shown. The results are shown in Table 2-1 to Table 2-3.

The smaller the fluctuation in exposed portion potential before and after the actual machine paper passing test is, the better the chemical durability is.

<Evaluation of Abrasion Durability>

In the abrasion durability test, imagio Neo 270 (manufactured by Ricoh Company, Ltd.) was used as an image forming apparatus.

As paper, My Paper (A4 size, manufactured by NBS Ricoh Company, Ltd.) was used. Using the short direction as the feeding direction, 30,000 50%-halftone (black) images were formed in an environment of normal temperature and normal humidity (23° C., 55% RH). Next, 30,000 images were similarly formed in an environment of high temperature and high humidity (28° C., 75% RH). Finally, 30,000 images were similarly formed in an environment of low temperature and low humidity (10° C., 15% RH), and an actual machine paper passing test for a total of 90,000 sheets was performed. The film thickness of the photoconductor before and after the actual machine paper passing test was carried out was measured using an eddy current type film thickness meter FISCHERSCOPE MMS (manufactured by Fischer Instruments K.K.), and the amount of abrasion was obtained. The evaluation was performed according to the following criteria. The results are shown in Table 2-1 to Table 2-3.

[Evaluation Criteria]

A: the amount of abrasion is 1 μm or less

B: the amount of abrasion is larger than 1 μm and 2 μm or less

C: the amount of abrasion is larger than 2 μm and 4 μm or less

D: the amount of abrasion is larger than 4 μM

<Evaluation of Image Quality>

Each of the photoconductors in the Examples and the Comparative Examples was mounted in imagio Neo 270 (manufactured by Ricoh Company, Ltd.). Then, 30,000 images were formed in the environments of the above-described actual machine paper passing test using A4-size paper My Paper (manufactured by NBS Ricoh Company, Ltd.). Then, the Imaging Society of Japan test chart No. 3 was output, and image quality was evaluated according to the following criteria. The results are shown in Table 2-1 to Table 2-3.

[Evaluation Criteria]

A: a level at which the image quality hardly decreases

B: a level at which the image quality decreases slightly, but no problem is seen by visual observation C: a level at which a decrease in image quality is seen even by visual observation D: a level at which there is a serious problem in image quality

TABLE 2-1

| | | Image quality | | | Exposed portion potential (V) | | |
|---|---|---|---|---|---|---|---|
| | Abrasion durability | 23° C./ 55% RH | 10° C./ 15% RH | 28° C./ 75% RH | Before paper passing | After paper passing | Potential change |
| Example 1 | A | A | A | A | 60 | 65 | 5 |
| Example 2 | A | A | A | A | 85 | 95 | 10 |
| Example 3 | A | A | A | A | 55 | 60 | 5 |
| Example 4 | B | A | A | A | 80 | 90 | 10 |
| Example 5 | B | A | A | A | 105 | 120 | 15 |
| Example 6 | B | A | A | A | 70 | 75 | 5 |
| Example 7 | C | A | A | A | 75 | 75 | 0 |
| Example 8 | C | A | A | A | 90 | 105 | 15 |
| Example 9 | C | A | A | A | 65 | 70 | 5 |
| Example 10 | A | A | A | A | 75 | 95 | 20 |
| Example 11 | A | A | A | B | 90 | 135 | 45 |
| Example 12 | A | A | A | B | 130 | 165 | 35 |
| Example 13 | A | A | A | B | 60 | 90 | 30 |
| Example 14 | A | A | A | B | 110 | 145 | 35 |
| Example 15 | A | A | A | B | 65 | 100 | 35 |
| Example 16 | A | A | A | B | 60 | 105 | 45 |
| Example 17 | A | A | A | A | 55 | 55 | 0 |
| Example 18 | A | A | A | A | 70 | 75 | 5 |
| Example 19 | A | A | A | A | 50 | 50 | 0 |
| Example 20 | B | A | A | A | 70 | 70 | 0 |
| Example 21 | B | A | A | A | 95 | 100 | 5 |
| Example 22 | B | A | A | A | 60 | 60 | 0 |
| Example 23 | C | A | A | A | 60 | 60 | 0 |
| Example 24 | C | A | A | A | 80 | 90 | 10 |
| Example 25 | C | A | A | A | 50 | 50 | 0 |
| Example 26 | A | A | A | A | 55 | 85 | 30 |
| Example 27 | A | A | A | A | 55 | 90 | 35 |
| Example 28 | A | A | A | A | 55 | 55 | 0 |
| Example 29 | B | A | A | A | 50 | 55 | 5 |
| Example 30 | C | A | A | A | 50 | 50 | 0 |
| Example 31 | B | A | A | A | 70 | 75 | 5 |
| Example 32 | C | A | A | A | 65 | 70 | 5 |
| Example 33 | C | A | A | A | 60 | 60 | 0 |
| Example 34 | A | A | A | A | 85 | 95 | 10 |
| Example 35 | A | A | A | A | 60 | 65 | 5 |
| Example 36 | A | A | A | B | 65 | 100 | 35 |
| Example 37 | A | A | A | A | 80 | 80 | 0 |
| Example 38 | A | A | A | A | 55 | 55 | 0 |
| Example 39 | A | A | A | A | 75 | 80 | 5 |
| Example 40 | A | A | A | A | 60 | 65 | 5 |
| Example 41 | B | A | A | A | 80 | 85 | 5 |
| Example 42 | B | A | A | A | 55 | 55 | 0 |
| Example 43 | A | A | A | A | 70 | 75 | 5 |
| Example 44 | A | A | A | A | 75 | 75 | 0 |
| Example 45 | B | A | A | A | 85 | 90 | 5 |

TABLE 2-2

| | | Image quality | | | Exposed portion potential (V) | | |
|---|---|---|---|---|---|---|---|
| | Abrasion durability | 23° C./ 55% RH | 10° C./ 15% RH | 28° C./ 75% RH | Before paper passing | After paper passing | Potential change |
| Example 46 | B | A | A | A | 90 | 90 | 0 |
| Example 47 | C | A | A | A | 85 | 90 | 5 |
| Example 48 | C | A | A | A | 90 | 90 | 0 |
| Example 49 | A | A | A | A | 75 | 75 | 0 |
| Example 50 | A | A | A | A | 70 | 75 | 5 |
| Example 51 | A | A | A | A | 85 | 100 | 15 |
| Example 52 | A | A | A | B | 100 | 140 | 40 |
| Example 53 | A | A | A | B | 140 | 165 | 25 |
| Example 54 | A | A | A | B | 70 | 95 | 25 |
| Example 55 | A | A | A | B | 125 | 150 | 25 |
| Example 56 | A | A | A | A | 70 | 70 | 0 |
| Example 57 | B | A | A | A | 75 | 75 | 0 |
| Example 58 | C | A | A | A | 70 | 70 | 0 |
| Example 59 | A | A | A | A | 60 | 65 | 5 |
| Example 60 | A | A | A | A | 65 | 65 | 0 |
| Example 61 | B | A | A | A | 80 | 90 | 10 |
| Example 62 | B | A | A | A | 85 | 90 | 5 |
| Example 63 | C | A | A | A | 75 | 75 | 0 |

TABLE 2-2-continued

| | | Image quality | | | Exposed portion potential (V) | | |
|---|---|---|---|---|---|---|---|
| | Abrasion durability | 23° C./ 55% RH | 10° C./ 15% RH | 28° C./ 75% RH | Before paper passing | After paper passing | Potential change |
| Example 64 | C | A | A | A | 80 | 80 | 0 |
| Example 65 | A | A | A | A | 60 | 65 | 5 |
| Example 66 | A | A | A | A | 70 | 75 | 5 |
| Example 67 | A | A | A | A | 75 | 80 | 5 |
| Example 68 | A | A | A | A | 75 | 95 | 20 |
| Example 69 | A | A | A | B | 90 | 135 | 45 |
| Example 70 | A | A | A | B | 130 | 165 | 35 |
| Example 71 | A | A | A | B | 60 | 90 | 30 |
| Example 72 | A | A | A | B | 110 | 145 | 35 |
| Example 73 | A | A | A | A | 70 | 75 | 5 |
| Example 74 | B | A | A | A | 95 | 100 | 5 |
| Example 75 | C | A | A | A | 80 | 90 | 10 |
| Example 76 | A | A | A | A | 60 | 65 | 5 |
| Example 77 | A | A | A | A | 65 | 65 | 0 |
| Example 78 | B | A | A | A | 80 | 90 | 10 |
| Example 79 | B | A | A | A | 85 | 85 | 0 |
| Example 80 | C | A | A | A | 75 | 75 | 0 |
| Example 81 | C | A | A | A | 80 | 80 | 0 |
| Example 82 | A | A | A | A | 75 | 75 | 0 |
| Example 83 | A | A | A | A | 90 | 110 | 20 |
| Example 84 | A | A | A | B | 95 | 135 | 40 |
| Example 85 | A | A | A | B | 140 | 180 | 40 |
| Example 86 | A | A | A | B | 55 | 80 | 25 |
| Example 87 | A | A | A | B | 100 | 135 | 35 |
| Example 88 | A | A | A | A | 85 | 90 | 5 |
| Example 89 | B | A | A | A | 100 | 105 | 5 |
| Example 90 | C | A | A | A | 90 | 100 | 10 |

TABLE 2-3

| | | Image quality | | | Exposed portion potential (V) | | |
|---|---|---|---|---|---|---|---|
| | Abrasion durability | 23° C./ 55% RH | 10° C./ 15% RH | 28° C./ 75% RH | Before paper passing | After paper passing | Potential change |
| Comparative Example 1 | D | B | C | D | 60 | 100 | 40 |
| Comparative Example 2 | — | — | — | — | 350 | — | — |
| Comparative Example 3 | A | B | C | D | 70 | 180 | 110 |
| Comparative Example 4 | C | B | B | C | 85 | 130 | 45 |
| Comparative Example 5 | D | A | B | C | 80 | 125 | 45 |
| Comparative Example 6 | A | B | C | D | 85 | 200 | 115 |
| Comparative Example 7 | A | A | C | D | 80 | 180 | 100 |
| Comparative Example 8 | A | B | C | D | 70 | 95 | 25 |
| Comparative Example 9 | C | B | B | C | 70 | 90 | 20 |
| Comparative Example 10 | A | B | C | D | 75 | 110 | 35 |
| Comparative Example 11 | A | A | C | D | 75 | 130 | 55 |
| Comparative Example 12 | A | A | C | D | 150 | 180 | 30 |
| Comparative Example 13 | A | A | C | C | 90 | 150 | 60 |

From the results in Table 2-1 to Table 2-3, it is found that in the electrophotographic photoconductors in Examples 1 to 90, the surface layer contains a resin having no charge transport properties, and first inorganic fine particles having a volume resistivity of $1\times10^8$ Ω·cm or less, modified with a compound having either of primary and secondary amino groups, and thus, the durability against mechanical hazards and chemical hazards is high, and the image quality can be maintained.

On the other hand, the electrophotographic photoconductor in Comparative Example 1 contains a charge transport substance and an antioxidant in the surface layer, and therefore, the chemical durability is at a level capable of practical use. But, it is found that although ethylene tetrafluoride resin particles, an alkyl fluoride group-containing methacrylic copolymer, and fine particles having a volume resistivity of higher than $1\times10^8$ Ω·cm, modified with a compound having a secondary amino group are added to the surface layer as fillers, the mechanical durability is low, and the maintenance of image quality is also poor.

In the electrophotographic photoconductor in Comparative Example 2, no charge transport substance was present in the surface layer, unlike Comparative Example 1, and therefore, from the initial stage, the exposed portion potential was high, and an abnormal image was seen. Therefore, the abrasion durability test, and the image quality test in the environments of low temperature and low humidity, and high temperature and high humidity were not carried out.

In the electrophotographic photoconductors in Comparative Examples 4, 5, and 9, the surface layer contains an antioxidant, and therefore, the chemical durability is at a level capable of practical use. It is found that the volume resistivity of the fine particles in the surface layer is $1\times10^8$ Ω·cm or less in all of them, but the fine particles are not covered with a compound having either of primary and secondary amino groups, and therefore, the mechanical durability is poor, and the maintenance of image quality is also poor.

In the electrophotographic photoconductors in Comparative Examples 3, 6, 7, 8, 10, and 11, the surface layer contains no antioxidant or charge transport substance, and therefore, the mechanical durability is sufficient. The volume resistivity of the fine particles in the surface layer is $1\times10^8$ Ω·cm or less in all of them. But, it is found that the surfaces of the fine particles are not modified (Comparative Example 3), modified with a compound having no amino group (Comparative Example 6), and modified with a compound having a tertiary amino group (Comparative Example 7), and therefore, the chemical durability is poor, and the maintenance of image quality is also poor.

The electrophotographic photoconductor in Comparative Example 12 contains no antioxidant or charge transport substance in the surface layer, and therefore, the mechanical durability is sufficient. In addition, the fine particles are modified with a compound having an amino group, and therefore, the fluctuation in exposed portion potential before and after the paper passing is also small. But, it is found that the volume resistivity of the fine particles in the surface layer is as high as $3\times10^9$ Ω·cm, and although there is no problem at 23° C. and 55% RH, image quality cannot be maintained in the 10° C. and 20% RH environment and the 28° C. and 75% RH environment.

The electrophotographic photoconductor in Comparative Example 13 contains no antioxidant or charge transport substance in the surface layer, and therefore, the mechanical durability is sufficient. But, although the fine particles are modified with a material that exhibits the function of an antioxidant, the properties are not sufficient. Therefore, the maintenance of image quality is insufficient, and the fluctuation in exposed portion potential before and after the paper passing is also large.

Next, for Examples 1 to 3, Examples 15 to 19, Example 27, Example 28, Examples 34 to 40, Example 43, Example 49, Example 50, Example 56, Example 59, Examples 65 to 67, Example 73, Example 76, Example 82, and Example 88, after the paper passing test, using the short direction as the feeding direction, 110,000 sheets 50% halftone (black) images were continuously formed (a total of 200,000 images) in an environment of normal temperature and normal humidity (23° C., 55% RH), and the electrical property evaluation was carried out. The results are shown in Table 3.

TABLE 3

| | Exposed portion potential (200,000 sheets; V) | | |
|---|---|---|---|
| | Before paper passing | After paper passing | Potential change |
| Example 1 | 60 | 90 | 30 |
| Example 2 | 85 | 140 | 55 |
| Example 3 | 55 | 80 | 25 |
| Example 15 | 65 | 140 | 75 |
| Example 16 | 60 | 115 | 55 |
| Example 17 | 55 | 60 | 5 |
| Example 18 | 70 | 80 | 10 |
| Example 19 | 50 | 55 | 5 |
| Example 27 | 55 | 65 | 10 |
| Example 28 | 55 | 55 | 0 |
| Example 34 | 85 | 105 | 20 |
| Example 35 | 60 | 90 | 30 |
| Example 36 | 65 | 90 | 25 |
| Example 37 | 80 | 85 | 5 |
| Example 38 | 55 | 65 | 10 |
| Example 39 | 75 | 80 | 5 |
| Example 40 | 60 | 60 | 0 |
| Example 43 | 70 | 80 | 10 |
| Example 49 | 75 | 80 | 5 |
| Example 50 | 70 | 80 | 10 |
| Example 56 | 70 | 70 | 0 |
| Example 59 | 60 | 70 | 10 |
| Example 65 | 60 | 75 | 15 |
| Example 66 | 70 | 85 | 15 |
| Example 67 | 75 | 85 | 10 |
| Example 73 | 75 | 75 | 0 |
| Example 76 | 60 | 80 | 20 |
| Example 82 | 75 | 90 | 15 |
| Example 88 | 85 | 90 | 5 |

From the results in Table 3, it is shown that in the electrophotographic photoconductors in Examples 1 to 3, Examples 15 to 16, Examples 34 to 36, Example 43, Example 49, Example 50, Example 59, Examples 65 to 67, Example 76, and Example 82, the amount of fluctuation in exposed portion potential after the running of a total of 200,000 sheets is relatively large, whereas in the electrophotographic photoconductors in Examples 17 to 19, Example 27, Example 28, Examples 37 to 40, Example 56, Example 73, and Example 88, the amount of fluctuation in exposed portion potential after the running of 200,000 sheets is small and comparable to the exposed portion potential after the running of 90,000 sheets, and when Ga-doped zinc oxide fine particles in which the volume resistivity of the fine particles in the surface layer is $1\times10^4$ Ω·cm or more or the Si content is 2% by mass or more are used, the electrophotographic photoconductors have very high electrostatic stability.

In addition, it is shown that the electrophotographic photoconductors in Example 43, Example 44, Example 49, Example 50, Example 59, Example 60, Example 65, Example 66, Example 67, Example 76, Example 77, and Example 82 contain a small amount of a compound (any of the compounds represented by the formulas (1) to (7)) used in the present invention, and therefore have high electrostatic stability though the volume resistivity of the fine particles in the surface layer is $1\times10^4$ Ω·cm or less. It is found that in Example 56, the volume resistivity of the fine particles in the surface layer is $1\times10^4$ Ω·cm or more, and in addition, the electrophotographic photoconductor contains a small amount of a compound (any of the compounds represented by the formulas (1) to (7)) used in the present invention, and therefore, the electrophotographic photoconductor has particularly high electrostatic stability.

Aspects of the present invention are, for example, as follows.

<1> An electrophotographic photoconductor, including:

an electroconductive substrate; and at least a photoconductive layer and a surface layer in this order over the electroconductive substrate, wherein the surface layer includes first inorganic fine particles and a resin having no charge transport properties, and wherein the first inorganic fine particles are inorganic fine particles having surfaces modified with at least one of a primary amino group and a secondary amino group, and a volume resistivity of the first inorganic fine particles is $1\times10^{8}$ t) cm or less.

<2> The electrophotographic photoconductor according to <1>, wherein the surface layer contains a compound represented by the following general formula (1):

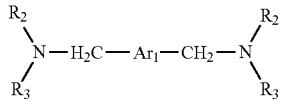

wherein $R_2$ and $R_3$ may be the same or different, and represent a substituted or unsubstituted alkyl group or a substituted or unsubstituted aromatic hydrocarbon group, and either one of $R_2$ and $R_3$ is a substituted or unsubstituted aromatic hydrocarbon group; $R_2$ and $R_3$ may be bonded to each other to form a substituted or unsubstituted heterocyclic group containing a nitrogen atom; and $Ar_1$ represents a substituted or unsubstituted aromatic hydrocarbon group.

<3> The electrophotographic photoconductor according to <1>, wherein the surface layer contains an arylmethane compound having an alkylamino group.

<4> The electrophotographic photoconductor according to <3>, wherein the arylmethane compound having an alkylamino group is a compound represented by the following general formula (2):

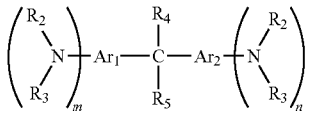

wherein $R_2$ and $R_3$ represent either of a substituted or unsubstituted aromatic hydrocarbon group and a substituted or unsubstituted alkyl group, and may be the same or different, and $R_2$ and $R_3$ may be bonded to each other to form a heterocyclic group containing a nitrogen atom; m and n represent an integer of 0 to 3, and m and n are not simultaneously 0; $R_4$ and $R_5$ represent any of a hydrogen atom, a substituted or unsubstituted alkyl group having 1 to 11 carbon atoms, and a substituted or unsubstituted aromatic hydrocarbon group, and may be the same or different; and $Ar_1$ and $Ar_2$ represent a substituted or unsubstituted aromatic hydrocarbon group, and may be the same or different.

<5> The electrophotographic photoconductor according to <3>, wherein the arylmethane compound having an alkylamino group is a compound represented by the following general formula (3):

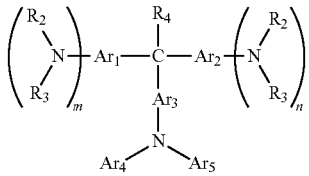

wherein $R_2$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $R_4$ represents a hydrogen atom, a substituted or unsubstituted alkyl group having 1 to 11 carbon atoms, or a substituted or unsubstituted aromatic hydrocarbon group; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

<6> The electrophotographic photoconductor according to <3>, wherein the arylmethane compound having an alkylamino group is a compound represented by the following general formula (4):

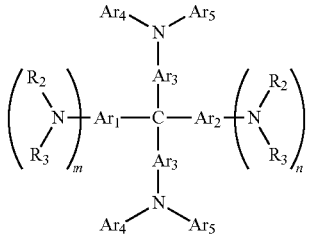

wherein $R_2$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

<7> The electrophotographic photoconductor according to <3>, wherein the arylmethane compound having an alkylamino group is a compound represented by the following general formula (5):

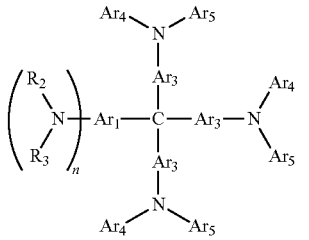

wherein $R_2$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

<8> The electrophotographic photoconductor according to <1>, wherein the surface layer contains a compound represented by the following general formula (6):

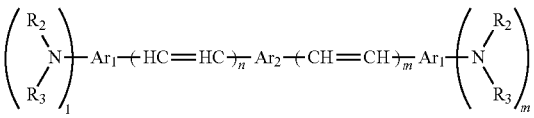

wherein $R_2$ and $R_3$ represent either of a substituted or unsubstituted aromatic hydrocarbon group and a substituted or unsubstituted alkyl group, and may be the same or different, and $R_2$ and $R_3$ may be bonded to each other to form a heterocyclic group containing a nitrogen atom; $Ar_1$ and $Ar_2$ represent a substituted or unsubstituted aromatic hydrocarbon group; l and m represent an integer of 0 to 3, and l and m are not simultaneously 0; and n represents an integer of 1 to 3.

<9> The electrophotographic photoconductor according to <1>, wherein the surface layer contains a compound represented by the following general formula (7):

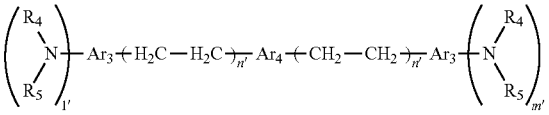

wherein $R_4$ and $R_5$ represent either of a substituted or unsubstituted aromatic hydrocarbon group and a substituted or unsubstituted alkyl group, and may be the same or different, and $R_4$ and $R_5$ may be bonded to each other to form a heterocyclic group containing a nitrogen atom; $Ar_3$ and $Ar_4$ represent a substituted or unsubstituted aromatic hydrocarbon group; l' and m' each represent an integer of 0 to 3, provided that l' and m' are not simultaneously 0; and n' represents an integer of 1 to 3.

<10> The electrophotographic photoconductor according to any one of <1> to <9>, wherein the at least one of the primary amino group and the secondary amino group is a phenylamino group.

<11> The electrophotographic photoconductor according to any one of <1> to <10>, wherein the first inorganic fine particles are zinc oxide fine particles.

<12> The electrophotographic photoconductor according to <11>, wherein the first inorganic fine particles are doped with gallium.

<13> The electrophotographic photoconductor according to <12>, wherein the zinc oxide particles surface-modified and doped with gallium contain Si, and the content of the Si is 2% by mass to 15% by mass in terms of $SiO_2$.

<14> The electrophotographic photoconductor according to any one of <1> to <13>, wherein the volume resistivity of the first inorganic fine particles is $1\times10^3$ Ω·cm or more.

<15> The electrophotographic photoconductor according to any one of <1> to <14>, wherein the surface layer further contains second inorganic fine particles.

<16> The electrophotographic photoconductor according to any one of <1> to <15>, wherein the resin having no charge transport properties is a crosslinked resin.

<17> An image forming apparatus, including;

an electrophotographic photoconductor;

a charging unit configured to charge a surface of the electrophotographic photoconductor;

an exposure unit configured to expose the charged surface of the electrophotographic photoconductor to light to form an electrostatic latent image;

a developing unit configured to develop the electrostatic latent image with a toner to form a visible image; and a transfer unit configured to transfer the visible image to a recording medium, wherein the electrophotographic photoconductor is the electrophotographic photoconductor according to any one of <1> to <16>.

<18> A process cartridge, including;

an electrophotographic photoconductor; and at least one selected from the group consisting of a charging unit configured to charge a surface of the electrophotographic photoconductor, an exposure unit configured to expose the charged surface of the electrophotographic photoconductor to light to form an electrostatic latent image, a developing unit configured to develop the electrostatic latent image with a toner to form a visible image, and a transfer unit configured to transfer the visible image to a recording medium, wherein the electrophotographic photoconductor is the electrophotographic photoconductor according to any one of <1> to <16>.

This application claims priority to Japanese application No. 2013-005567, filed on Jan. 16, 2013, Japanese application No. 2013-129362, filed on Jun. 20, 2013, and Japanese application No. 2013-220117, filed on Oct. 23, 2013, and incorporated herein by reference.

What is claimed is:

1. An electrophotographic photoconductor, comprising:

an electroconductive substrate; and at least a photoconductive layer and a surface layer in this order over the electroconductive substrate, wherein the surface layer comprises first inorganic fine particles and a resin having no charge transport properties, and wherein the first inorganic fine particles are inorganic fine particles having surfaces modified with at least one of a primary amino group and a secondary amino group, and a volume resistivity of the first inorganic fine particles is $1\times10^8$ Ω·cm or less.

2. The electrophotographic photoconductor according to claim 1, wherein the surface layer comprises a compound represented by the following general formula (1):

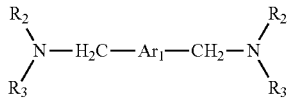

wherein $R_2$ and $R_3$ may be the same or different, and represent a substituted or unsubstituted alkyl group or a substituted or unsubstituted aromatic hydrocarbon group, and either one of $R_2$ and $R_3$ is a substituted or unsubstituted aromatic hydrocarbon group; $R_2$ and $R_3$ may be bonded to each other to form a substituted or unsubstituted heterocyclic group containing a nitrogen atom; and $Ar_1$ represents a substituted or unsubstituted aromatic hydrocarbon group.

3. The electrophotographic photoconductor according to claim 1, wherein the surface layer comprises an arylmethane compound having an alkylamino group.

4. The electrophotographic photoconductor according to claim 3, wherein the arylmethane compound having an alkylamino group is a compound represented by the following general formula (2):

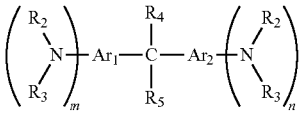

wherein $R_2$ and $R_3$ represent either of a substituted or unsubstituted aromatic hydrocarbon group and a substituted or unsubstituted alkyl group, and may be the same or different, and $R_2$ and $R_3$ may be bonded to each other to form a heterocyclic group containing a nitrogen atom; m and n represent an integer of 0 to 3, and m and n are not simultaneously 0; $R_4$ and $R_5$ represent any of a hydrogen atom, a substituted or unsubstituted alkyl group having 1 to 11 carbon atoms, and a substituted or unsubstituted aromatic hydrocarbon group, and may be the same or different; and $Ar_1$ and $Ar_2$ represent a substituted or unsubstituted aromatic hydrocarbon group, and may be the same or different.

5. The electrophotographic photoconductor according to claim 3, wherein the arylmethane compound having an alkylamino group is a compound represented by the following general formula (3):

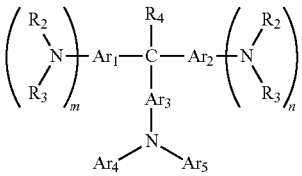

wherein $R_2$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $R_4$ represents a hydrogen atom, a substituted or unsubstituted alkyl group having 1 to 11 carbon atoms, or a substituted or unsubstituted aromatic hydrocarbon group; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

6. The electrophotographic photoconductor according to claim 3, wherein the arylmethane compound having an alkylamino group is a compound represented by the following general formula (4):

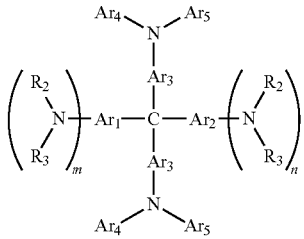

wherein $R_2$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

7. The electrophotographic photoconductor according to claim 3, wherein the arylmethane compound having an alkylamino group is a compound represented by the following general formula (5):

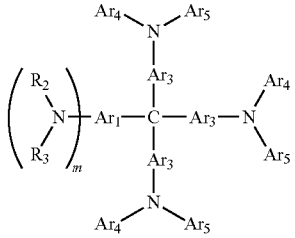

wherein $R_2$ and $R_3$ represent either of a substituted or unsubstituted aromatic hydrocarbon group and a substituted or unsubstituted alkyl group having 1 to 4 carbon atoms, and may be the same or different, and $R_2$ and $R_3$ may be bonded to each other to form a heterocyclic group containing a nitrogen atom; m and n represent an integer of 0 to 3, provided that m and n are not simultaneously 0; $Ar_1$, $Ar_2$, $Ar_3$, $Ar_4$, and $Ar_5$ represent a substituted or unsubstituted aromatic hydrocarbon group, and may be the same or different; and $Ar_4$ and $Ar_5$, or $Ar_4$ and $Ar_3$ may be bonded to each other to form a heterocyclic group containing a nitrogen atom.

8. The electrophotographic photoconductor according to claim 1, wherein the surface layer comprises a compound represented by the following general formula (6):

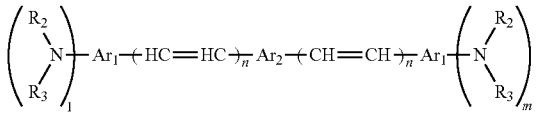

wherein $R_2$ and $R_3$ represent either of a substituted or unsubstituted aromatic hydrocarbon group and a substituted or unsubstituted alkyl group, and may be the same or different, and $R_2$ and $R_3$ may be bonded to each other to form a heterocyclic group containing a nitrogen atom; $Ar_1$ and $Ar_2$ represent a substituted or unsubstituted aromatic hydrocarbon group; 1 and m represent an integer of 0 to 3, and 1 and m are not simultaneously 0; and n represents an integer of 1 to 3.

9. The electrophotographic photoconductor according to claim 1, wherein the surface layer comprises a compound represented by the following general formula (7):

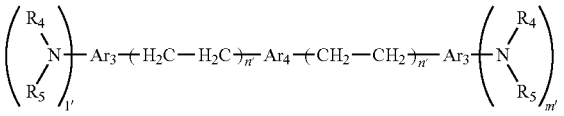

wherein $R_4$ and $R_5$ represent either of a substituted or unsubstituted aromatic hydrocarbon group and a substituted or unsubstituted alkyl group, and may be the same or different, and $R_4$ and $R_5$ may be bonded to each other to form a heterocyclic group containing a nitrogen atom; $Ar_3$ and $An_4$ represent a substituted or unsubstituted aromatic hydrocarbon group; l' and m' each represent an integer of 0 to 3, provided that l' and m' are not simultaneously 0; and n' represents an integer of 1 to 3.

10. The electrophotographic photoconductor according to claim 1, wherein the at least one of the primary amino group and the secondary amino group is a phenylamino group.

11. The electrophotographic photoconductor according to claim 1, wherein the first inorganic fine particles are zinc oxide fine particles.

12. The electrophotographic photoconductor according to claim 11, wherein the first inorganic fine particles are doped with gallium.

13. The electrophotographic photoconductor according to claim 12, wherein the zinc oxide particles surface-modified and doped with gallium comprise Si, and the content of the Si is 2% by mass to 15% by mass in terms of $SiO_2$.

14. The electrophotographic photoconductor according to claim 1, wherein the volume resistivity of the first inorganic fine particles is $1\times10^3$ Ω·cm or more.

15. The electrophotographic photoconductor according to claim 1, wherein the surface layer further comprises second inorganic fine particles.

16. The electrophotographic photoconductor according to claim 1, wherein the resin having no charge transport properties is a crosslinked resin.

17. The electrophotographic photoconductor according to claim 1, wherein the surface layer is a layer of resin having no charge transport properties with said first inorganic fine particles dispersed therein.

18. An image forming apparatus, comprising:

an electrophotographic photoconductor;

a charging unit configured to charge a surface of the electrophotographic photoconductor;

an exposure unit configured to expose the charged surface of the electrophotographic photoconductor to light to form an electrostatic latent image;

a developing unit configured to develop the electrostatic latent image with a toner to form a visible image; and a transfer unit configured to transfer the visible image to a recording medium, wherein the electrophotographic photoconductor is an electrophotographic photoconductor which comprises:

an electroconductive substrate; and at least a photoconductive layer and a surface layer in this order over the electroconductive substrate, wherein the surface layer comprises a resin having no charge transport properties, and first inorganic fine particles, and wherein the first inorganic fine particles are inorganic fine particles having surfaces modified with at least one of a primary amino group and a secondary amino group, and a volume resistivity of the first inorganic fine particles is $1\times10^8$ Ω·cm or less.

19. A process cartridge, comprising:

an electrophotographic photoconductor; and at least one selected from the group consisting of a charging unit configured to charge a surface of the electrophotographic photoconductor, an exposure unit configured to expose the charged surface of the electrophotographic photoconductor to light to form an electrostatic latent image, a developing unit configured to develop the electrostatic latent image with a toner to form a visible image, and a transfer unit configured to transfer the visible image to a recording medium, wherein the electrophotographic photoconductor is an electrophotographic photoconductor which comprises:

an electroconductive substrate; and at least a photoconductive layer and a surface layer in this order over the electroconductive substrate, wherein the surface layer comprises a resin having no charge transport properties, and first inorganic fine particles, and wherein the first inorganic fine particles are inorganic fine particles having surfaces modified with at least one of a primary amino group and a secondary amino group, and a volume resistivity of the first inorganic fine particles is $1\times10^8$ Ω·cm or less.

* * * * *